US007150127B2

(12) United States Patent
Underwood et al.

(10) Patent No.: US 7,150,127 B2
(45) Date of Patent: Dec. 19, 2006

(54) PARTITION SYSTEM

(75) Inventors: Robert A. Underwood, Jasper, IN (US); Keith E. Metcalf, Huntingburg, IN (US); Ryan A. Herbig, Jasper, IN (US); J. Douglas Mitchell, Newburgh, IN (US)

(73) Assignee: Kimball International, Inc., Jasper, IN (US)

( * ) Notice: Subject to any disclaimer, the term of this patent is extended or adjusted under 35 U.S.C. 154(b) by 222 days.

(21) Appl. No.: 10/453,187

(22) Filed: Jun. 3, 2003

(65) Prior Publication Data

US 2004/0093805 A1 May 20, 2004

Related U.S. Application Data

(60) Provisional application No. 60/426,994, filed on Nov. 15, 2002, provisional application No. 60/386,775, filed on Jun. 6, 2002.

(51) Int. Cl.
*E04B 2/74* (2006.01)
*E04B 2/00* (2006.01)
*E04B 1/00* (2006.01)

(52) U.S. Cl. ..... 52/36.1; 52/36.5; 52/36.6; 52/67; 52/641; 52/645; 52/646; 52/653.1; 52/772; 52/695; 52/775; 52/282.1; 52/272; 52/731.5; 52/731.9; 160/130; 160/181; 160/182; 160/184; 160/371; 160/372; 160/374; 160/377; 108/106; 108/107

(58) Field of Classification Search ..... 52/36.1–6, 52/645, 646, 683.1, 651.1, 677, 772, 695, 52/770, 775, 282.1, 282.2, 731.5, 731.9, 52/204.62, 204.67, 204.68, 204.7, 64, 67, 52/506.07, 506.09, 636, 638, 641; 108/106–108; 182/156, 164, 177, 187–188, 178.4, 182.1–5, 182/183.1; 160/371–372, 374, 377, 130, 160/181, 182, 184
See application file for complete search history.

(56) References Cited

U.S. PATENT DOCUMENTS

| | | | | | |
|---|---|---|---|---|---|
| 1,666,414 | A * | 4/1928 | Foster | 52/638 |
| 2,121,213 | A | 6/1938 | Small | 189/85 |
| 2,357,819 | A | 9/1944 | Greer | 160/351 |
| 2,982,379 | A * | 5/1961 | Fisher | 52/111 |
| 3,095,070 | A * | 6/1963 | McDonald | 52/638 |
| 3,290,846 | A | 12/1966 | Mader et al. | 52/479 |
| 3,425,568 | A | 2/1969 | Albright | 211/87 |
| 3,622,012 | A | 11/1971 | Lundgren | 211/126 |
| 3,686,805 | A | 8/1972 | Pofferi | 52/64 |
| 3,745,732 | A | 7/1973 | Pritchard et al. | 52/239 |

(Continued)

FOREIGN PATENT DOCUMENTS

DE 40 04 200 8/1991

(Continued)

*Primary Examiner*—Jeanette Chapman
(74) *Attorney, Agent, or Firm*—Baker & Daniels

(57) ABSTRACT

A partition system for office spaces generally includes a framework and a plurality of different types of decorative and/or functional tiles mountable to the framework. The framework includes I- and C-shaped vertical frame members which are adjustably joined by upper and lower horizontal spanners such that the distance between the vertical frame members is adjustable. Also, the framework may include other types of vertical frame members for forming L-, T-, or X-junctions within the partition system framework. A variety of decorative and functional tiles are mountable to the framework, including retractable workspace tiles, several types of storage tiles, display tiles, window tiles, and electrical and data services tiles.

15 Claims, 67 Drawing Sheets

U.S. PATENT DOCUMENTS 3,875,711 A 4/1975 Palmer ..... 52/239
3,916,972 A 11/1975 Breiner ..... 160/135
4,008,872 A 2/1977 Thompson ..... 248/224.2
4,034,864 A 7/1977 Tyson et al. ..... 211/50
4,136,785 A * 1/1979 McDevitt ..... 211/190
4,274,687 A 6/1981 Bayles et al. ..... 312/205
4,338,990 A 7/1982 Blodee et al. ..... 160/229 R
4,508,300 A 4/1985 Minick ..... 248/216.1
4,535,577 A 8/1985 Tenser et al. ..... 52/221
4,542,832 A 9/1985 Minick et al. ..... 211/106
4,573,513 A 3/1986 Small et al. ..... 160/135
4,602,470 A * 7/1986 Stuart et al. ..... 52/651.1
4,631,881 A 12/1986 Charman ..... 52/220
4,660,339 A 4/1987 Paz ..... 52/238.1
4,876,835 A 10/1989 Kelley et al. ..... 52/239
4,944,122 A 7/1990 Wendt ..... 52/36
5,038,539 A 8/1991 Kelley et al. ..... 52/239
5,056,285 A 10/1991 Frascaroli et al. ..... 52/243
D321,801 S 11/1991 Friedman ..... D6/492
5,129,200 A 7/1992 Kaneko ..... 52/205
5,142,832 A 9/1992 Branham, Sr. et al. ..... 52/36
5,155,955 A 10/1992 Ball et al. ..... 52/126.4
5,230,197 A * 7/1993 Hart ..... 52/653.2
5,309,686 A * 5/1994 Underwood et al. ..... 52/29
5,328,287 A * 7/1994 Gilb ..... 403/231
5,345,737 A * 9/1994 Latchinian ..... 52/280
5,394,668 A 3/1995 Lim ..... 52/438.1
5,399,044 A * 3/1995 Gilb ..... 403/231
5,406,760 A 4/1995 Edwards ..... 52/239
5,483,779 A 1/1996 Crawford et al. ..... 52/645
5,537,290 A 7/1996 Brown et al. ..... 361/681
5,634,300 A * 6/1997 Huebner et al. ..... 52/36.1
5,740,650 A 4/1998 Seiber et al. ..... 52/584.1
5,784,843 A 7/1998 Greer et al. ..... 52/220.7
5,816,001 A * 10/1998 Goodman et al. ..... 52/239
5,881,500 A * 3/1999 Latino et al. ..... 52/36.1
5,881,518 A 3/1999 Edwards et al. ..... 52/239
5,899,035 A 5/1999 Waalkes et al. ..... 52/239
5,921,040 A 7/1999 Glashouwer et al. ..... 52/239
5,950,386 A 9/1999 Shipman et al. ..... 52/481.2
5,979,118 A * 11/1999 Gortsema et al. ..... 52/36.1
6,009,676 A * 1/2000 Feldpausch et al. ..... 52/239
6,073,399 A 6/2000 Shipman et al. ..... 52/36.1
6,079,173 A * 6/2000 Waalkes et al. ..... 52/239
6,112,472 A 9/2000 Can Dyk et al. ..... 52/36.1
6,128,876 A 10/2000 Nitschke et al. ..... 52/239
6,128,877 A * 10/2000 Goodman et al. ..... 52/242
6,173,545 B1 1/2001 Feldpausch et al. ..... 52/239
6,189,268 B1 2/2001 Carr et al. ..... 52/36.1
6,230,445 B1 5/2001 Arko et al. ..... 52/36.5
6,230,459 B1 5/2001 Jeffers et al. ..... 52/239
6,266,935 B1 7/2001 Seiber et al. ..... 52/241
6,282,854 B1 * 9/2001 Vos et al. ..... 52/239
D449,748 S 10/2001 Martin et al. ..... D6/436
6,330,773 B1 * 12/2001 MacDonald et al. ..... 52/239
6,349,516 B1 * 2/2002 Powell et al. ..... 52/239
6,378,255 B1 * 4/2002 Eich et al. ..... 52/220.7
6,425,219 B1 7/2002 Barmak et al. ..... 52/239
6,442,909 B1 * 9/2002 Waalkes et al. ..... 52/239
6,470,990 B1 * 10/2002 Panoz ..... 180/311
6,516,732 B1 * 2/2003 LaCombe et al. ..... 108/180
6,540,094 B1 * 4/2003 Baloga et al. ..... 211/94.01
6,553,731 B1 4/2003 Hsueh ..... 52/239
D481,226 S 10/2003 Overthun et al. ..... D6/492
6,665,935 B1 * 12/2003 Panoz ..... 29/897.2
D485,096 S 1/2004 Smith et al. ..... D6/492
6,729,244 B1 * 5/2004 Cattaneo ..... 108/155
6,745,525 B1 * 6/2004 High ..... 52/220.7
6,751,914 B1 * 6/2004 Zeh et al. ..... 52/239
6,802,169 B1 * 10/2004 Simmons ..... 52/648.1
6,837,016 B1 * 1/2005 Simmons et al. ..... 52/655.1
2002/0053174 A1 5/2002 Barmak ..... 52/220.7
2003/0154673 A1 8/2003 MacGregor et al. ..... 52/239
2003/0196388 A1 10/2003 Edwards ..... 52/36.1

FOREIGN PATENT DOCUMENTS

DE 40 35 367 5/1992

* cited by examiner

PARTITION SYSTEM

CROSS REFERENCE TO RELATED APPLICATIONS

This application claims the benefit under Title 35, U.S.C. § 119(e) of U.S. Provisional Patent Application Ser. No. 60/386,775, entitled PARTITION SYSTEM, filed on Jun. 6, 2002, as well as U.S. Provisional Patent Application Ser. No. 60/426,994, entitled PARTITION SYSTEM, filed on Nov. 15, 2002.

BACKGROUND OF THE INVENTION

1. Field of the Invention

The present invention relates to partition systems of the type used in office spaces, and more particularly, to a movable and reconfigurable office partition system including a framework to which decorative and/or functional tiles are attached for subdividing an office space.

2. Description of the Related Art

Partition systems, which are used to divide interior office spaces, typically include a plurality of panels, each having a rectangular frame formed from vertical and horizontal frame members rigidly connected to one another. Panel tiles are mounted to the rectangular frames to cover the frames and to subdivide the office space into individual spaces such as work stations, conference rooms, and the like. Typically, the individual panels in the system are connected by attaching the rectangular frames of adjacent panels together along the side edges of the rectangular frames. The panels may be connected in an end-to-end manner to form a partition wall, or may be connected to one another to form L-, T-, or X-type panel-to-panel connections to form junctions between the partition walls.

In partition systems having the foregoing construction, the connections along the side edges of the rectangular panel frames are typically the weakest points in the entire partition system. Therefore, in order to provide rigid, durable connections between the panel frames, a plurality of brackets, latches, or other structures are needed, which may be difficult and tedious to install.

Additionally, known partition systems typically include decorative tiles for mounting to the panel frames to provide privacy between the individual work space areas within the office space which are formed by the partition system. The decorative tiles are sized to have a width which is co-extensive with the rectangular frames, which disadvatageously limits the locational positioning of the tiles on the frames and does not allow for flexibility in the configuration of the tiles relative to the frames.

Modular furniture components, such as work surfaces, cabinets and the like are typically mounted to the panels using specialized brackets or other hardware. Thus, the modular furniture components are disposed in a fixed position relative to the panels and are not easily movable or reconfigurable with respect thereto. In this manner, the decorative and space-dividing functions are performed by the decorative tile, while other functions, such as storage, are provided only by the modular furniture components.

Existing partition systems are substantially fixed after their initial installation, and do not permit easy reconfiguration thereof based upon changing space demands in a workspace. Existing systems further do not permit easy expansion, in which additional partition systems components are added to partition system components which are already installed.

What is needed is a partition system for office spaces which is an improvement over the foregoing.

SUMMARY OF THE INVENTION

The present invention provides a partition system for office spaces which generally includes a structure or framework, and a plurality of different types of decorative and/or functional tiles mountable to the framework. The framework includes I- and C-shaped vertical frame members which are adjustably joined by upper and lower horizontal spanners such that the distance between the vertical frame members is adjustable. Also, the framework may include other types of vertical frame members for forming L-, T-, or X-junctions within the partition system framework. Decorative tiles and a variety of functional tiles, are mountable to the framework, including retractable workspace tiles, several types of storage tiles, display tiles, window tiles, and electrical and data services tiles.

The horizontal spanners are adjustably mounted between the vertical frame members such that the distance between the vertical frame members may be modified as desired to create framework sections of varying width. The vertical frame members each include one or more upper and lower horizontal sub-frame members which are fixedly attached to the vertical frame members, and may also include one or more horizontal mid-channel members detachably mounted to the vertical frame members. The sub-frame members and mid-channel members support track members which extend horizontally along the partition system framework. The track members provide attachment points for mounting modular furniture components to the framework, and also support decorative and/or functional tiles on the framework. The number of mid-channel members may be varied to in turn vary the number and configuration of track members along the framework, which in turn allows tiles of varying height and/or width to be mounted upon the framework in a desired configuration.

The track members are attached to adjacent pairs of upper sub-frame members or to adjacent pairs of mid-channel members in a fastenerless manner, in which the track members are hung over edge portions of the upper sub-frame members and the mid-channel members. Thus, the track members are easily attachable to the framework without the use of fasteners or tools, such that the configuration of track members upon the framework, and in turn, the configuration of the tiles which are supported upon the framework by the track members, may be easily varied to suit the requirements of users of the partition system. Further, the track members each include anti-dislodgement structure cooperating with the upper sub-frame members and the mid-channel members.

The track members may extend horizontally along the framework, wherein the length of the track members is not determined by the placement or location of the vertical frame members within the framework. Further, each tile is supported between a pair of vertically spaced track members at any of an essentially infinite number of horizontal positions, regardless of the positioning of the underlying framework structure. In this manner, the placement and location of the tiles is not dependent upon the configuration of the framework which is covered by the tiles. Rather, the placement and location of the tiles is completely independent of the specific configuration of the framework.

Further, decorative tiles may be attached to the framework which either cover individual framework sections of the framework, or which span multiple framework sections or portions of adjacent framework sections. In this manner, because the tiles are attached to track members which may be configured differently on each side of the framework and which span one or more framework sections, the location and size of the tiles with respect to the framework need not correlate with the individual framework sections. Thus, for example, relatively large or wide tiles may be attached to the framework which span more than one framework section, and relatively smaller or narrow tiles may be used which span only one framework section or only a portion of a framework section. The track members are independently attachable to each side of the partition system framework, such that the location and placement of tiles on one side of the partition system framework may be configured differently than the location and placement of tiles on the opposite side of the partition system framework.

The track members of the partition system framework may be horizontally aligned with identical track members which are mounted to permanent, existing walls in the office space to provide aesthetic and visual continuity between the partition system and the existing walls within an office space. Further, a connection system is provided for connecting an end portion of the framework of the partition system to the track members of the permanent walls within an office space. Alternatively, the partition system may be free-standing within an interior office space, wherein the partition system is not connected to any of the existing, permanent walls of the office space. In a free-standing partition system, the framework of one framework run may be connected at selectively variable locations along the track members of the framework of another framework run, to provide an off-module connection between two runs within the framework of the partition system.

Additionally, a variety of decorative and functional tiles are provided for attaching to the partition system framework. The decorative tiles may include any exterior facing such as fabric, vinyl, metal, or a functional surface such as a marker board, chalk board, projection screen or a tack board, for example. Functional tiles may include retractable work station tiles and a variety of different types of storage tiles for storing papers and other materials used within an office environment. The decorative and functional tiles are mounted to the framework without the use of tools, such that the particular arrangement of functional and/or decorative tiles on the partition system framework may be easily reconfigured to suit the particular needs of workers within the office space. Additionally, the storage tiles provide storage space within the interior of the partition system framework, in contrast with existing systems, in which the space within the interior of the partition system framework is occupied by filler material or is not used at all.

Also, a file pocket is provided which is sized to hold standard sized paper, or other office supplies. The file pocket is further dimensioned to be received within a standard sized drawer of a filing cabinet. The file pocket may also be received within the storage cavity or retractable storage bin of a storage tile of the partition system. Further, the file pocket includes hooks for mounting the file pocket to a track member of the partition system. In this manner, the file pocket provides a portable storage component which may be conveniently be moved between known casegoods, such as a filing cabinet, and the present partition system.

In another form of the present invention, a two-piece adjustable work surface support bracket is provided, which attaches to a track member of the partition system for supporting a work surface. A vertical member of the bracket includes a mounting portion adapted to be received within a track member, and a plate portion extending from the mounting portion which includes a plurality of vertically spaced slots. A horizontal member is attached to a work surface using suitable fasteners, and includes a tab which is received within any one of the vertically spaced slots in the vertical member. In this manner, a work surface may be mounted to a track member of the partition system in a vertically adjustable manner.

In a further form of the present invention, a work surface support post is provided which attaches in an adjustable manner to the vertical member of the foregoing work surface support bracket, thereby adjustably mounting the work surface to a track member of the partition system. The support post also engages the floor to support at least a portion of the load of the work surface on the floor, while also providing knee space beneath the work surface for a user seated at the work surface.

In one form thereof, the present invention provides a workspace partition system, including a framework including at least two adjacent frame elements, each the frame element including a vertical upright having upper and lower ends; at least one sub-frame member secured to a least one of the upper end and the lower end of each of the vertical uprights and extending horizontally therefrom; and at least one horizontal spanner adjustably connected at opposite ends thereof to adjacent sub-frame members of the adjacent frame elements, whereby the distance between the vertical uprights of the adjacent frame elements may be varied.

In another form thereof, the present invention provides a partition system, including a framework including a plurality of vertical frame elements, the vertical frame elements connected by a plurality of horizontal frame elements; at least two horizontal track members connected to the framework, the track members vertically spaced from one another and including tile-retaining structure; and at least one tile retained between the track members and disposed facewise adjacent the framework, the tile selectively locatable at any one of a plurality of horizontally spaced locations along the track members irrespective of the positioning of the frame elements.

In a further form thereof, the present invention provides a partition system, including a framework, including: at least three frame elements disposed in a row, each frame element including a vertical upright to which is secured at least one sub-frame member which extends horizontally therefrom; and horizontal spanners connecting adjacent sub-frame members of adjacent frame elements to form a pair of adjacent framework sections which share one of the frame elements as a common frame element therebetween; and at least one tile mounted to the framework, the tile covering at least a portion of each of the framework sections.

In a further form thereof, the present invention provides, in combination, a permanent wall including at least one track member mounted thereon, the track member disposed horizontally and defining a channel which opens outwardly of the permanent wall; and a partition system framework having at least one track member mounted thereon, the track member disposed horizontally and defining a channel which opens outwardly of the framework, the framework attached to at least one track member on the permanent wall, and at least one track member on the permanent wall and at least one track member on the framework horizontally aligned with one another.

In a further form thereof, the present invention provides, in combination, a lower framework, including a plurality of lower frame elements, each lower frame element including a vertical upright to which is attached at least one horizontal sub-frame member; and a horizontal spanner connecting the sub-frame members of adjacent lower frame elements; and an upper framework attached to and disposed above the lower framework, including a plurality of upper frame elements, each upper frame element including a vertical upright to which at least one horizontal sub-frame member is attached, the uprights of the upper frame elements attached to and vertically aligned with the uprights of the lower frame elements; and a horizontal spanner connecting the sub-frame members of adjacent upper frame elements.

In a further form thereof, the present invention provides a partition system, including a framework including vertical frame elements and horizontal frame elements, the horizontal frame elements having longitudinally extending edge portions; and at least one horizontal track member attached to a respective edge portion of at least one of the horizontal frame elements.

In a further form thereof, the present invention provides, in combination, a partition system, including a framework having a partition system component mounted thereon, the partition system component having receiving structure; and a portable storage compartment dimensioned for receipt within a drawer of a filing cabinet, the storage compartment having a body portion and attachment structure, the attachment structure attached to the receiving structure to attach the storage compartment to the partition system.

In a further form thereof, the present invention provides, in combination, a partition system including a horizontal track member defining an outwardly facing channel; and a work surface support bracket, including a first portion mountable within the channel, and a second portion attached to a work surface, the second portion adjustably attached to the first portion whereby the work surface is supported on the partition system.

In a further form thereof, the present invention provides, in combination, a partition system supported on a floor surface, the partition system including a horizontal track member defining an outwardly facing channel; and a work surface support post engaging the floor and including a first portion mountable within the channel, and a second portion attached to a work surface, the second portion adjustably attached to the first portion whereby the work surface is supported by the partition system and by the floor.

BRIEF DESCRIPTION OF THE DRAWINGS

The above-mentioned and other features and advantages of this invention, and the manner of attaining them, will become more apparent and the invention itself will be better understood by reference to the following description of an embodiment of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention any manner.

DETAILED DESCRIPTION

Figure 1:
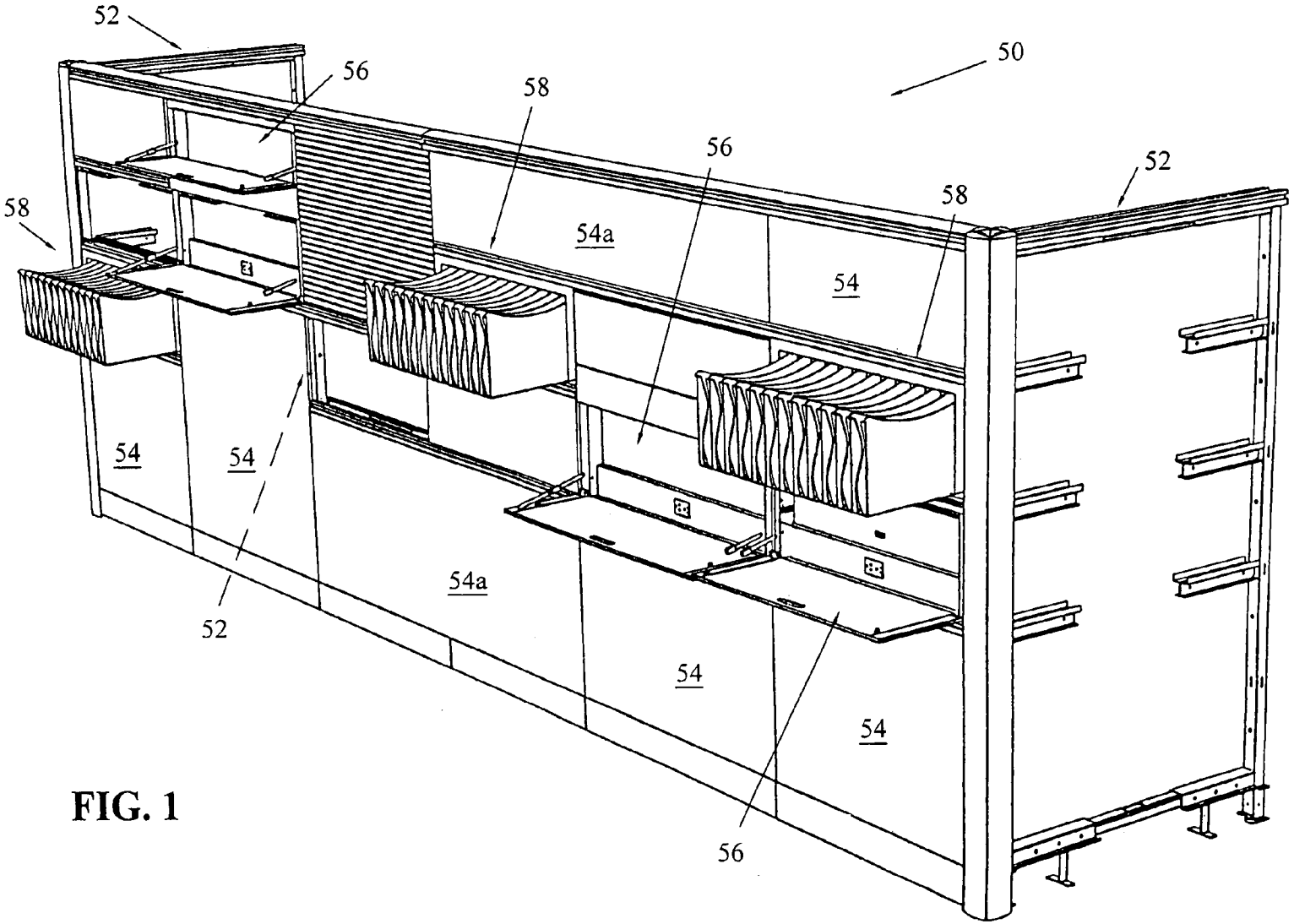
FIG. 1 is a perspective view of an exemplary partition system according to the present invention.

Referring to FIG. 1, partition system 50 is shown, of the type generally used in office spaces for dividing an interior office space into separate workspaces, such as work stations, conference rooms, reception rooms, and common areas, for example. Partition system 50 generally includes a framework or structure 52 (a portion of which is visible in FIG. 1), to which decorative and/or functional tiles are mounted for dividing the interior office space and providing privacy between the individual spaces therein. The tiles attached to framework 52 may include decorative tiles 54 or functional tiles, such as retractable workspace tiles 56 and/or a variety of different types of storage tiles 58, for example, which are described below. Additionally, framework 52 may include window tiles, as described below. As shown in FIG. 1, partition system 50 is free-standing upon the floor surface of an office space and is not connected to the permanent walls of the building in which the office space is disposed. However, as described below, partition system 50 may optionally be connected to permanent walls of a building in which partition system 50 is disposed.

Figure 3A:
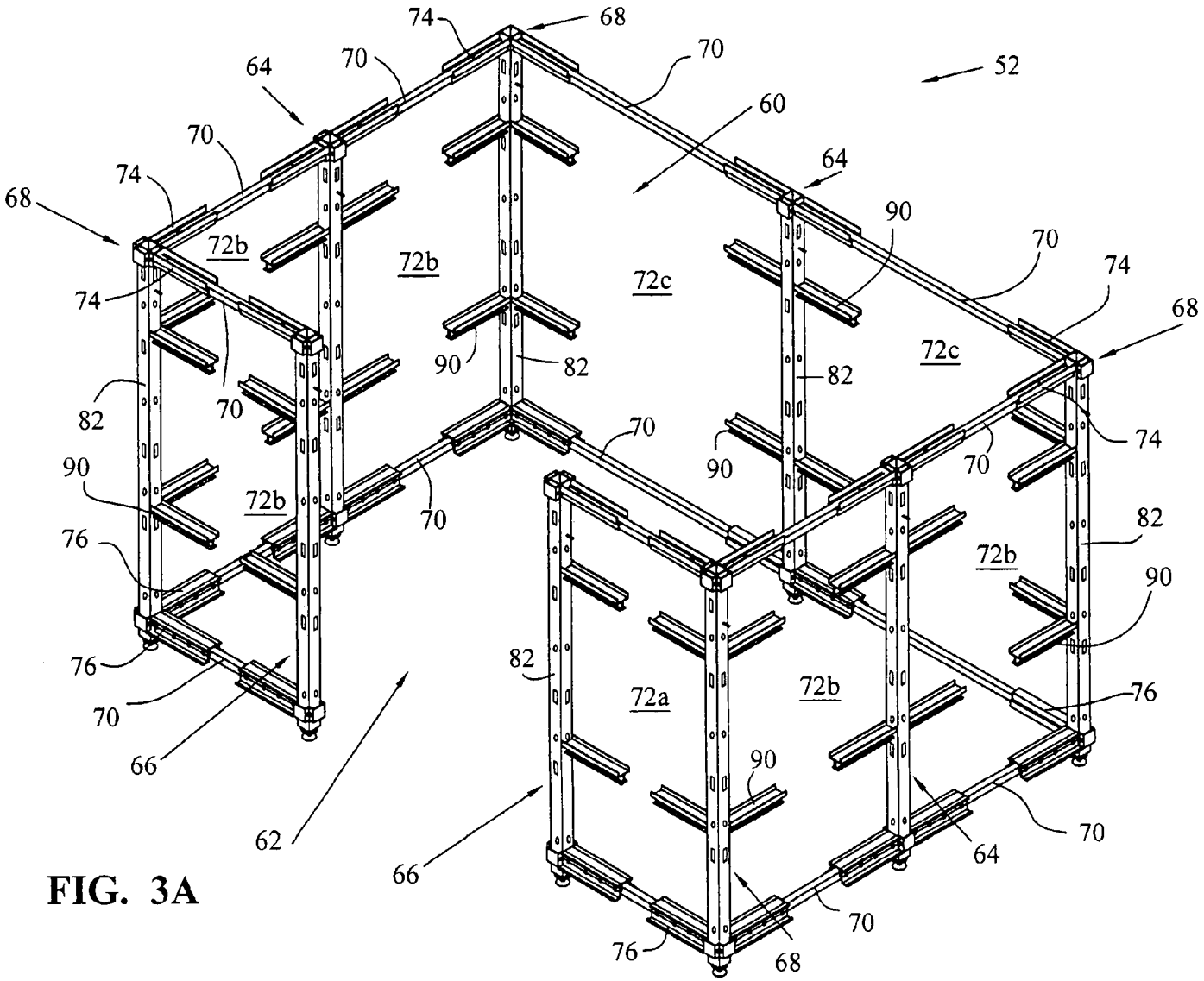
FIG. 3*a* is a perspective view of a first exemplary framework of a partition system according to the present invention.

Referring to FIG. 3*a*, a first exemplary configuration of framework 52 of partition system 50 is shown, which generally defines an enclosed workspace 60 with opening 62 for allowing passage into and out of workspace 60. Framework 52 generally includes I-shaped vertical frame members 64, C-shaped vertical frame members 66, and L-junction vertical frame members 68. Each of the foregoing vertical frame members 64, 66, 68 are connected to one another by upper and lower horizontal spanners 70 to define individual rectangular-shaped framework sections 72. However, as shown in FIG. 3*a*, because each framework section 72 includes at least one vertical frame member 64, 66, 68 which is common to an adjacent framework section 72, framework 52 is a progressive-type framework which does not include individual, rectangular frames which are connected along the edges thereof to adjacent rectangular frames, as in known partition systems. In this manner, the present partition system 50 does not require brackets, latches, or other structure to connect the adjacent vertical edges of individual panel frames, as in known partition systems, thereby increasing the structural integrity of framework 52, reducing the number of overall components of partition system 50, and reducing the difficulty of assembly of partition system 50. Thus, although the term "framework section" is used herein as a reference to the space which is bounded between two adjacent vertical frame members, framework 52 of partition system 50 does not include individual panel "frames" as in known partition systems.

Each of the I-shaped, C-shaped, and L-junction vertical frame members 64, 66, 68, include at least one horizontal upper sub-frame member 74 and at least one horizontal lower sub-frame member 76 rigidly connected thereto, such as by suitable fasteners or by welding, for example. As may be seen in FIG. 4*a*, for example, upper sub-frame members 74 define upwardly-opening channels 78 and lower sub-frame members 76 define downwardly-opening channels 80. Referring back to FIG. 3*a*, spanners 70 are received within the channels 78, 80 of horizontally adjacent upper and lower sub-frame members 74, 76, respectively, to join adjacent vertical frame members 64, 66, 68 together to form framework sections 72. As discussed in more detail below, spanners 70 are adjustably connected to vertical frame members 64, 66, 68 such that the distance between adjacent vertical frame members 64, 66, 68 to in turn vary the width of each framework section defined between adjacent vertical frame members 64, 66, and 68. For example, referring to FIG. 3*a*, framework includes short width framework sections 72*a*, medium width framework sections 72*b*, and extended width framework sections 72*c*, for example.

Figure 4A:
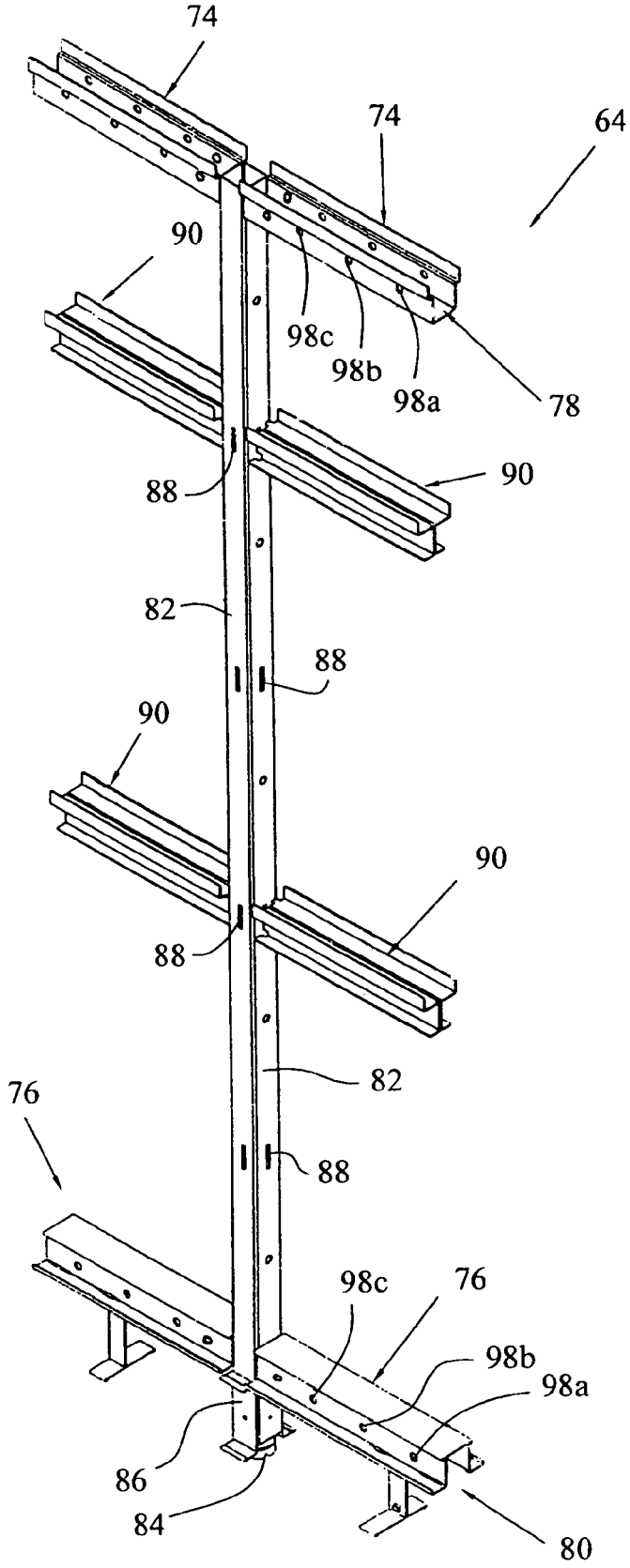
FIG. 4*a* is a perspective view of an I-shaped vertical frame member including a plurality of mid-channel members mounted thereto.

Referring to FIG. 4*a*, I-shaped vertical frame member 64 is shown, which generally includes upright 82 to which are rigidly connected a pair of upper sub-frame members 74 and a pair of lower sub-frame members 76. Upper sub-frame members 74 and lower sub-frame members 76 are respectively disposed 180° from one another on I-shaped vertical frame member 64. The lower portion of upright 82 includes a known level glide assembly with foot 84 mounted upon a threaded member and resting against a floor surface, wherein the distance between foot 84 and the bottom edge of upright 82 is vertically adjustable by rotating foot 84, such that framework 52 may be leveled along an uneven floor surface. The lower portion of upright 82 additionally includes a pair of C-shaped floor trim mounts 86 rigidly secured thereto. Upright 82 includes a plurality of vertical slots 88, located at vertical intervals along upright 82, to which mid-channel members 90 may be attached, as described below.

Figure 6A:
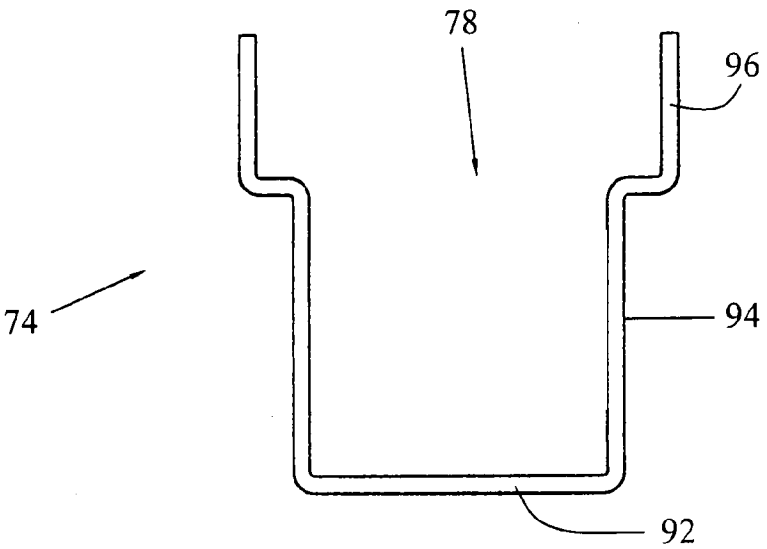
FIG. 6*a* is an end view of an upper sub-frame member.
Figure 6B:
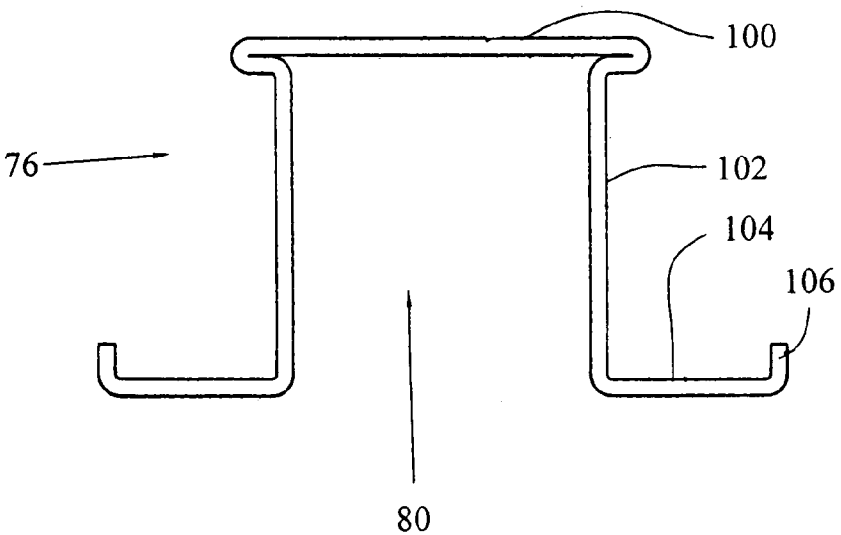
FIG. 6*b* is an end view of a lower sub-frame member.

Referring to FIGS. 4*a* and 6*a*, upper sub-frame members 74 have a substantially upwardly directed C-shaped cross section, including base wall 92 and a pair of side walls 94 extending upwardly from base wall 92 which, together with base wall 92, define channel 78. A pair of track member mounting walls 96 are spaced laterally from, and extend upwardly from, side walls 94. As shown in FIG. 4*a*, side walls 94 include three or more sets of horizontally aligned apertures 98*a*, 98*b*, 98*c* therein for attachment of spanners 70, as described below. Referring to FIGS. 4*a* and 6*b*, lower sub-frame members 76 also have a generally downwardly directed C-shaped cross section, including base wall 100 and a pair of side walls 102 extending downwardly from base wall 100 which, together with base wall 100, define channel 80. Horizontal walls 104 extending horizontally from the lower ends of side walls 102, and terminate in upwardly-projecting ridges 106. As shown in FIG. 4*a*, side walls 102 of lower sub-frame members 76 additionally include three or more sets of horizontally aligned apertures 98*a*, 98*b*, 98*c* for attachment of spanners 70, as described below.

Figure 4B:
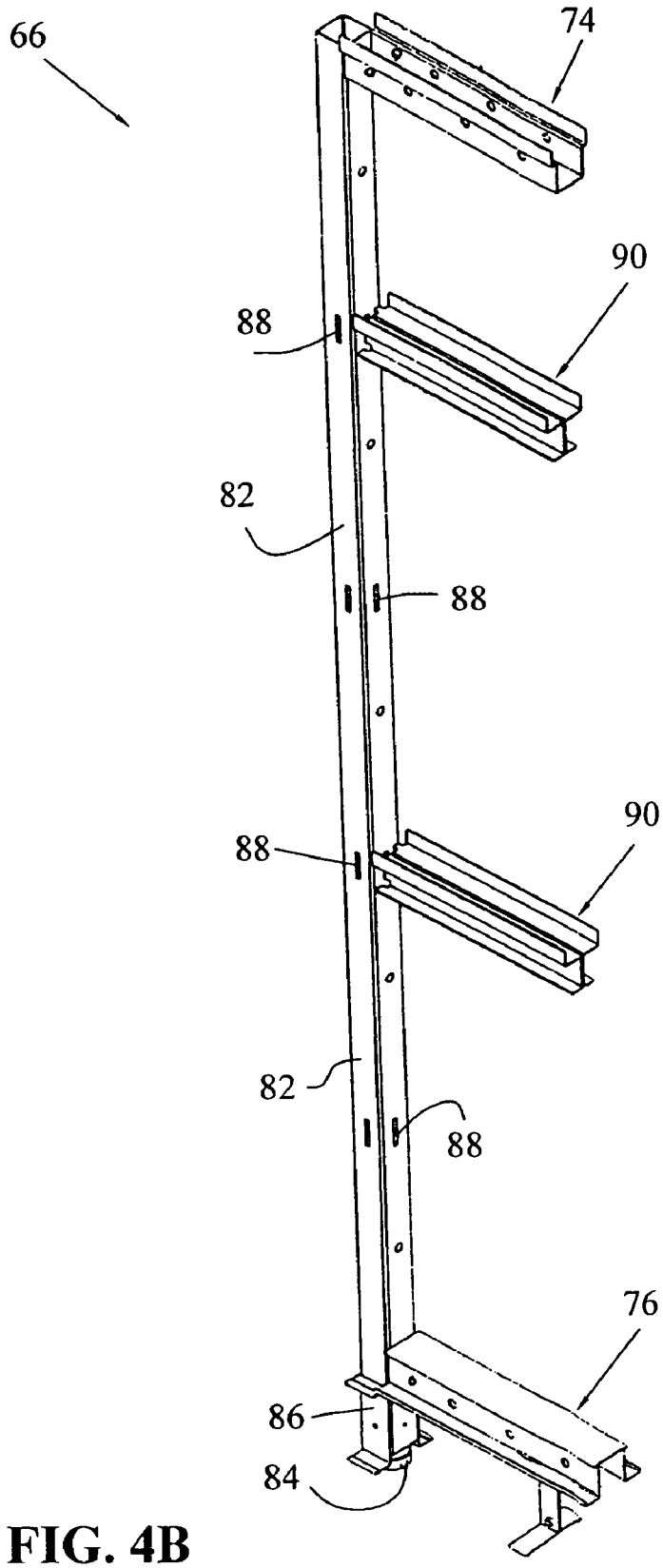
FIG. 4*b* is a perspective view of a C-shaped vertical frame member including a pair of mid-channel members mounted thereto.
Figure 4C:
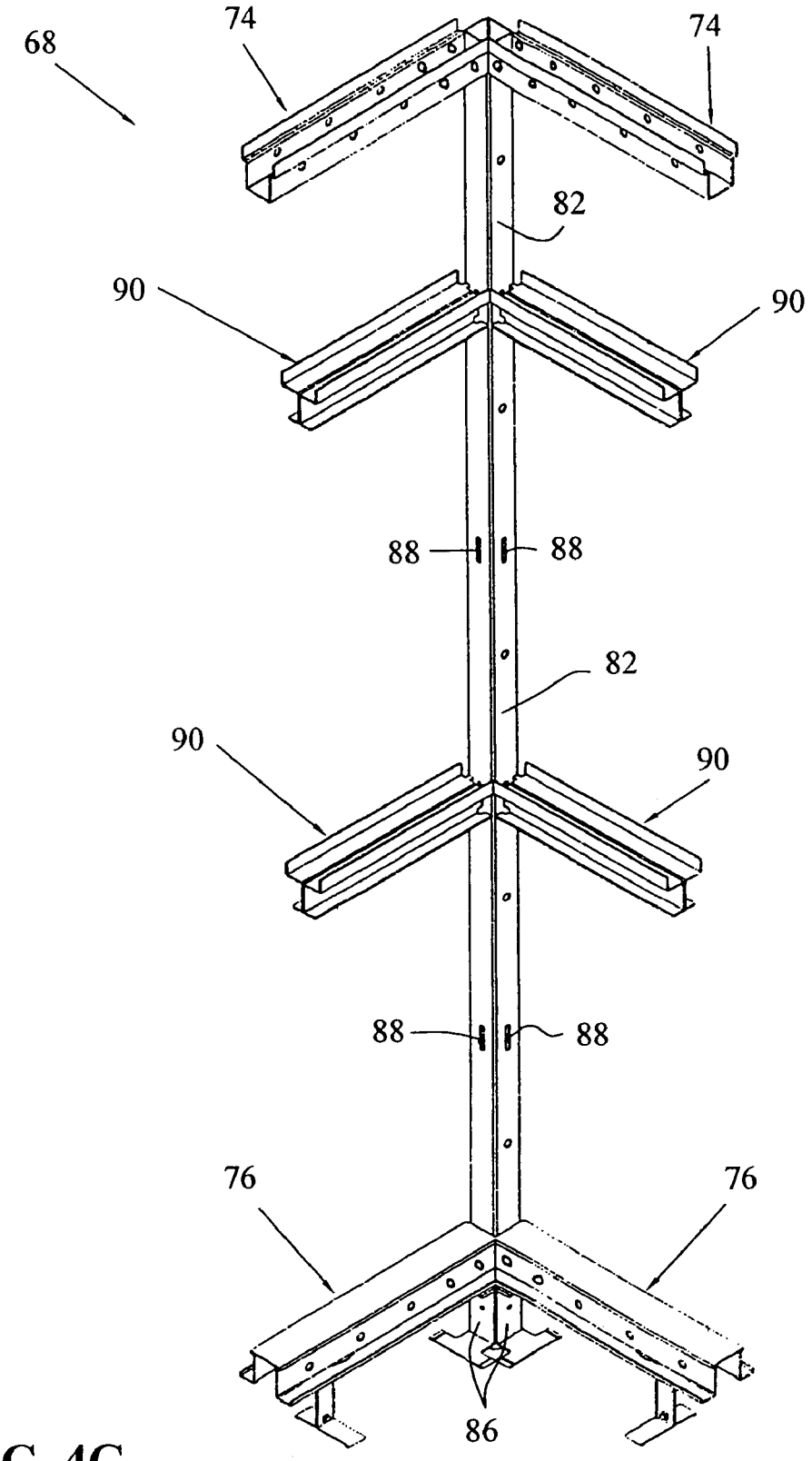
FIG. 4*c* is a perspective view of an L-junction vertical frame member including a plurality of mid-channel members mounted thereto.

Referring to FIG. 4*b*, C-shaped vertical frame member 66 is shown, including a single upper sub-frame member 74 and a single lower sub-frame member 76. C-shaped vertical frame members 66 are generally used at the ends of a run of framework 52, as shown in FIG. 3*a*, or may also be used in an off-module connection between intersecting runs of framework 52, as described below. Further, as also described below, C-shaped vertical frame members 52 may also be used in a wall start configuration in which framework 52 extends from a permanent wall. Referring to FIG. 4*c*, L-junction vertical frame member 68 is shown, including two upper sub-frame members 74 attached thereto and disposed 90° from one another, and two lower sub-frame members attached thereto and also disposed 90° from one another. In this manner, L-junction vertical frame member 68 forms an L-junction within framework 52.

Figure 3B:
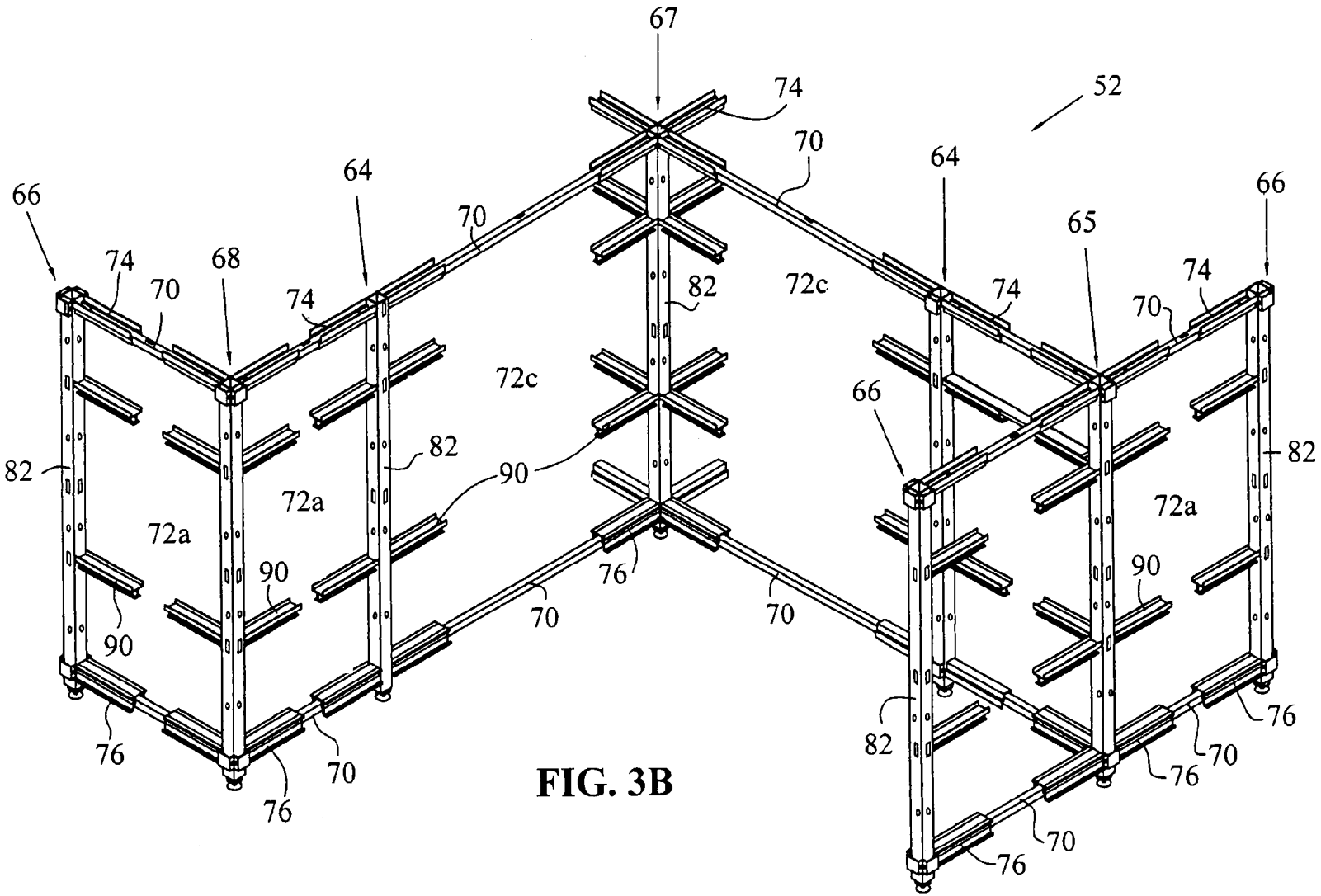
FIG. 3*b* is a perspective view of a second exemplary framework of a partition system according to the present invention.

Additionally, referring to a second exemplary framework 52 shown in FIG. 3*b*, framework 52 may also include T-junction vertical frame members 65 and X-junction vertical frame members 67 for forming T-junctions or X-junctions within framework 52. T-junction and X-junction vertical frame members 65, 67 are analogous to L-junction vertical frame members 68. For example, T-junction vertical frame member 65 includes three vertical sub-frame members 74 affixed thereto, with corresponding lower sub-frame members 76. Similarly, X-junction vertical frame member 67 includes four upper sub-frame members 74 attached thereto, with corresponding lower sub-frame members 76.

Figure 4D:
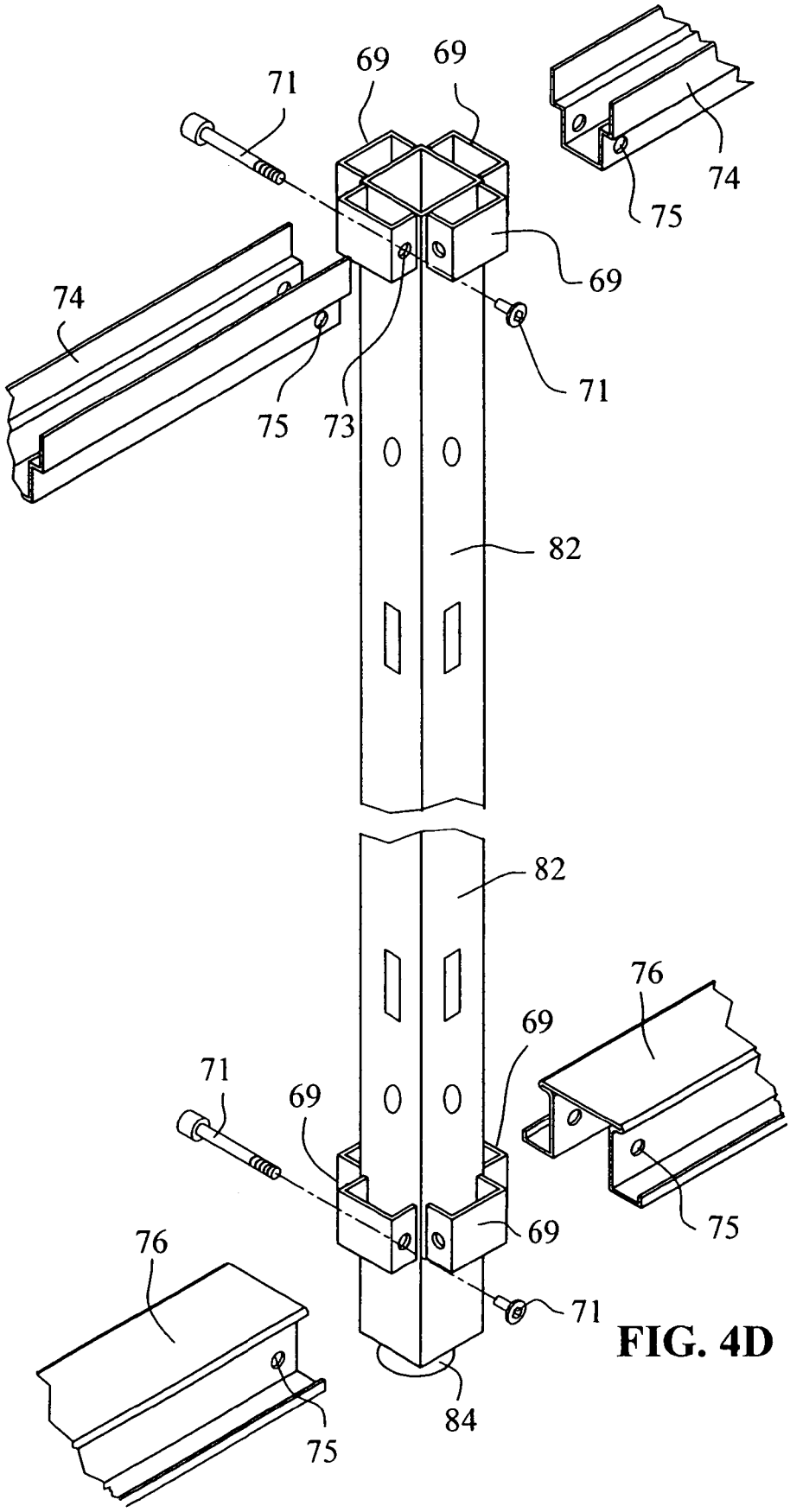
FIG. 4*d* is a perspective view showing a manner in which upper and lower sub-frame members may be selectively attached to an upright to form various types of vertical frame members.

In many of the Figures herein, upper and lower sub-frame members 74, 76 are shown rigidly and permanently attached to uprights 82 of vertical frame members 64–68 such as by welding, for example. However, upper and lower sub-frame members 74, 76 may also be detachably connected to uprights 82 of vertical frame members 64–68 by suitable fasteners. Referring to FIG. 4*d*, upright 82 may include brackets 69 mounted to each side face thereof at 90° intervals around the both of the upper and lower ends of upright 82. Suitable two-part fasteners 71, for example, extend through aligned apertures 73 in brackets 69 and apertures 75 in upper and lower sub-frame members 74, 76 to rigidly connect upper and lower sub-frame members 74, 76 to upright 82. In this manner, each upright 82 may be selectively configured as any one of the various types of I-shaped, T-junction, C-shaped, X-junction, or L-junction vertical frame members 64–68 described above by attaching suitable upper and lower sub-frame members 74, 76 thereto. For example, in FIG. 4*d*, upright 82 is configured as an I-shaped vertical frame member 64.

Figure 7:
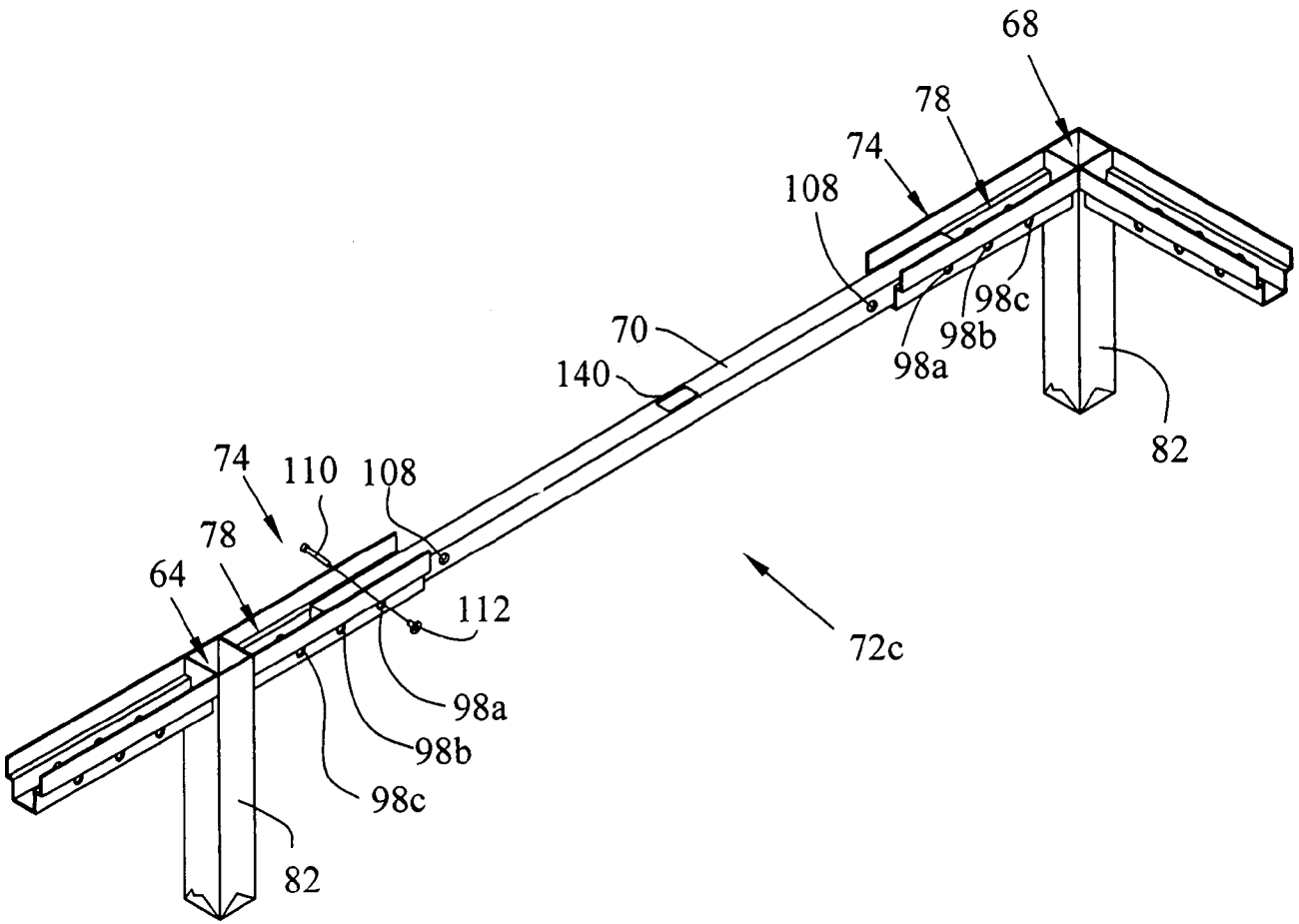
FIG. 7 is a partial perspective view showing a spanner connecting the upper sub-frame members of two adjacent vertical frame members within the partition system framework.
Figure 8:
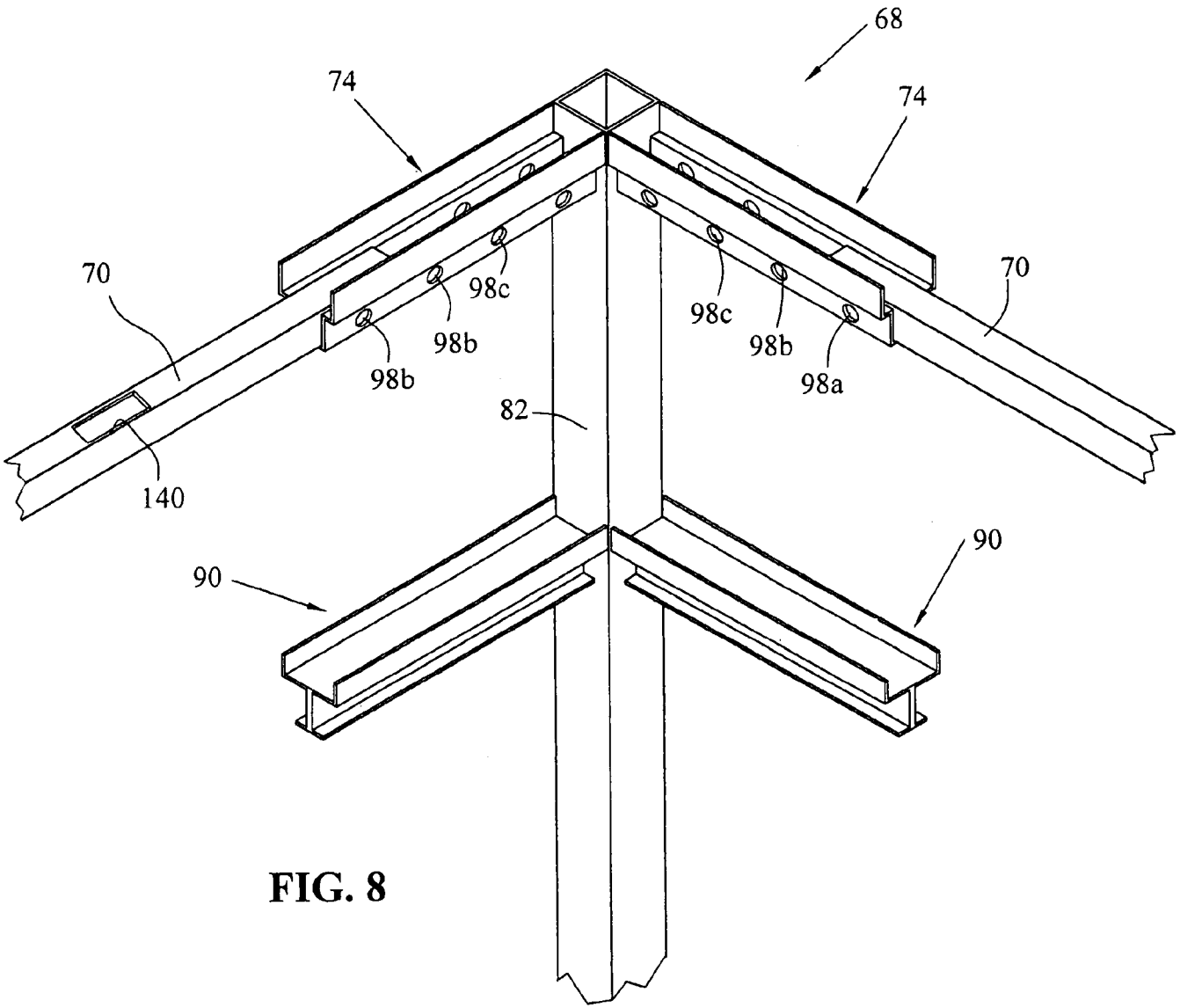
FIG. 8 is a partial perspective view of the upper portion of an L-junction vertical frame member, showing a pair of spanners connected to the upper sub-frame members thereof.

Referring to FIG. 7, spanner 70 is shown disposed within channels 78 of horizontally aligned upper sub-frame members 74 of a pair of adjacent vertical frame members 64 and 68. Spanners 70 generally have a square cross-section, and include a plurality of horizontally spaced through holes 108 at opposite ends thereof which are alignable with any pair of the horizontally aligned sets of apertures 98*a*, 98*b*, 98*c* in upper sub-frame members 74. Fasteners, which may include bolt 110 and lug 112, are inserted through a first aperture 98*a*, 98*b*, or 98*c* in upper sub-frame member 74, through the through holes 108 in spanner 70 and through the corresponding horizontally aligned aperture 98*a*, 98*b*, or 98*c* in the upper sub-frame member 74 to connect spanner 70 to supper sub-frame member 74. In FIG. 8, the upper portion of an L-junction vertical frame member 68 is shown, having a spanner 70 received within each of the upper sub-frame members 76 thereof.

As shown in FIG. 7, the ends of spanners 70 are connected to first set of apertures 98*a* to define an extended framework section 72*c* between vertical frame members 64 and 68. However, as may be seen from FIG. 7 and from FIGS. 3*a* and 3*b*, spanners 70 may also be connected to second or third sets of apertures 98*b* or 98*c* to define narrow or medium width framework sections 72*a*, 72*b* between vertical frame members 64, 66, and 68. In this manner, spanners 70 are adjustably connected to vertical frame members 64, 66, and 68 such that the width between vertical frame members 64, 66, and 68 is variable. Further, the length of spanners 70 themselves may also be varied. Therefore, the length of spanners 70, together with the adjustability provided by through holes 108 in spanners and apertures 98*a*, 98*b*, and 98*c* of upper and lower sub-frame members 74 and 76, allow selection of any distance between adjacent vertical frame members 64, 66, or 68 to create framework sections 72 of any width. For example, a spanner of a first length may be selectively attached to apertures 98*a*, 98*b*, or 98*c* resulting in framework sections 24 inches, 30 inches, or 36 inches wide, respectively, or a spanner of a second length may be selectively attached to apertures 98*a*, 98*b*, or 98*c* resulting in framework sections 36 inches, 42 inches, or 48 inches wide, respectively. Spanners 70 are connected to apertures 98*a*, 98*b*, and 98*c* of lower sub-frame members 76 of adjacent vertical frame members 64, 66, and 68 in the same manner as that described above.

Figure 9:
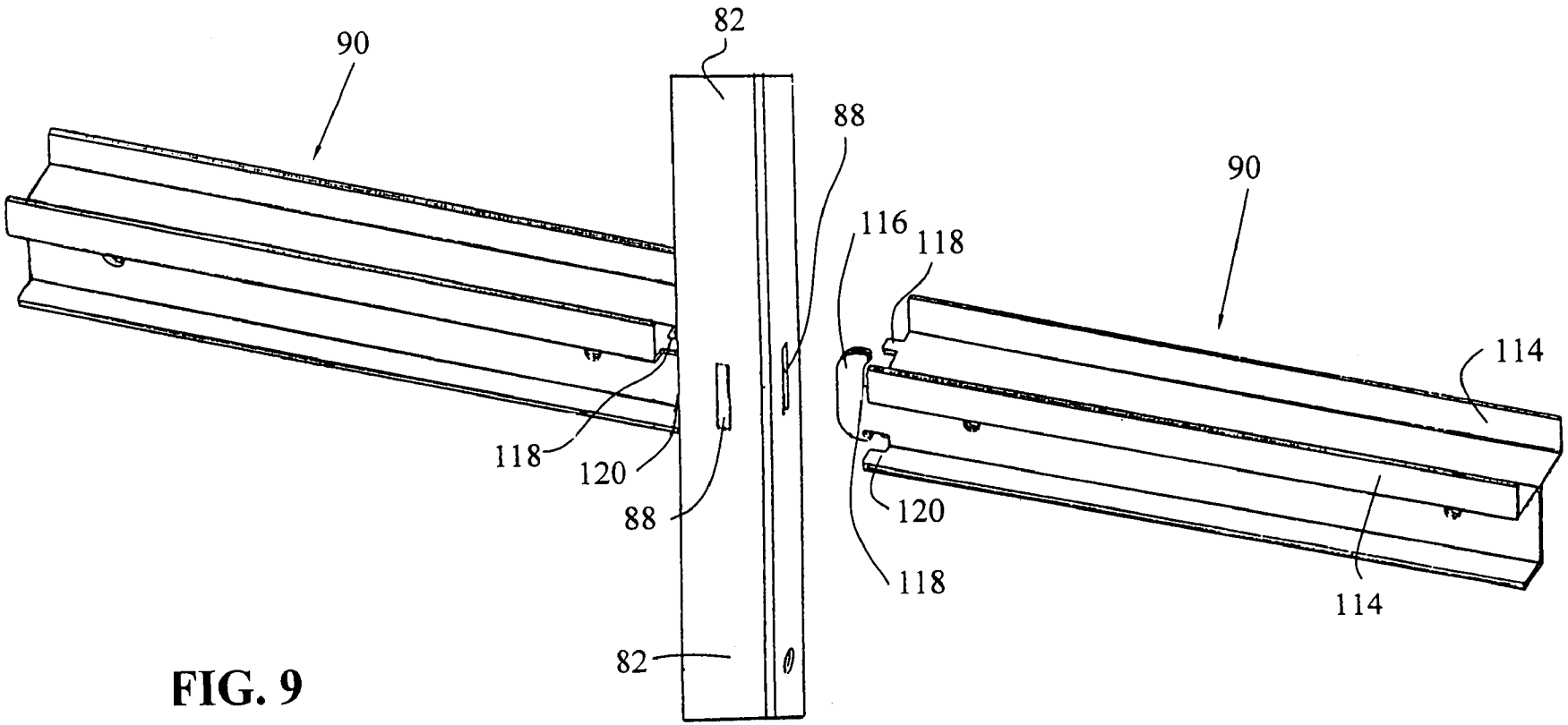
FIG. 9 is a partial perspective view of a portion of a vertical frame member, showing the attachment of a pair of mid-channel members thereto.

Referring to FIG. 9, mid-channel members 90 generally have an I-shaped cross section, and are formed by a pair of bent metal pieces attached to one another in a back-to-back manner. Mid-channel members 90 include track member mounting walls 114, and a mounting structure at one end thereof which includes hooks 116, upper spacers 118, and lower spacers 120. Mid-channel members 90 are attached to uprights 82 of vertical frame members 64, 66, or 68 by first tilting mid-channel members 90 upwardly to insert hooks 116 of mid-channel members 90 into slots 86 of uprights 82, followed by rotating mid-channel members 90 downwardly to a horizontal position such that upper spacers 118 and lower spacers 120 abut the faces of uprights 82 adjacent slots 86. Mid-channel members 90 may be removed by the opposite of the foregoing procedure. In this manner, mid-channel members 90 may be firmly and rigidly, yet detachably, mounted to uprights 82 of vertical frame members 64, 66, and 68 at vertical intervals thereon defined by the locations of slots 86.

Figure 5A:
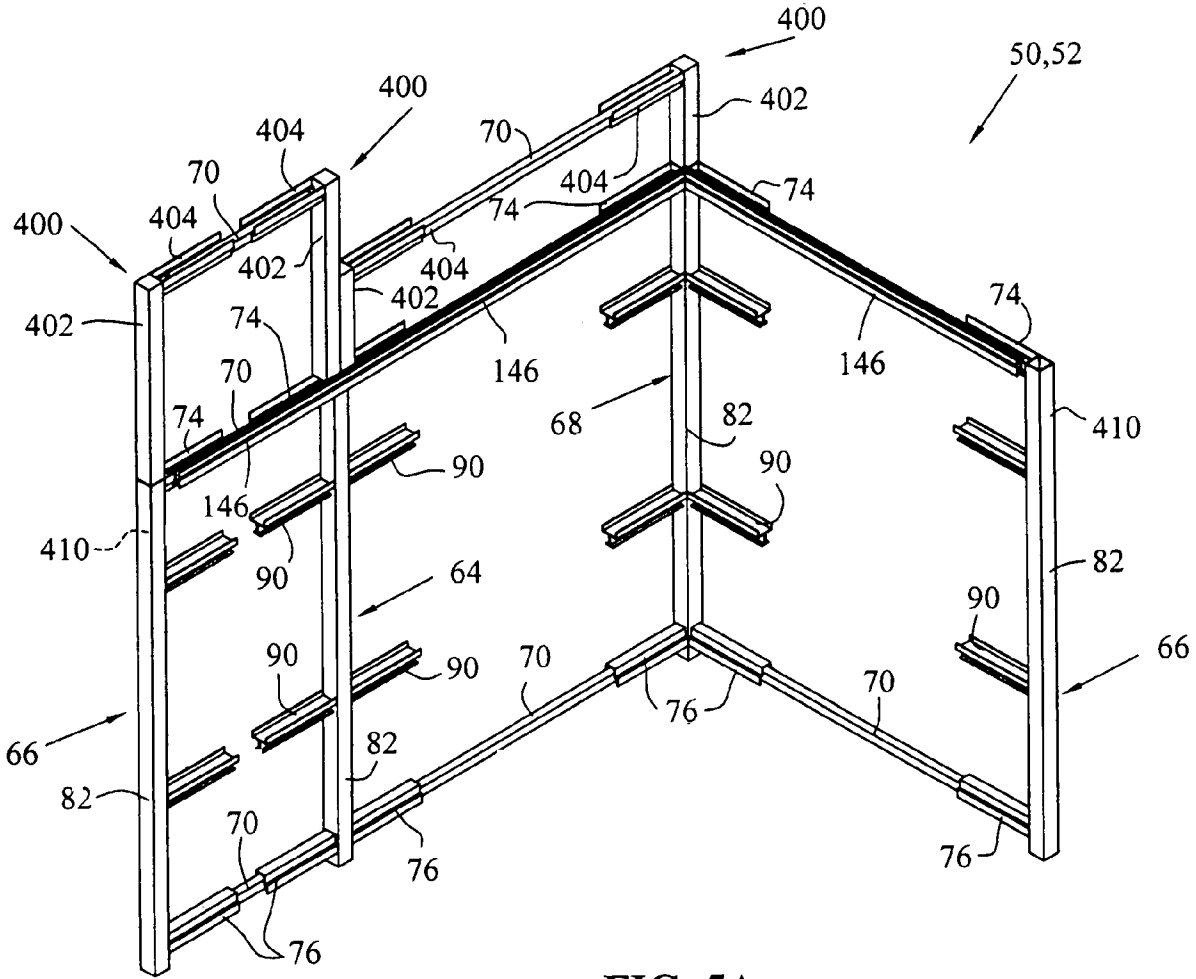
FIG. 5*a* is a perspective view of a stacking arrangement for the partition system framework.
Figure 5B:
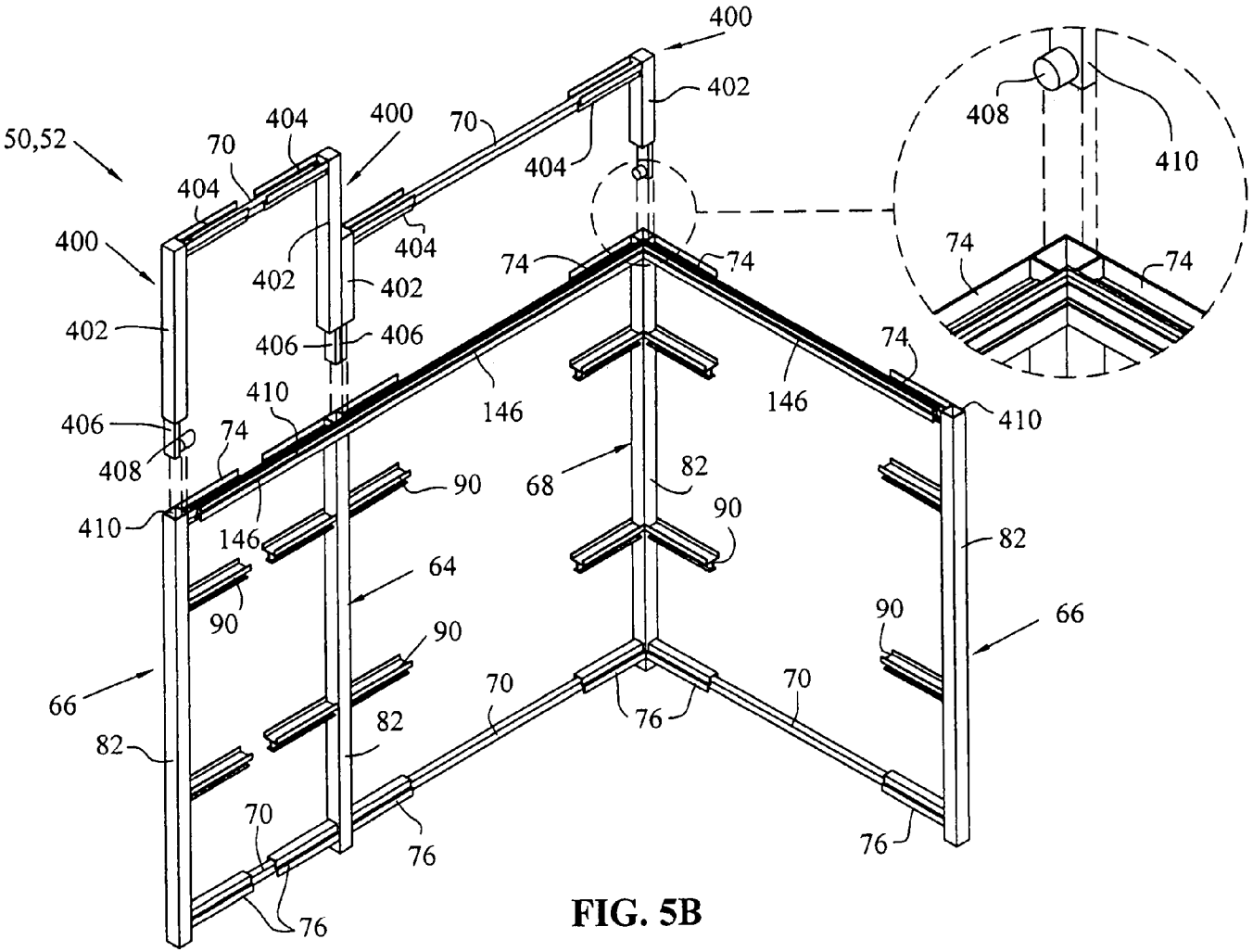
FIG. 5*b* is an exploded view of the stacking arrangement of FIG. 5*b;*
Figure 5C:
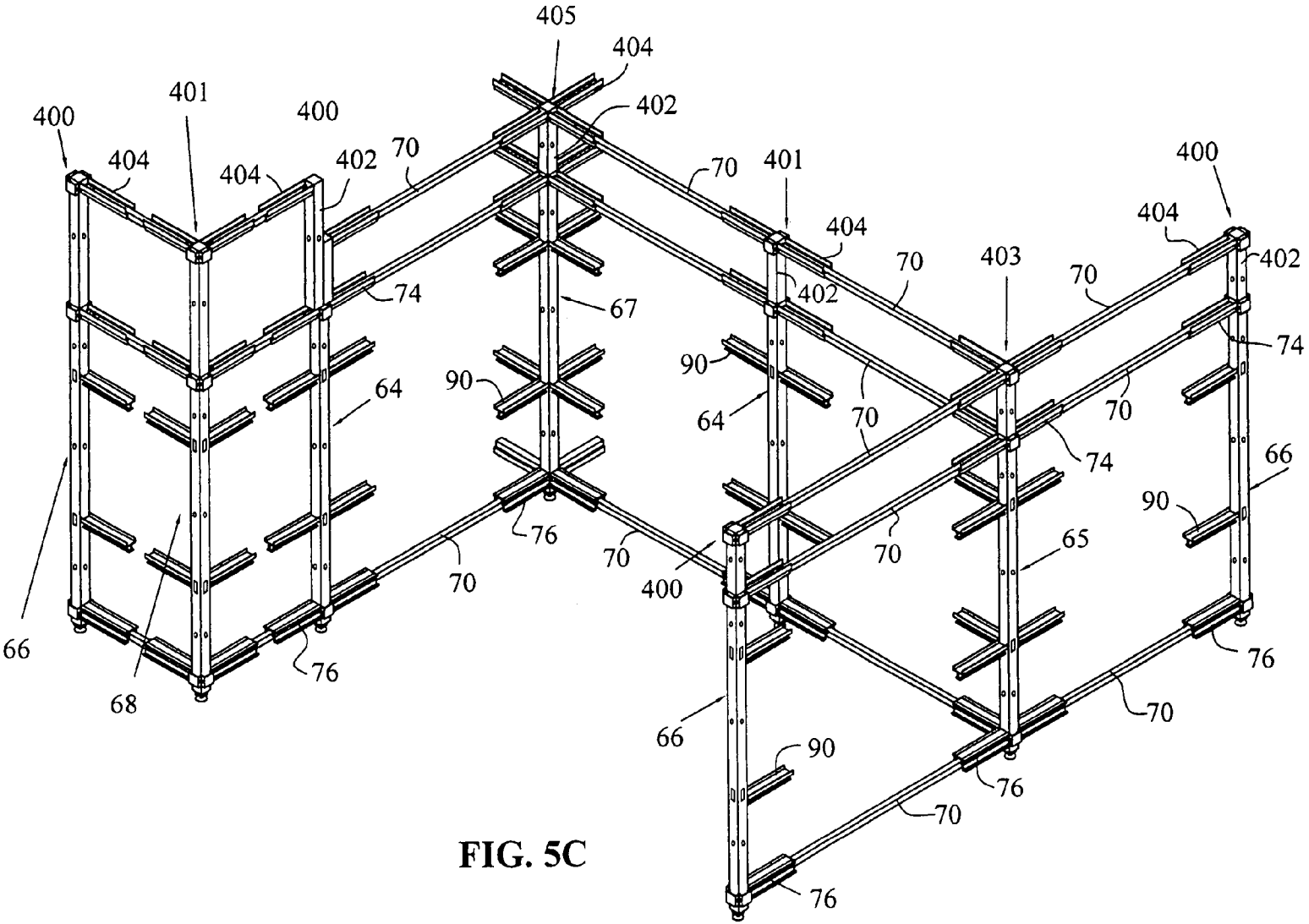
FIG. 5*c* is another perspective view of a stacking arrangement for the partition system framework, further showing L-junction, T-junction, and X-junction stacking frame members.

Referring to FIGS. 5*a*–5*c*, framework 52 may include a stacking system in order to vary the height of framework 52 at selected locations therein. As shown in FIGS. 5*a* and 5*b*, stacking frame members 400 each include vertical component 402 and at least one horizontal component 404 attached to vertical component 402 and extending therefrom. In this manner, stacking frame members 400 may each have an L-shaped profile as shown in FIGS. 5*a* and 5*b*, when stacking frame members 400 are used along a run of framework 52. Further, as shown in FIG. 5*c* each vertical component 402 may also include two, three or four horizontal components 404 mounted thereto to form I-shaped stacking members or L-junction stacking frame members 401, T-junction stacking frame members 403, and X-junction stacking frame members 405. In this manner, stacking frame members 400 may be used at L-type, T-type, or X-type panel junctions within framework 52, as described above. The length of vertical components 402 may be varied in order to vary the height of stacking frame members 400.

Horizontal components 404 are analogous or identical to upper sub-frame members 74 in construction, and are fixedly attached to vertical components by welding, for example. Also, horizontal components 404 may be attached to vertical components 402 in the manner described above with respect to FIG. 4*d*, in which vertical components 402 include brackets 69 for selective mounting of one or more horizontal components 404 to vertical components 402. Thus, vertical components 402 are analogous to vertical uprights 82 of vertical frame members 64, 66, and 68 in construction; however, as shown in FIG. 5*b*, vertical components 402 each additionally include an extension 406 extending from the lower portion thereof, wherein extensions 406 may additionally include supports 408. Extensions 406 of vertical components 402 are slidably received within cavities 410 defined in the upper ends of vertical frame members 64, 66, and 68 to vertically attach stacking frame members 400 to vertical frame members 64, 66, and 68.

Referring to FIG. 5*b*, when only one vertical component 402 of a stacking frame member 400 is attached to a given vertical frame member 64, 66 or 68, such as at the end of a run of framework 52, supports 408 function to take up the space within cavities 410 of vertical frame members 64, 66, and 68 which is not occupied by extensions 410, to thereby provide a stable vertical connection between stacking frame members 400 and vertical frame members 64, 66, and 68. As also shown in FIG. 5*b*, when two vertical components 402 of stacking frame members 400 are attached in a back-to-back manner to a single vertical frame member 64, 66, or 68, such as in the middle of a run of framework 52, extensions 406 thereof together occupy the space within cavity 410 thereof to provide a stable vertical connection, and supports 408 are not used. As shown in FIGS. 5*a*–5*c*, two vertical components 402 of stacking frame members 400 of different height may also attached in a back-to-back manner to a single vertical frame member 64, 66, or 68 in order to vary the height of stacking frame members 400 within a panel run, forming a "high-low" condition. Further, spanners 70 may be attached between adjacent horizontal components 404 in the same manner as described above with respect to the attachment of spanners 70 to upper sub-frame members 74 of vertical frame members 64, 66, and 68.

As shown in FIGS. 5*a* and 5*b*, track members 146 may be attached to horizontal components 404 of stacking frame members 400 in the same manner as described below with respect to the attachment of track members 146 to upper sub-frame members 74 of vertical frame members 64, 66, and 68. In this manner, stacking frame members 400, 401, 403, and 405 may support the various components of partition system 50, such as decorative tiles 54 and storage tiles 58, for example, as discussed below. Further, stacking frame members 400, 401, 403, and 405 may also support window tiles 380 in the same manner as described below to provide clerestory windows within the upper spaces of partition system 50.

Figure 5D:
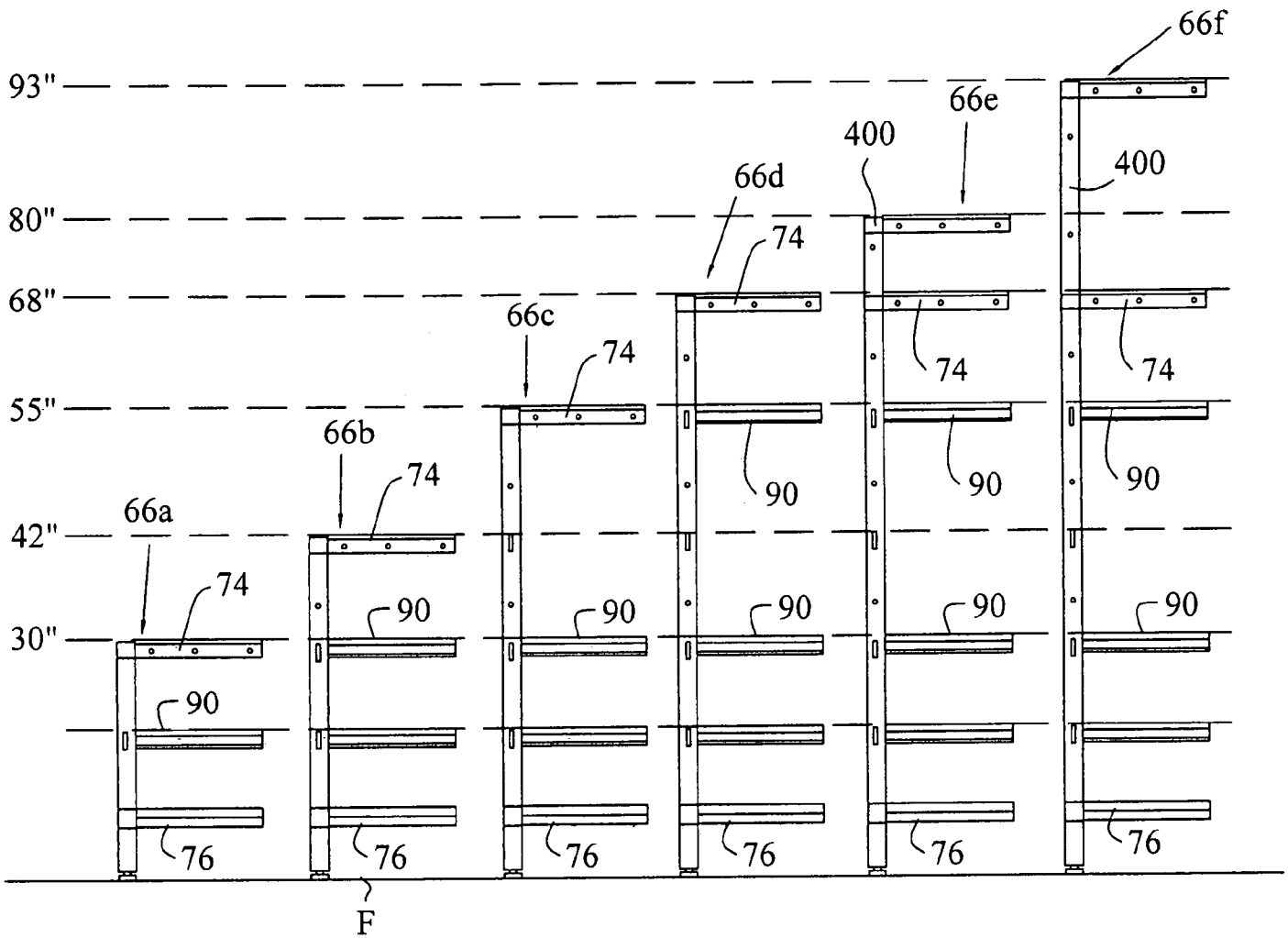
FIG. 5*d* is an elevational view showing a number of vertical frame members of varying height, and also showing vertical frame members to which stacking vertical frame members are attached to increase the height of same.

FIG. 5*d* illustrates how the height of framework 52 may be varied by using vertical frame members 64–68 of varying height, together with the use of stacking frame members 400 of varying height. For example, C-shaped vertical frame member 66*a* of FIG. 5*d* is 30" high, and includes an upper sub-frame member 74 disposed 30" from floor surface F, which corresponds to work surface height. C-shaped vertical frame member 66*b* of FIG. 5*d* is 42" high, and includes a mid-channel member 90 disposed 30" from floor surface F and an upper sub-frame member 74 disposed 42" from floor surface F. C-shaped vertical frame member 66*c* of FIG. 5*d* is 55" high, and includes a mid-channel member 90 disposed 30" from floor surface F and an upper sub-frame member 74 disposed 55" from floor surface F. C-shaped vertical frame member 66*d* of FIG. 5*d* is 68" high, and includes a first mid-channel member 90 disposed 30" from floor surface F, a second mid-channel member 90 disposed 55" from floor surface F, and an upper sub-frame member 74 disposed 68" from floor surface F. C-shaped vertical frame member 66*e* of FIG. 5*d* is identical to C-shaped vertical frame member 66*d*, and further includes a 12" stacking frame member 400 attached thereto to provide a total height of 80" from floor surface F. C-shaped vertical frame member 66*f* of FIG. 5*d* is identical to C-shaped vertical frame members 66*d* and 66*e*, and further includes a 25" stacking frame member 400 attached thereto to provide a total height of 93" from floor surface F. However, the foregoing dimensions are only exemplary—the height of vertical frame members 64–68 and stacking frame members 400 may be varied as necessary to fit the needs of any interior space.

Figure 10:
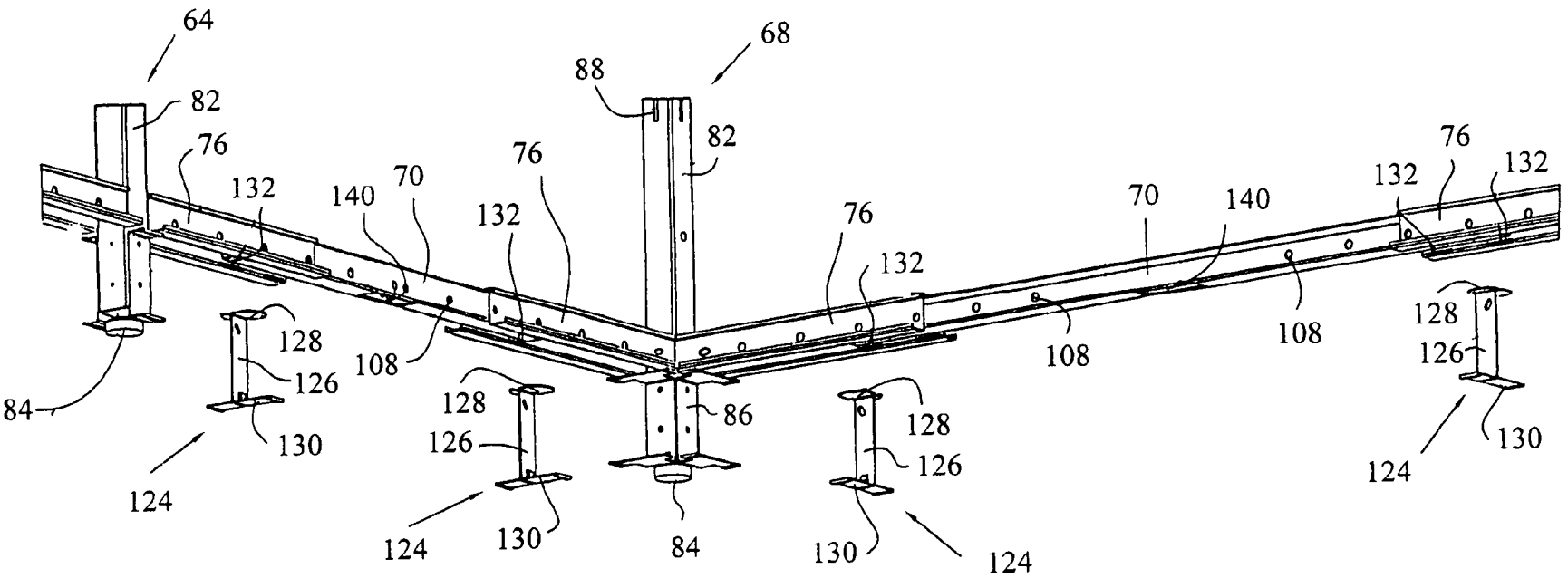
FIG. 10 is an exploded view showing a lower portion of an L-junction within the partition system framework, and a plurality of harness brackets.
Figure 11:
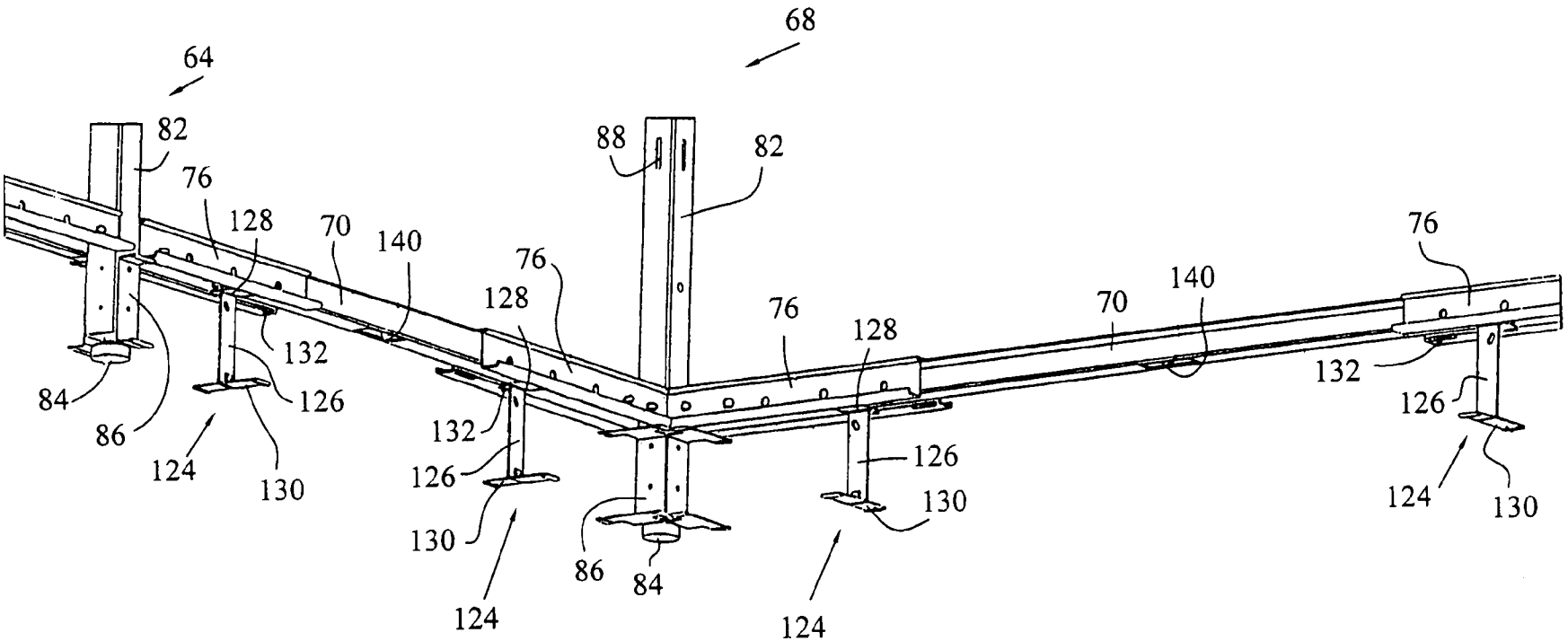
FIG. 11 is a perspective view of the assembly of FIG. 10.
Figure 12:
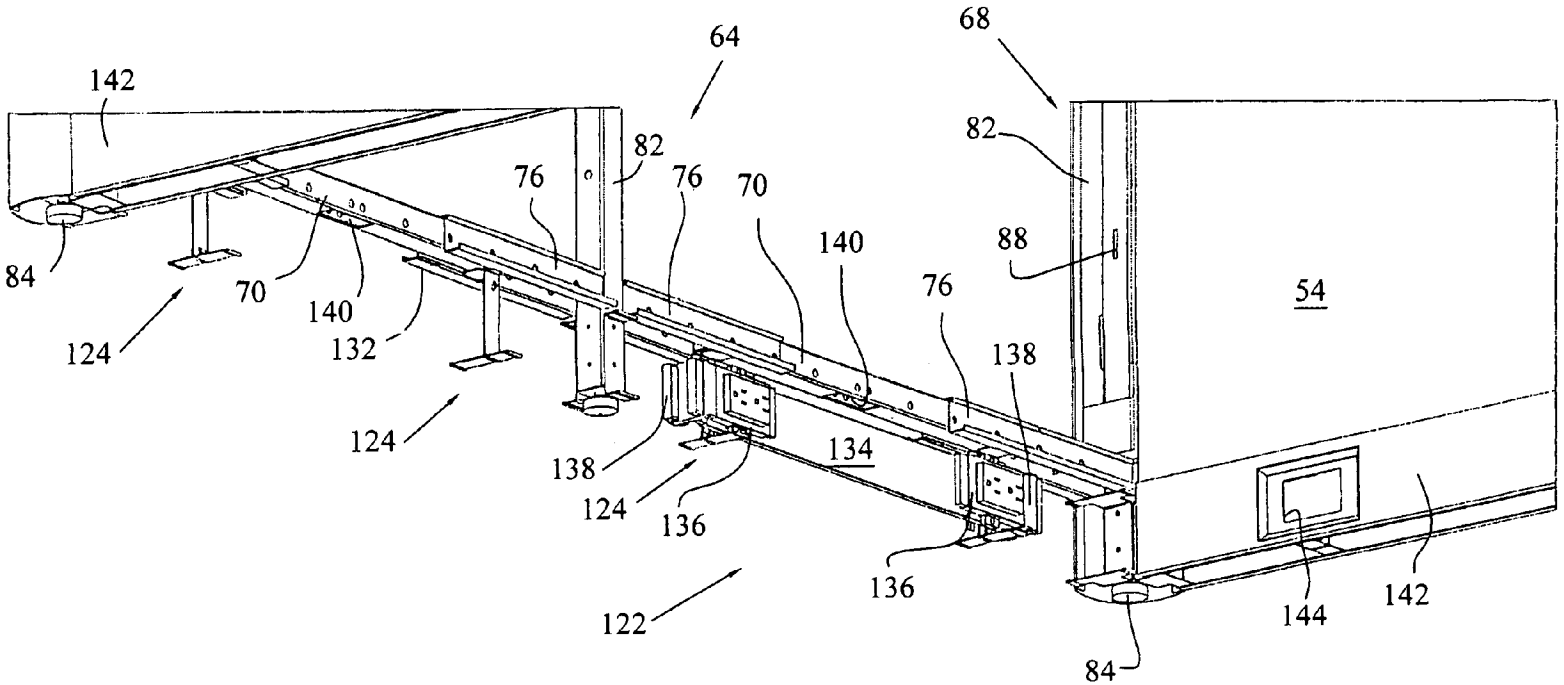
FIG. 12 is a partial perspective view of the lower portion of a partition system framework, showing an electrical harness assembly connected to the framework.

Referring to FIGS. 10–12, the attachment of harness assemblies 122 to framework 52, for providing electrical and/or data service throughout framework 52 of partition system 50, will be described. Referring to FIG. 10, harness brackets 124 generally include vertical portions 126, a pair of oppositely-directed mounting tangs 128, and a pair of lower, oppositely-directed floor trim mounts 130. To attach harness brackets 124 to lower sub-frame members 76, harness brackets 124 are first oriented such that mounting tangs 128 and floor trim mounts 130 are directed parallel to lower sub-frame members 76 and spanners 70. Thereafter, harness brackets 124 are moved upwardly to align mounting tangs 128 with mounting slots 132 in lower sub-frame members 76. Then, harness brackets 124 are rotated 90° to engage mounting tangs 128 within mounting slots 132 of lower sub-frame members 76, as shown in FIG. 11.

Figure 14:
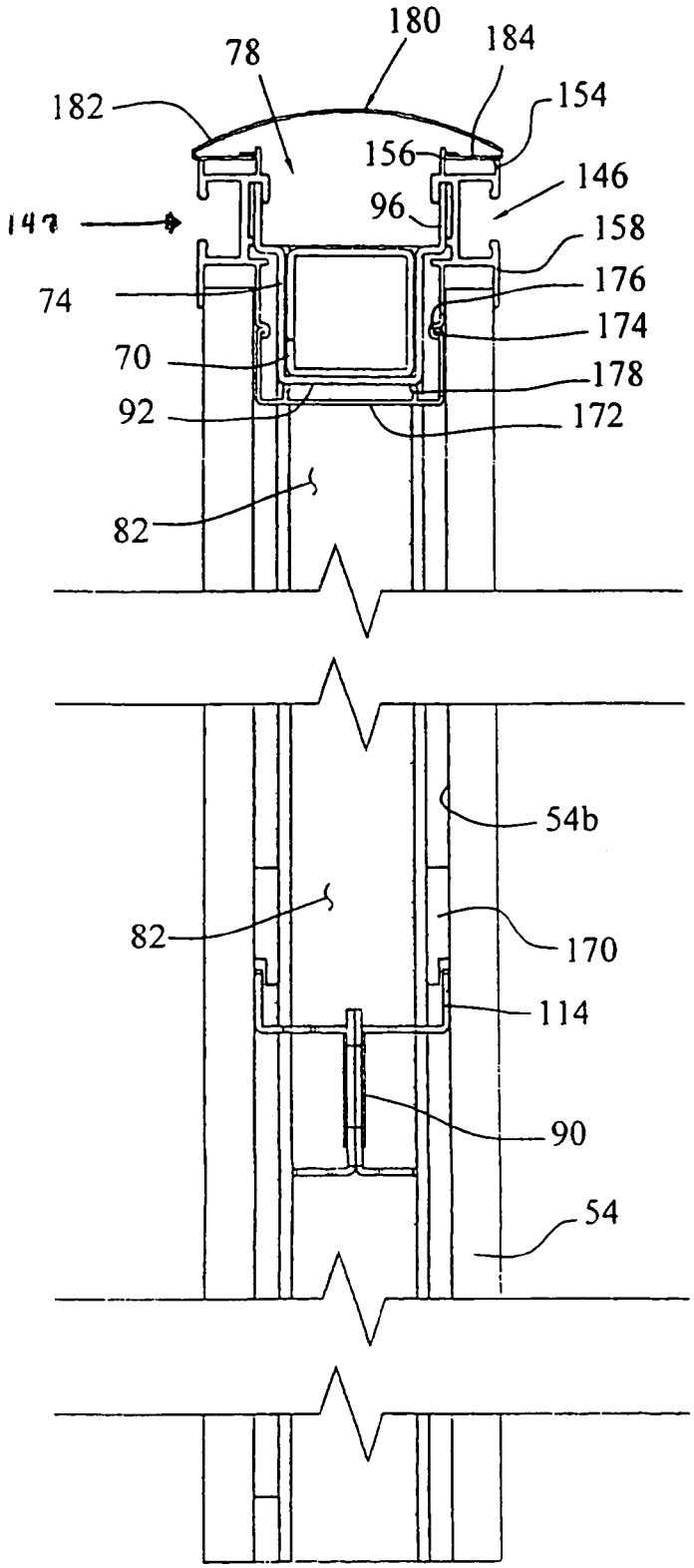
FIG. 14 is a sectional view through an upper portion of a partition system framework, showing a pair of track members attached to an upper sub-frame member of a vertical frame member, the track members and a mid-channel member supporting a pair of tiles on opposite faces of the framework, and a top cap mounted to the track members.

Referring to FIG. 12, harness assemblies 122 may be mounted to either side of vertical portions 126 of harness brackets 124 by suitable fasteners. Suitable harness assemblies 122 are available from suppliers such as Pent Manufacturing/Dekko Engineering of Kendallville, Ind., although other suitable harness assemblies are also readily available. Harness assemblies 122 generally include central portions 134 which contain electrical and/or data wiring, outlet modules 136 attached to central portions 134, and connection ports 138 for attaching jumpers (not shown) to harness assemblies 122. The jumpers are used to connect adjacent harness assemblies 122 between adjacent framework sections 72 within framework 52, wherein jumpers may be appropriately sized to span the distance between adjacent framework sections 72. Referring to FIGS. 7 and 10–12, spanners 70 include central, rectangular-shaped openings 140 to allow electrical wiring, data cables, or other utilities to pass therethrough for routing same vertically within framework 52 of partition system 50. In this manner, electrical and/or data services may be provided to electrical and data tiles 340, described below, at selected mid-height locations within framework 52. Referring to FIG. 14, electrical wiring and data cables may also be routed horizontally within channels 78 of upper sub-frame members 74 along the top edges of framework 52. Referring back to FIG. 12, floor trim elements 142 are attachable to framework 52 as described below, and include openings 144 for access to outlet modules 136 of harness assemblies 122.

Figure 13A:
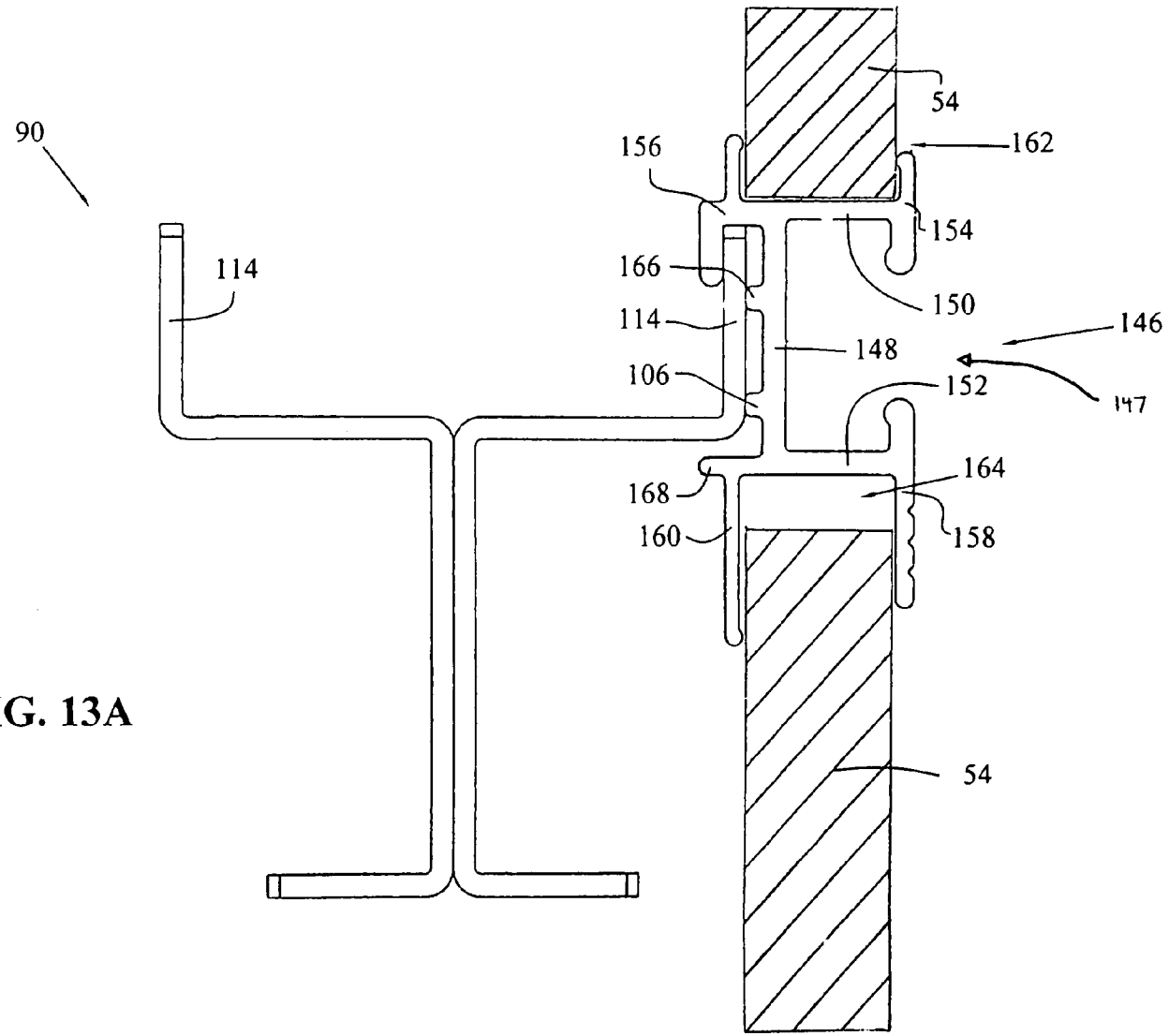
FIG. 13*a* is a sectional view through a portion of a partition system framework at a mid-height location, showing a mid-channel member, a track member, and portions of upper and lower decorative tiles attached to the track member.

Referring to FIG. 13*a*, a track member 146 is shown mounted to a mid-channel member 90. Track member 146 is similar to those which are described in detail in U.S. Pat. No. 5,309,686, assigned to the assignee of the present application, the disclosure of which is expressly incorporated herein by reference. Track members 146 generally include an extruded metal section having a horizontally-opening channel 147 defined by rear wall 148 and upper and lower walls 150, 152. Upper wall 150 terminates in upper front wall 154 and upper rear wall 156, and lower wall 152 terminates in lower front wall 158 and lower rear wall 160. Upper front wall 154, bottom wall 150, and upper rear wall 156 define tile space 162 therebetween for receipt of the lower edge of a tile, such as decorative tile 54 or a functional tile, and lower front wall 158, bottom wall 152, and lower rear wall 160 define tile space 164 therebetween for receipt of the upper edge of a tile. Track member 146 is mounted to mid-channel member 90 in a fastenerless manner with out the need for tools by engaging upper rear wall 160 of track member 146 over track member mounting wall 114 of mid-channel member 90 such that spacing projections 166 of rear wall 148 of track member 146 abut track member mounting wall 114 of mid-channel member 90. Referring to FIGS. 6*a* and 14, track members 146 may be mounted to track member mounting walls 96 of upper sub-frame members 74 in a similar manner. Referring back to FIG. 13*a*, lower rear wall 160 of track members 146 additionally include anti-dislodgment protrusion 168 which prevents dislodgment of track member 146 from mid-channel member 90 (or upper sub-frame member 74) when track member 146 is moved vertically with respect thereto.

Figure 13B:
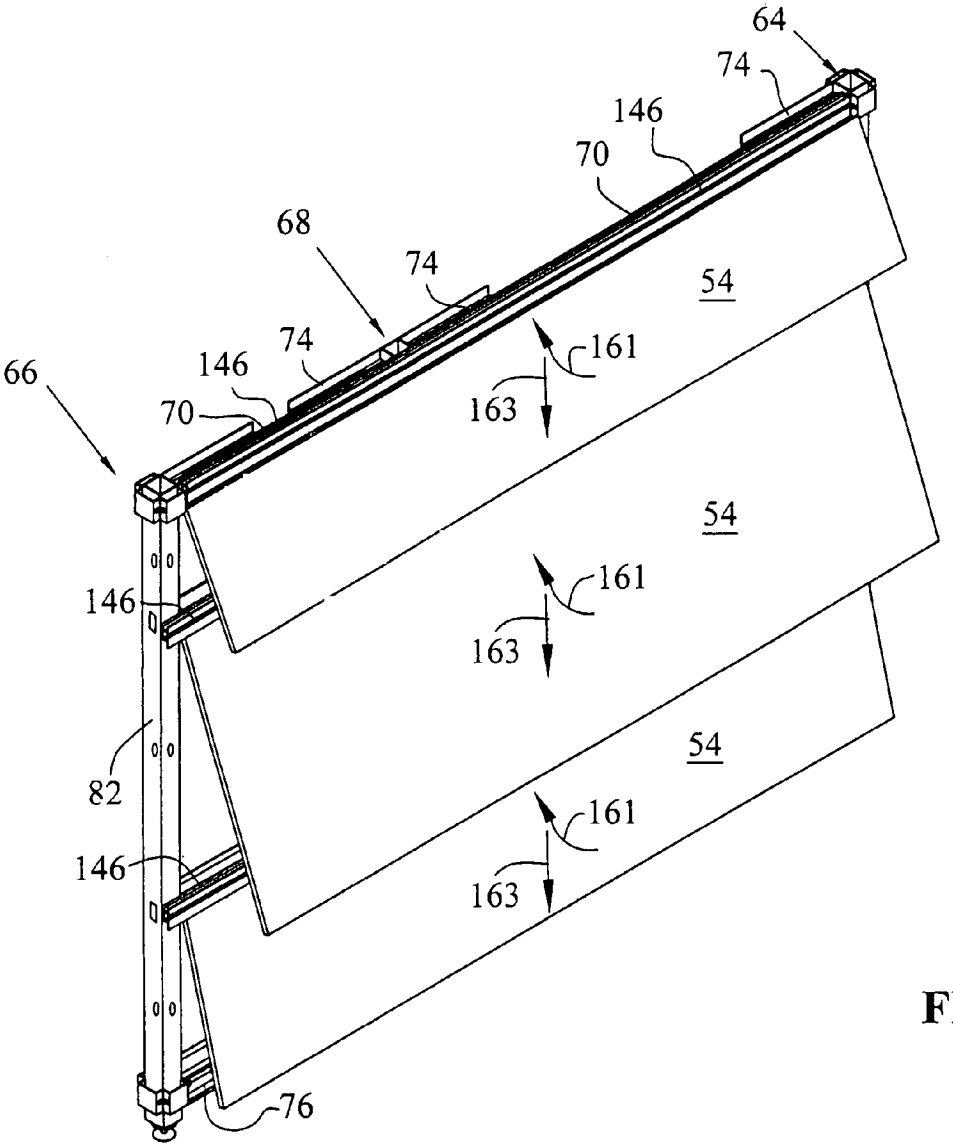
FIG. 13*b* is a perspective view illustrating the manner in which tiles are attached to the framework of the partition system.

Referring together to FIGS. 13*a* and 13*b*, tiles, such as decorative tiles 54, are attached to track members 146 by tilting the tile at an angle with respect to vertical and inserting the upper edge of the tile into tile space 164 defined between lower wall 152, lower front wall 158, and lower rear wall 160 and pushing the tile upwardly within tile space 164 while also moving the tile to a vertical position. This first component of movement of the tile is shown by arrow 161 in FIG. 13*b*. In this manner, the lower edge of the tile clears upper front wall 154 of another track member 146 (or clears ridge 106 of horizontal wall 104 of a lower sub-frame member 76, FIG. 6*a*), and the lower edge of the tile is moved into tile space 162 defined between upper wall 150, upper front wall 154, and upper rear wall 156 of the track member 146. Thereafter, as shown by arrow 163 in FIG. 13*b*, the tile is shifted downwardly such that the lower edge of the tile rests on upper wall 150 of the lower track member 146 (or upon horizontal wall 104 of a lower sub-frame member 76).

Figure 2:
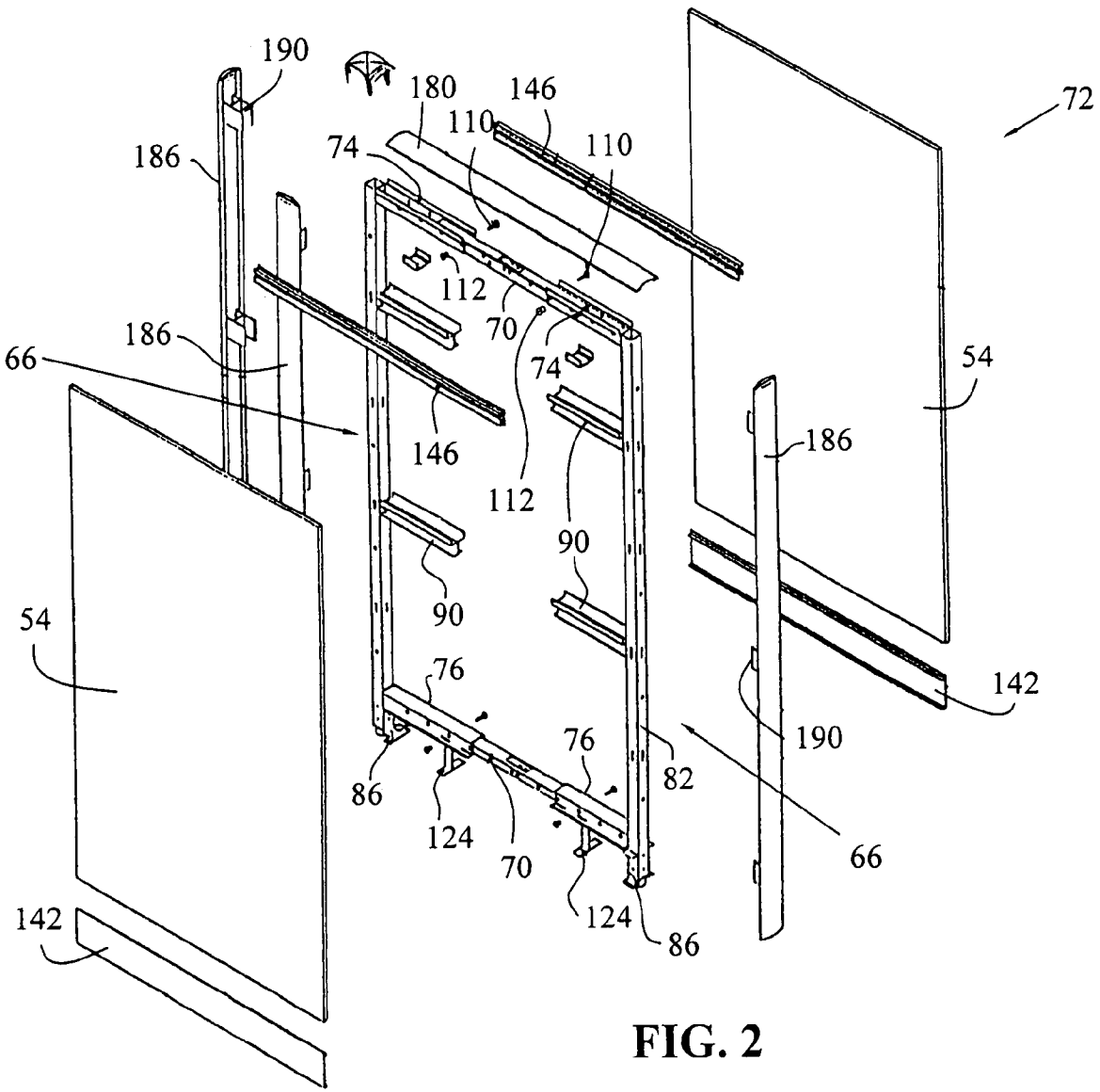
FIG. 2 is an exploded view of a single framework section of a partition system according to the present invention.

Referring to FIG. 14, the rear faces 54*b* of the tiles 54 may additionally include hooks 170 for engaging the interior surfaces of track member mounting walls 114 of mid-channel members 90. The foregoing connection is particularly useful with large tiles 54 which extend along the entire height of the framework 52 to prevent such tiles 54 from bowing outwardly relative to framework 52. Therefore, as shown in FIGS. 2 and 16, relatively large tiles 54 may be mounted to framework 52 which extend the entire distance between the track members 146 which are mounted to upper sub-frame members 74 and lower sub-frame members 76.

Additionally, as shown in FIG. 14, swing brackets 172 may be attached to framework 52 as shown in FIG. 14 to provide further support for the upper edges of tiles 54. Specifically, swing brackets 172 include tongues 174 which are received into grooves 176 which may be provided in track members 146 to attach swing brackets 172 to a pair of track members 146 which are disposed on opposite sides of framework 52. Swing brackets 172 further include spacers 178 which abut base wall 92 of upper sub-frame members 74. In this manner, swing brackets 172 also connect a pair of track members 146 which are disposed on opposite sides of framework 52 to secure the connection between track members 146 and framework 52.

Figure 16A:
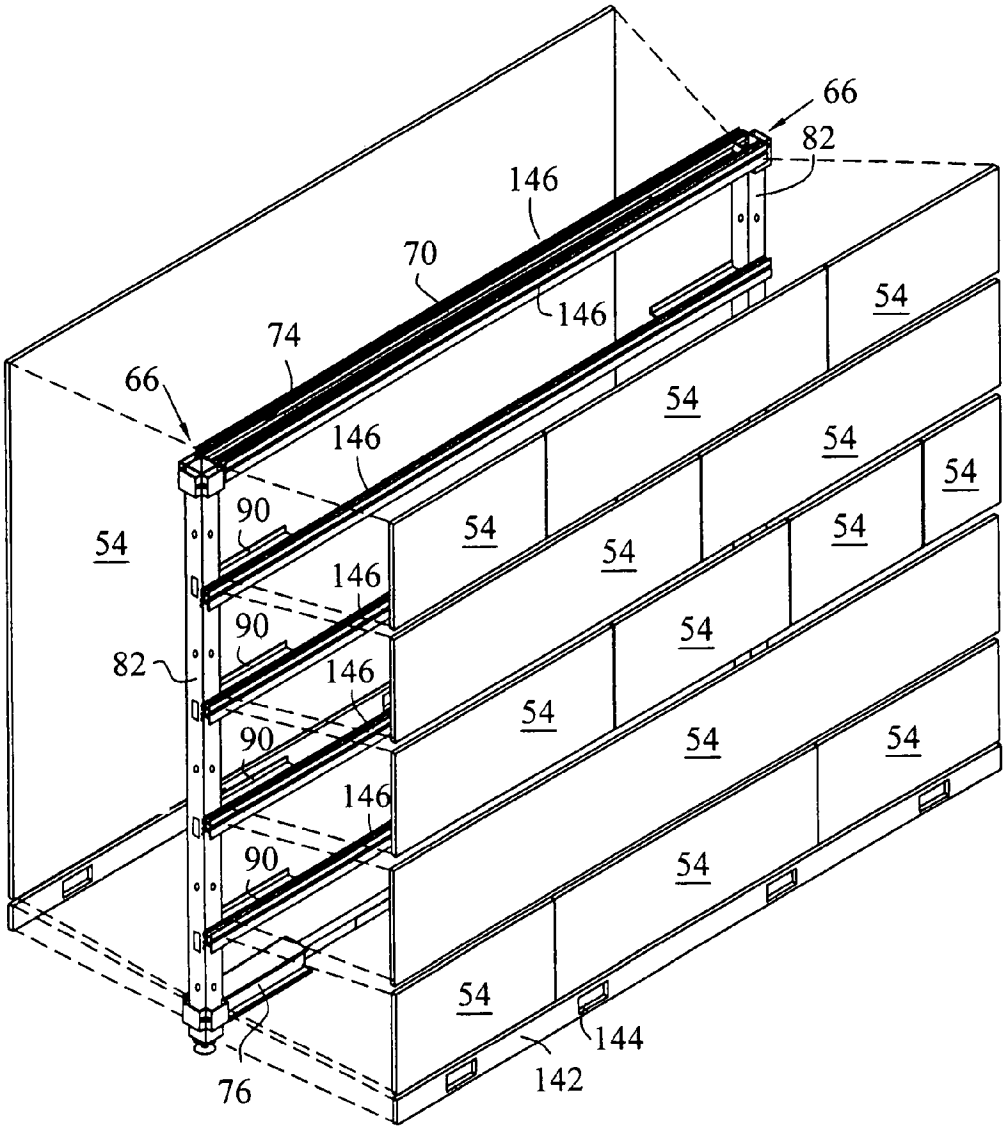
FIG. 16*a* is an exploded view of a portion of a partition system framework, showing five track members disposed at horizontal intervals along one side of the framework, with a plurality of smaller tiles mounted to one side of the framework and a single large tile mounted to an opposite side of the framework.

Referring to FIG. 16*a*, a portion of framework 52 of an exemplary partition system 50 is shown which includes two C-shaped vertical frame members 66 connected by spanners 70. The two C-shaped vertical frame members 66 in FIG. 16*a* may be connected to further vertical frame members 64–68 as desired, in the manner described above, to create a larger framework 52 of a desired size and shape. Each vertical frame member 66 includes one upper sub-frame member 74 and one lower sub-frame member 76 attached thereto, and further, also includes four mid-channel members 90 attached thereto. Five track members 146 are shown attached to the framework 52 on one side thereof in FIG. 16*a*; however up to five track members 146 may also be attached to the opposite side of framework 52 as desired. Specifically, one track member 146 is attached to the upper sub-frame members 74 of the vertical frame members 66, and four track members 146 are attached to the respective mid-channel members 90 thereof.

Figure 16B:
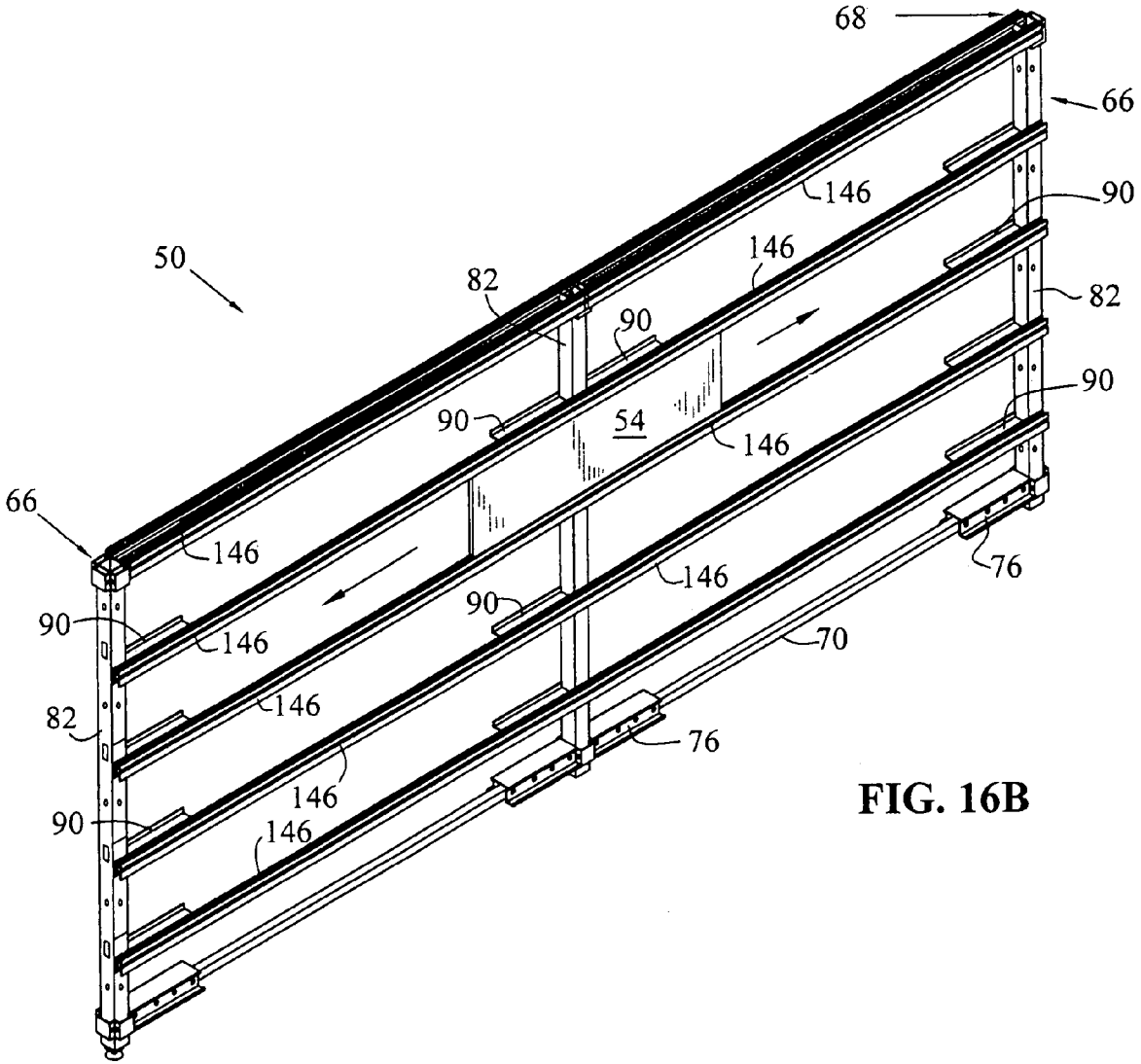
FIG. 16*b* is a perspective view of a portion of a partition system framework, showing a tile mounted to one side of the framework between a pair of vertically spaced track members, the tile selectively locatable at any one of a plurality of horizontally spaced locations along the track members irrespective of the positioning of the framework.

On one side of framework 52 of FIG. 16*a*, a number of decorative tiles 54 of varying width are mounted between pairs of vertically adjacent track members 146 or, with respect to the lowermost tile 54, between the lowermost track member 146 and the lower sub-frame members 76 of the framework 52, in the manner described above. Notably, the lateral location of each tile 54 which is mounted between adjacent track members 146 is not determined or related to the locations of the vertical frame members 66, but is only determined by the placement of track members 146. In this manner, as shown in FIG. 16*b*, track members 146 allow for the placement and location of tiles 54 which is independent of the configuration of framework 52 therebeneath, such that tiles 54 may be arranged in any desired pattern on the face of framework 52. For example, a repeating, brick-like pattern of tiles 54 may be arranged upon framework 52, or alternatively, a random arrangement of tiles 54 of varying width may be arranged upon framework 52.

Advantageously, the foregoing manner in which track members 146 are mounted to framework 52, and the manner in which tiles 54 are in turn mounted to track members 146, provides substantial design flexibility to partition system 50. Similarly, each of the functional tiles, which are described below, may also be selectively mounted upon framework 52 in the same manner as described above with respect to decorative tiles 54.

The number mid-channel members 90 which are attached to the vertical frame members 64, 66, and 68 may be varied as required to in turn vary the number of track members 146 which are attached to framework 52. Further, the number of track members 146 on each side of framework 52 may be varied to in turn accommodate varying height and/or positioning of tiles 54 on each side of framework 52. As shown in FIG. 16*a*, a number of tiles 54 of varying width and/or height may be mounted to opposite sides of framework 52. For example, a number of tiles 54 are mounted to one side of framework 52 in FIG. 16*a*, and a single, large tile 54 is mounted to the opposite side of framework 52. Further, because tiles 54 are attached to track members 146, which may span multiple framework sections 72 of framework 52, tiles 54 in turn may also span one or more framework sections 72 and/or vertical frame members 64–68 as desired, as shown in FIG. 16*b*, or may span only portions of framework sections 72. For example, referring to FIG. 1, tiles 54*a* each span two adjacent framework sections 72.

Figure 15:
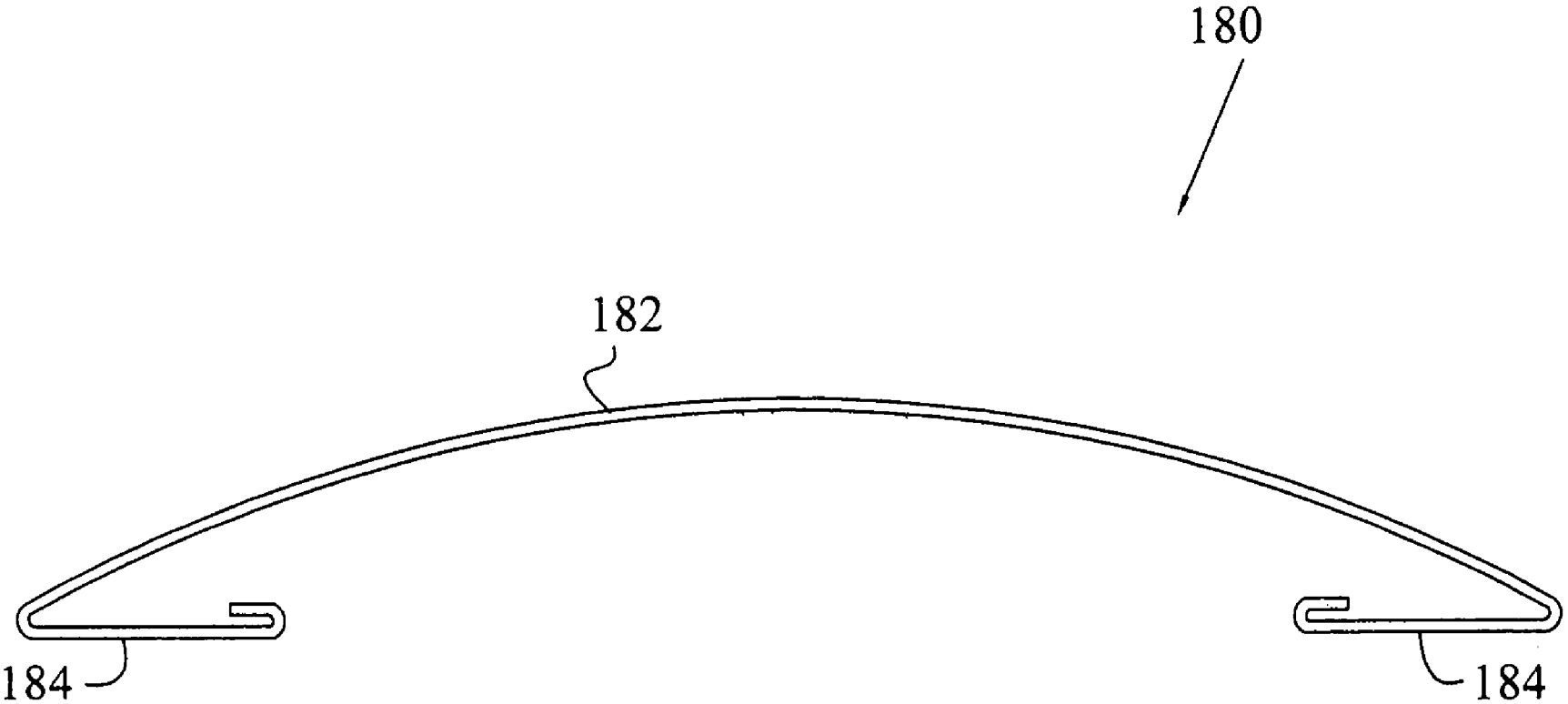
FIG. 15 is an end view of a top cap.

Top cap 180, shown in FIG. 15, generally includes arched body portion 182 and a pair of leg portions 182. As shown in FIG. 14, leg portions 182 rest upon upper front walls 154 of track members 146, and the ends of leg portions 182 engage upper rear walls 160 of track members 146, to attach top cap 180 to the uppermost track members 146 of the partition system framework 52. Top cap 180 covers channel 78 of upper sub-frame members 74, and provides an aesthetic, finished upper surface to framework 52 of partition system 50. Referring to FIG. 2, vertical trim elements 186 include arched body portions 188 and C-shaped attachment fittings 190 which engage around uprights 82 of vertical frame members 64, 66, 68 to attach vertical trim elements to framework 52. Similar to top caps 180, vertical trim elements 186 provide aesthetic, finished surfaces to framework 52 of partition system 50 at locations where uprights 82 of vertical frame members 64, 66, 68 would otherwise be exposed, such as at L-, or T-junctions within framework 52, or at the end portions of framework 52 where C-shaped vertical frame members 66 are located.

Figure 19:
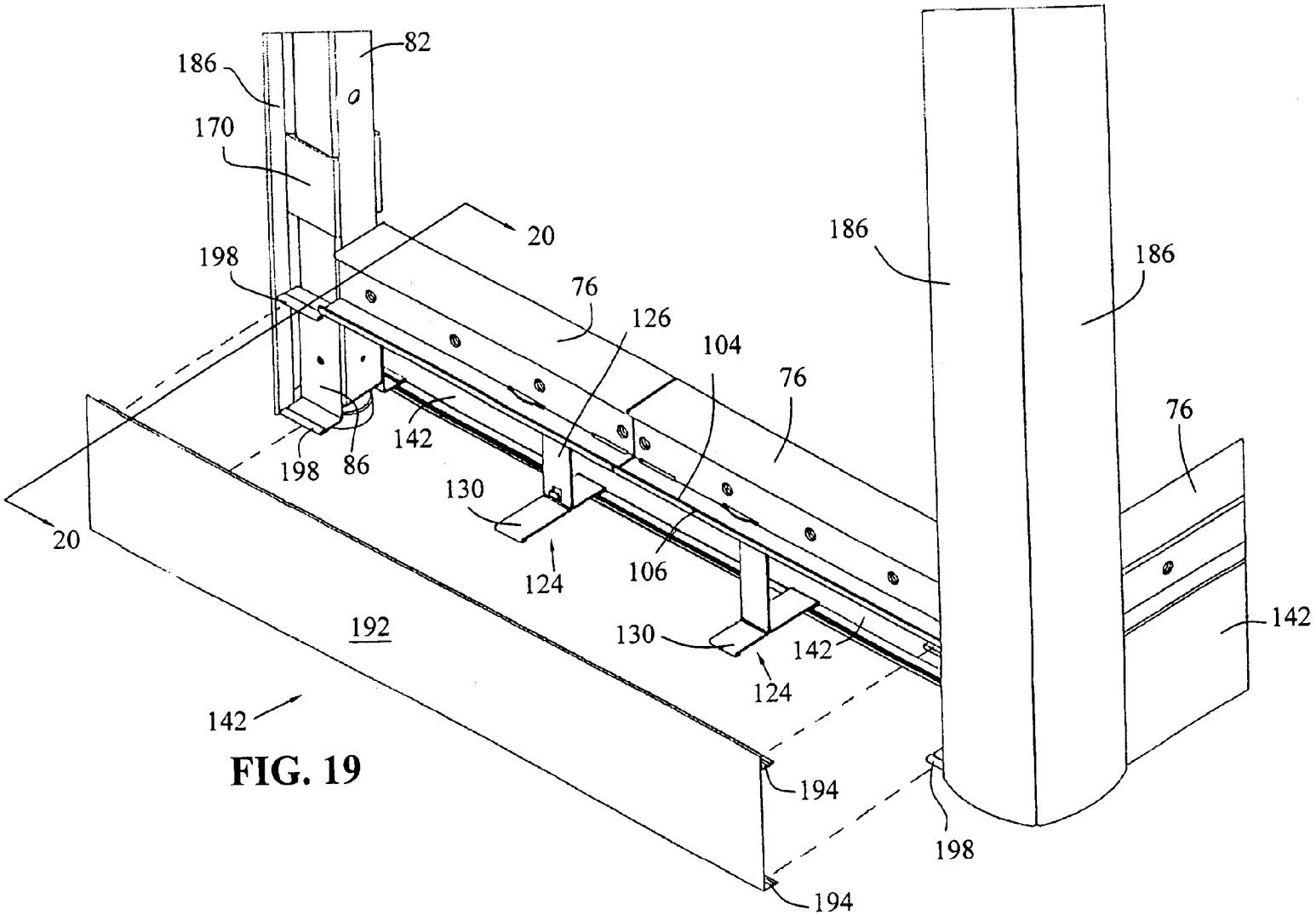
FIG. 19 is a perspective view of a lower portion of a partition system framework, showing the attachment of a floor trim element thereto.
Figure 20:
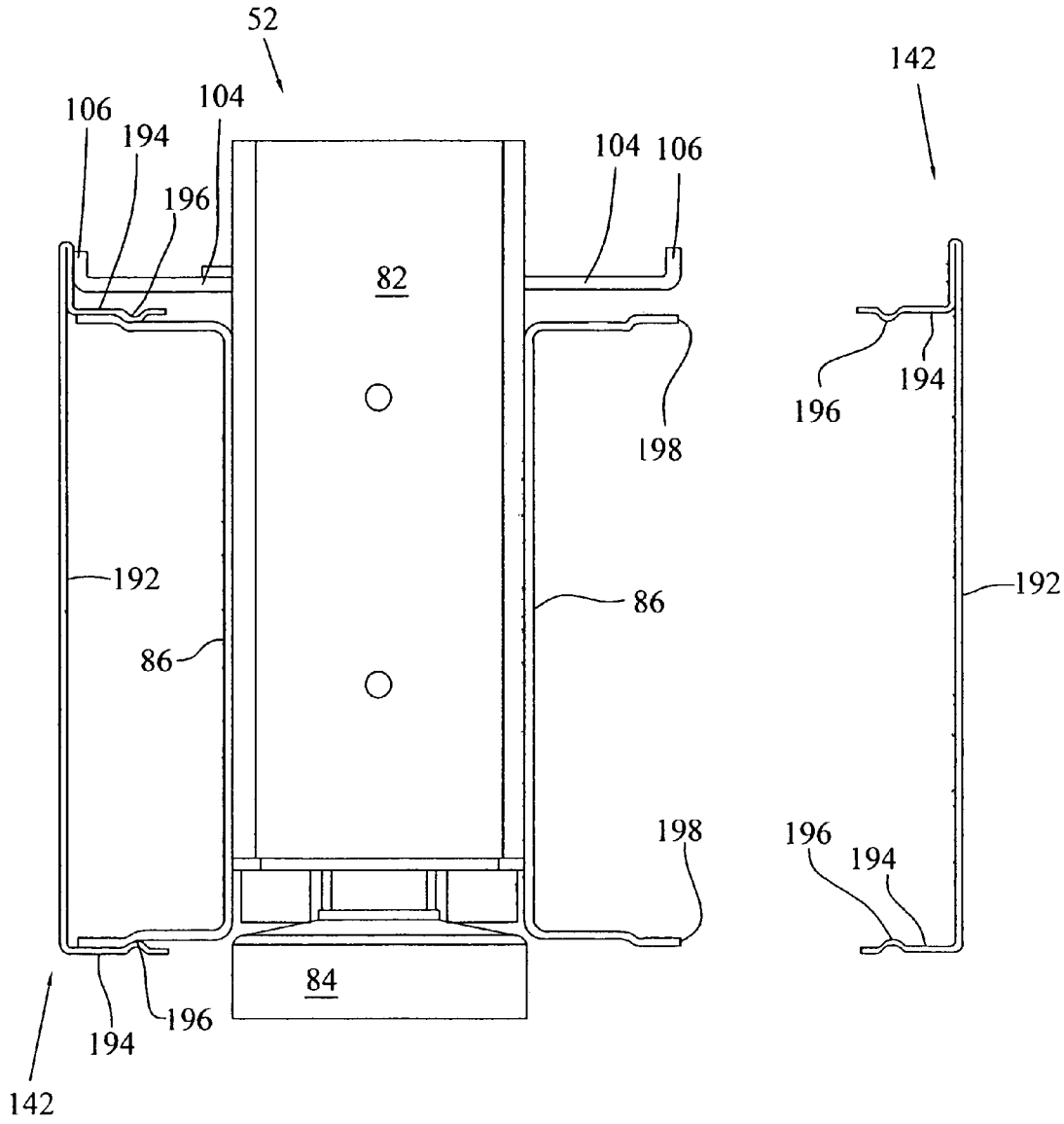
FIG. 20 is a sectional view taken along line 20—20 of FIG. 19.

Referring to FIGS. 19 and 20, the attachment of floor trim elements 142 to framework 52 is shown. Floor trim elements 142 generally include faces 192 with attachment legs 194 depending rearwardly therefrom, which have inwardly-directed lugs 196. C-shaped floor trim mounts 86 are secured to the lower ends of uprights 82 of vertical frame members 64, 66, and 68, and terminate in bent ends 198. Floor trim elements 142 are pressed onto floor trim mounts 86 such that attachment legs 194 of floor trim elements 142 are biased outwardly by engagement of lugs 196 with bent ends 198, until lugs 196 clear bent ends 198 to return inwardly to their original positions, thereby engaging behind bent ends 198 to secure floor trim elements 142 to floor trim mounts 86. Also, the upper portions of floor trim elements 142 above the upper attachment legs 194 thereof overlap horizontal walls 104 and ridges 106 of lower sub-frame members 76. Further, referring to FIG. 19, lower attachment leg 194 of each floor trim element 142 may additionally engage floor trim mounts 130 of harness brackets 124.

Figure 21A:
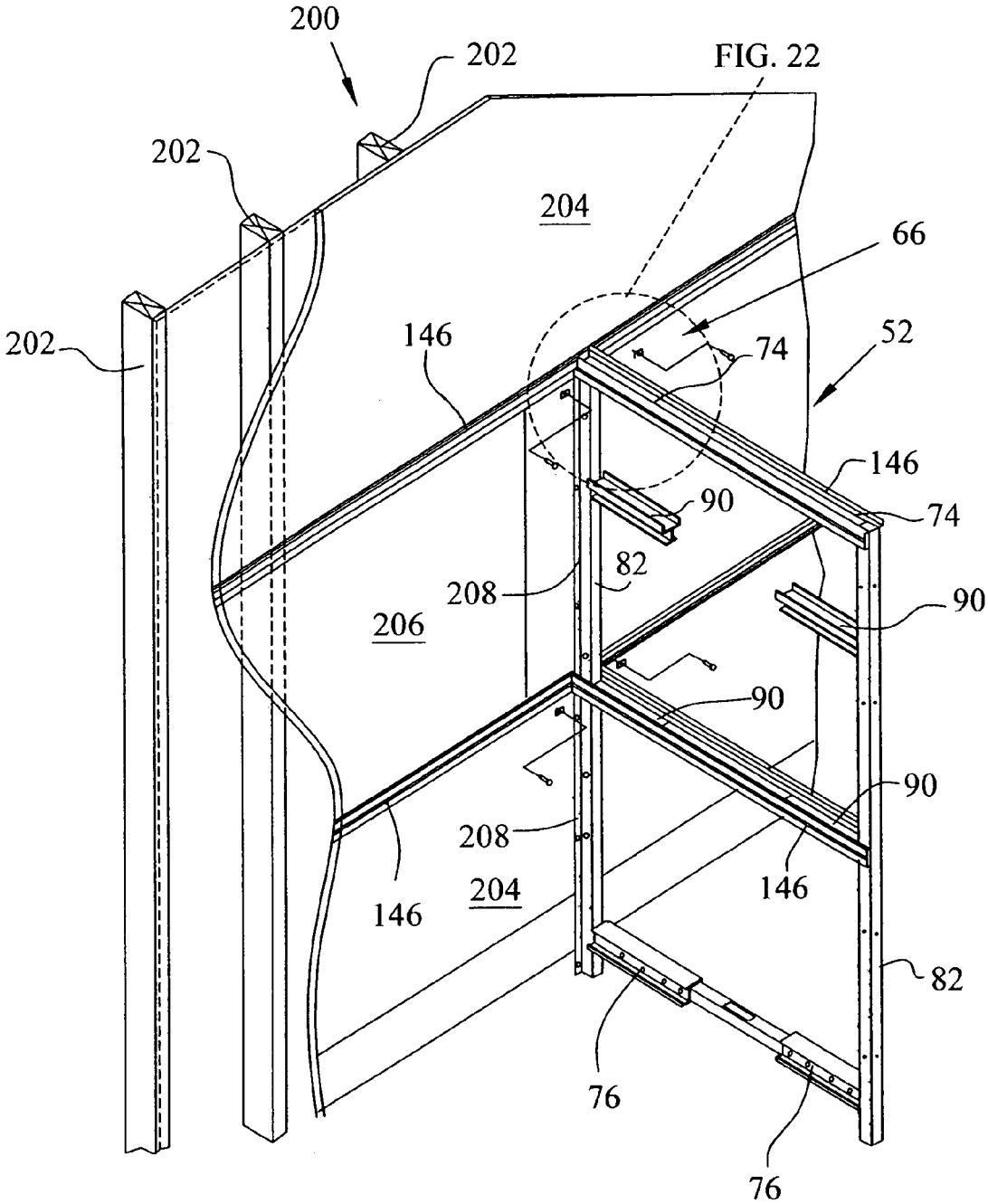
FIG. 21*a* is a perspective view showing the attachment of the partition system framework to a permanent, existing wall within an office space.
Figure 22:
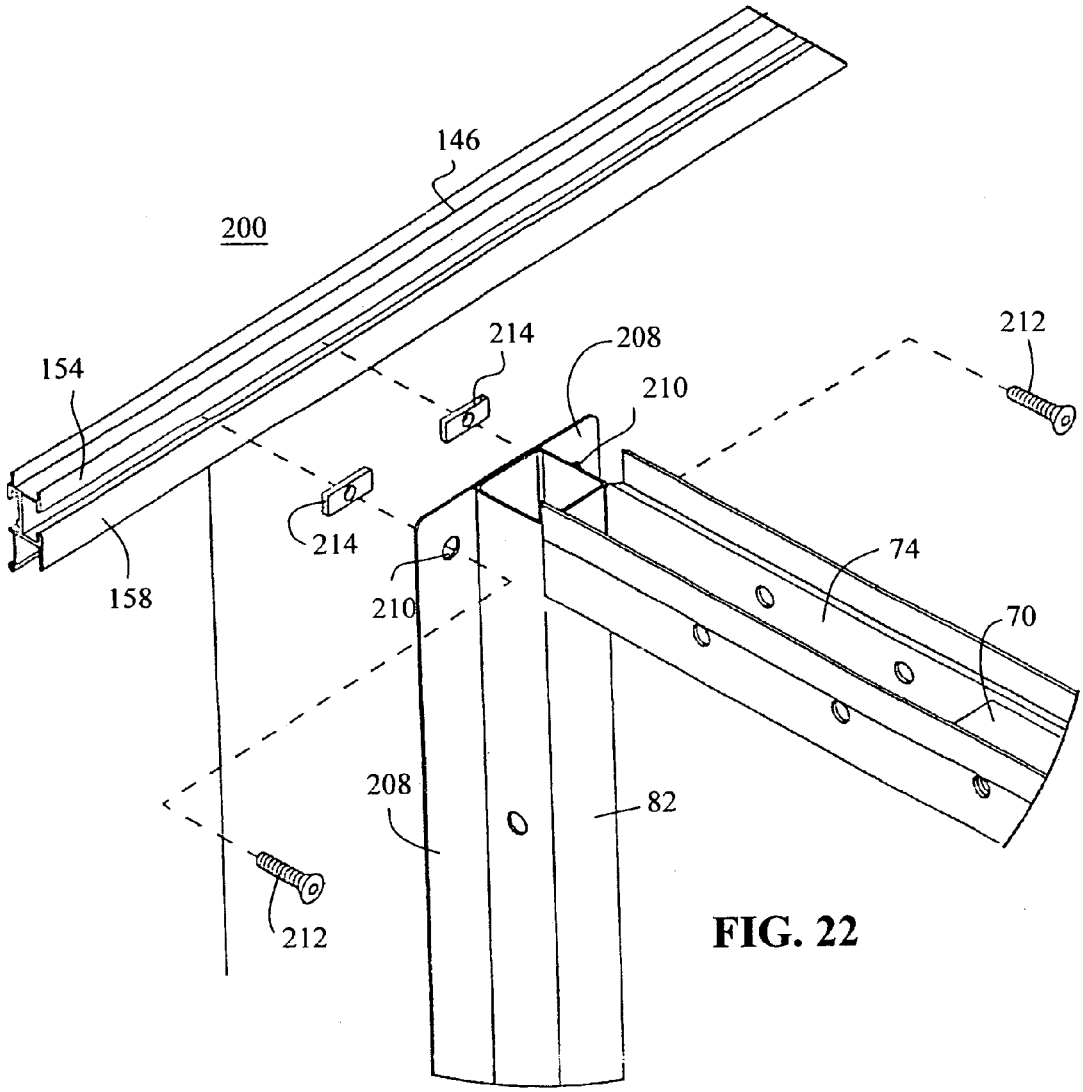
FIG. 22 is an enlarged view of a portion of FIG. 21*a;*

Framework 52 of partition system 50 may be mounted to existing, permanent walls 200 within an office space as shown in FIGS. 21*a* and 22. Referring to FIG. 21*a*, an existing, permanent wall 200 generally includes studs 202 to which track members 146 are mounted as described in the above-incorporated U.S. Pat. No. 5,309,686. Specifically, track members 146 may be mounted to studs 202 of permanent wall 200 using bolts (not shown) or may also be mounted to the drywall or other facing wall material 204 of permanent wall 200 between studs 202 using a bolt and molly anchor assembly (not shown) for example. Also, decorative wall panels 206 may be mounted to permanent wall 200 between track members 146 as described in the above-incorporated U.S. Pat. No. 5,309,686.

To attach framework 52 of partition system 50 to permanent wall 200, a vertical frame member of framework 52, such as C-shaped vertical frame member 66, is provided which mounting plate 208 attached to the face thereof opposite upper and lower sub-frame members 74, 76 and mid-channel members 90. Referring to FIG. 22, mounting plate 208 includes apertures 210 therein. Fasteners 212 are inserted through apertures 210 in mounting plate 208 and into rectangular-shaped connectors 214 which, when disposed in the orientation shown in FIG. 22, may be received within the channel of track members 146. After connectors 214 are received within track members 146, fasteners 212 are threaded further thereinto, eventually rotating connectors 214 such that connectors 214 engage behind upper front wall 154 and lower front wall 158 of track members 146. In this manner, upper front wall 154 and lower front wall 158 of track members 146 are captured between connectors 214 and mounting plate 208 to attach framework 52 to mounting tracks 146 of permanent wall 200. Generally, the foregoing attachment is used to either start a run of the partition system 50 from permanent wall 200, or to end a run of the partition system 50 against permanent wall 200, but may also be used to attach partition system 50 to permanent wall 200 wherever necessary along track members 146 within an interior office space, as indicated by the horizontal arrow in FIG. 21*a*.

Figure 21B:
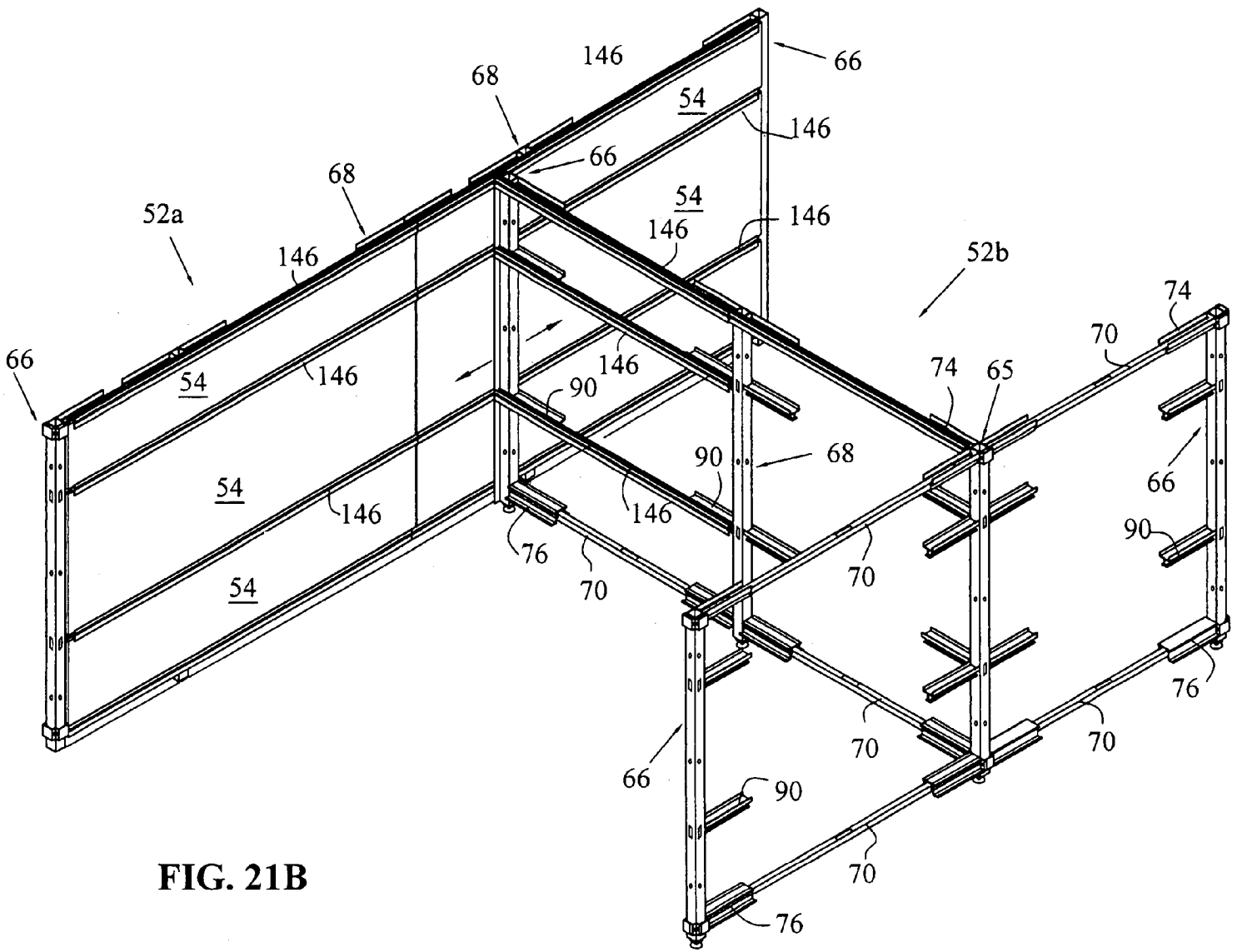
FIG. 21*b* is a perspective view showing the attachment of two intersecting runs of framework to one another in an off-module configuration.

Alternatively, as shown in FIG. 21*b*, the same attachment system described above with respect to FIGS. 21*a* and 22 may also be used to secure one run 52*a* of framework 52 to an intersecting run 52*b* of framework 52 within partition system 50 in a 90° off-module connection. In FIG. 21*b*, for example, framework run 52*a* may comprise a finished, existing segment of partition system 50 within a workspace, which includes track members 146 and tiles 54, with framework run 52*b* added as an extension from framework run 52*a*. Notably, due to the continuous extension of track members 146, framework run 52*b* may be attached to the track members 146 of framework run 52*a* at any selected location along framework run 52*a*, as indicated by the arrow in FIG. 21*b*, which provides unrestricted possibilities for the division of space provided by partition system 50.

Referring back to FIG. 21*a*, it may be seen that when track members 146 are attached to framework 52 of partition system 50, such track members 146 will horizontally align with the track members 146 on permanent wall 200. Similarly, referring to FIG. 21*b*, the track members of framework runs 52*a* and 52*b* will similarly align with one another. The alignment between the track members 146 of partition system 50 and track members 146 of permanent wall 200, as shown in FIG. 21*a*, and the alignment of the track members 146 of framework runs 52*a* and 52*b*, as shown in FIG. 21*b*, provide visual continuity in partition system to enhance the aesthetic appearance of the partition system 50 when same is attached to permanent wall 200 and/or when partition system includes intersecting framework runs.

Figure 23:
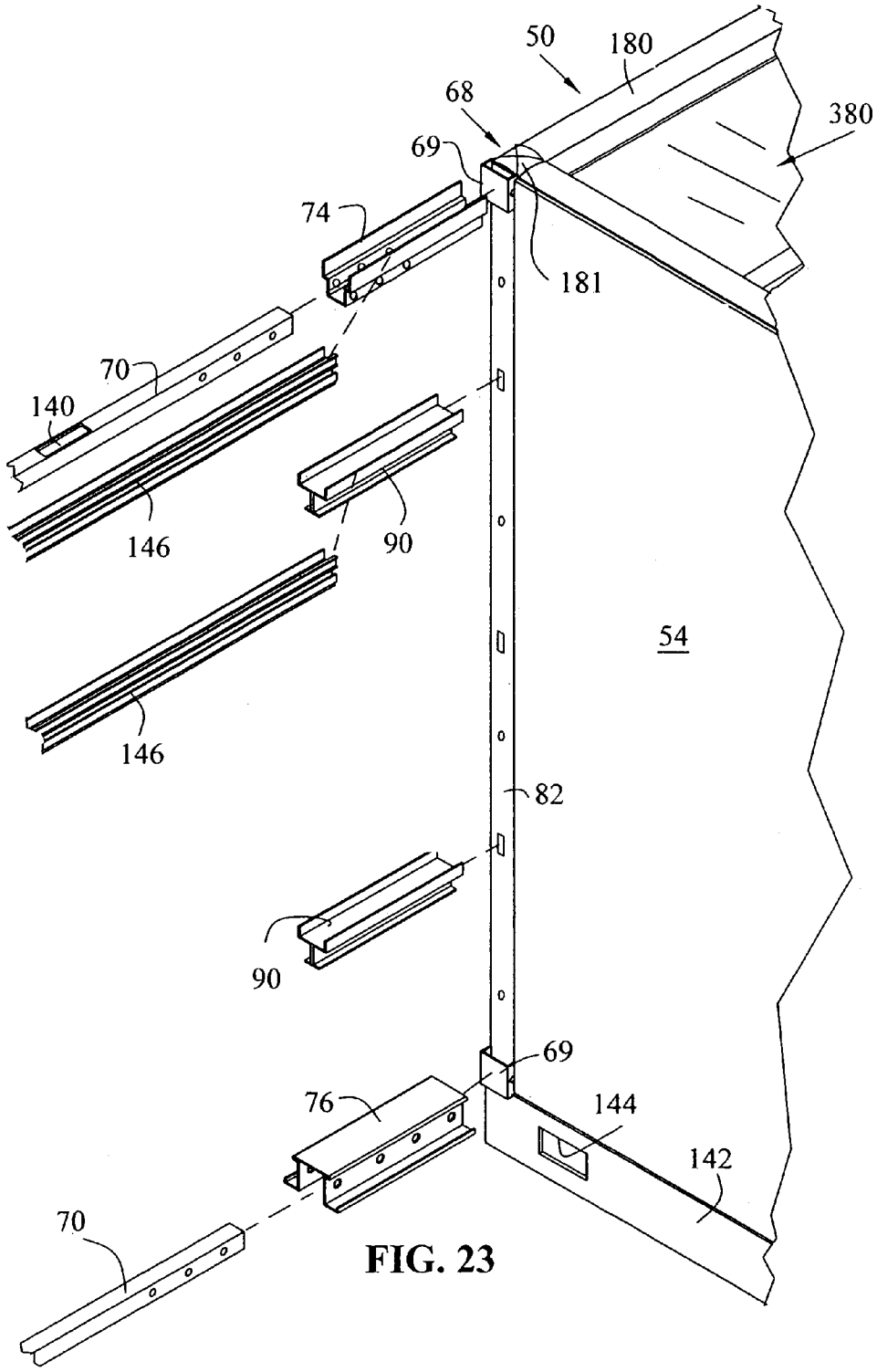
FIG. 23 is a perspective, exploded view showing the manner in which a framework run may be added to an installed section of the partition system.

Referring to FIG. 23, the manner in which an additional or "add-on" framework run may be attached to an installed portion of partition system 50 is shown. In FIG. 23, a portion of partition system 50 includes an L-junction provided by an L-junction vertical frame member 68, as installed in an interior space. The installed portion of partition system 50 further includes track members 146, tile 54, top caps 180, corner cap 181 mounted to framework 52 as described herein to finish partition system 50. However, after partition system 50 is installed, it is sometimes necessary to add an additional run of framework 52 thereto in order to reconfigure partition system 50 as desired. Advantageously, after a vertical trim element 186 (FIG. 2) is removed from one side of L-junction vertical frame member 68, the side of L-junction vertical frame member 68 is exposed to accommodate the attachment of upper and lower sub-frame members 74, 76, as well as mid-channel member 90, as described above. Then, as also described above, spanners 70 may be attached to upper and lower sub-frame members 74, 76 to extend framework 52 from L-junction vertical frame member 68. Finally, track members 146 may be attached to the new run of framework 52 to support decorative and functional tiles thereon in any desired configuration. In this manner, even after partition system 50 is fully installed, partition system 50 my be easily reconfigured as necessary to adapt to changing space division needs within an interior workspace.

Figure 24A:
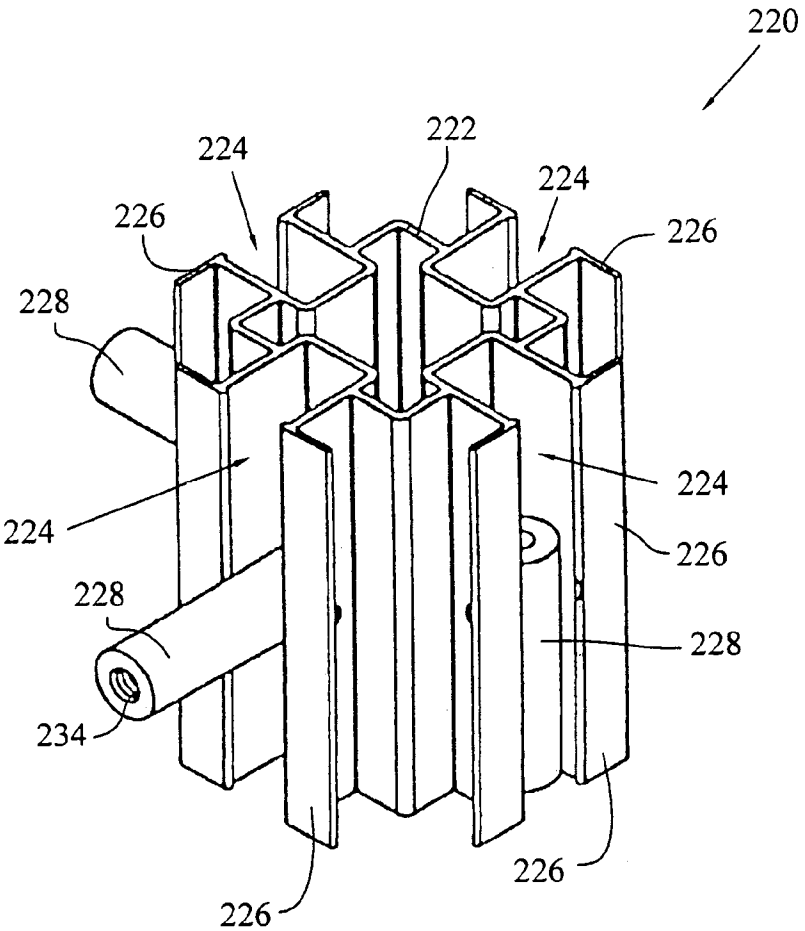
FIG. 24*a* is a perspective view of a corner block of a partition system framework according to a second embodiment.
Figure 24B:
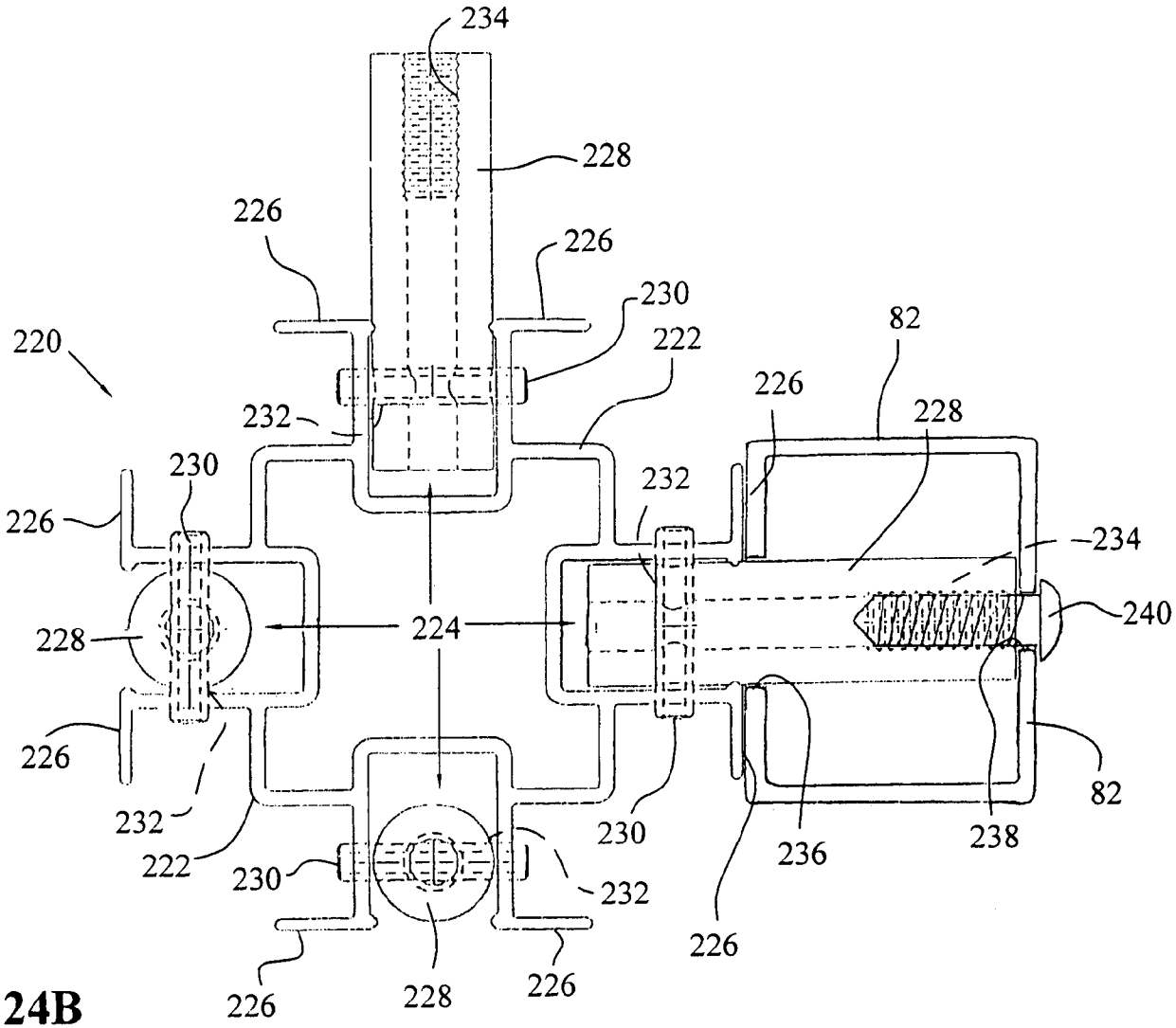
FIG. 24*b* is a horizontal sectional view through the center of the corner block of FIG. 24*a*, further showing an upright of a vertical frame member attached thereto.
Figure 25:
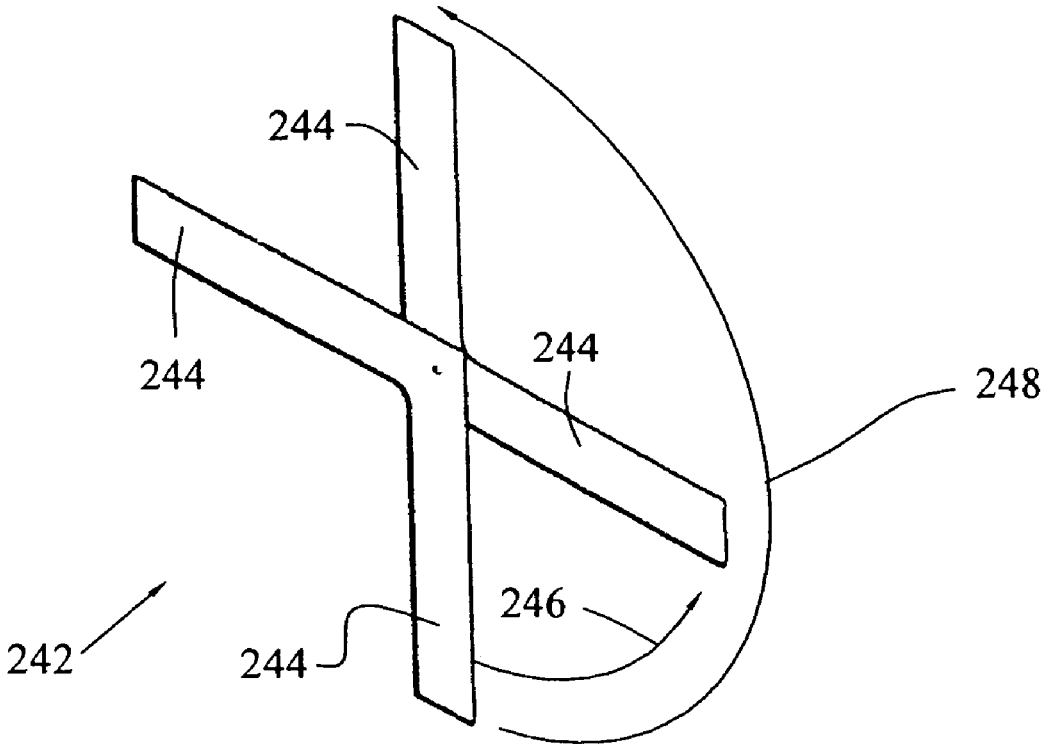
FIG. 25 is a perspective view of a swivel bracket for use in either L-, T-, or X-junctions within the partition system framework of a second embodiment.

Referring to FIGS. 24*a*–25, a second embodiment of framework 52 is shown, in which L-, T- or X-junctions are provided within framework 52 according to an alternative construction. Referring back to the first embodiment shown in FIGS. 3*a* and 3*b*, it may be seen that in order to provide an L-junction within framework 52, L-junction vertical frame member 68 is provided, which includes two upper sub-frame members 74 and two lower sub-frame members 76 rigidly or removeably attached thereto. As also described above with respect to the first embodiment, T-junction or X-junction vertical frame members are necessary to provide T-junctions and X-junctions, respectively, within framework 52. Further, in the first embodiment of framework 52 shown in FIGS. 3*a* and 3*b*, C-shaped vertical frame members 66 are typically used only at the ends of a run of framework 52, or as shown in FIGS. 21*a*–22, are used in off-module connections of framework 52 to a permanent wall or to another run of framework 52.

Referring to FIGS. 24*a* and 24*b*, the second embodiment includes corner blocks 220, which are used to connect up to four C-shaped vertical frame members to one another to provide L-, T-, and X-junctions within framework 52. Corner blocks 220 may be formed of a single metal extrusion, for example, or may alternatively be formed from a series of metal pieces attached to one another. Corner blocks 220 generally include central portion 222, and four outwardly-opening channels 224 terminating in upright abutment flanges 226. Attachment tubes 228 are pivotally mounted within channels 224 upon pins 230 which are received through transverse bores 232 of attachment tubes 228 and through the walls of channels 224. Referring to FIG. 24*b*, each attachment tube 228 additionally includes a longitudinal, threaded bore 234 extending therein opposite the ends of attachment tubes 228 which are attached to channels 224. Referring to FIG. 24*a*, each attachment tube 228 is pivotable between a retracted position in which the attachment tube 228 is disposed within a corresponding channel 224 of corner block 220 and an extended position in which attachment tube 228 is disposed perpendicular to channel 224 of corner block. In the extended position, the attachment tube 228 extends outwardly from corner block for attachment to uprights 82 of C-shaped vertical frame members 66, as described below.

Referring to FIG. 24*b*, when an attachment tube is in an extended position, same may be inserted through first aperture 236 in the wall on a first side of upright 82 of a C-shaped vertical frame member 66 until the end of attachment tube 228 abuts the interior opposite wall of upright 82 around second aperture 238, which is smaller in diameter than first aperture 236. The abutment of the end of attachment tube 228 with the wall of upright 82 about second aperture 238, as well as the abutment of the wall of upright 82 about first aperture 236 with upright abutment flanges 226 of channel 224, acts as stop upon extension of attachment tube 228 into upright 83, and indicates to an installer that upright 82 is properly positioned with respect to corner block 220. Thereafter, a fastener 240 is inserted through second aperture 238 into threaded bore 234 of attachment tube 228 to secure upright 82 of C-shaped vertical frame member 66 to corner block 220. As may be seen from FIGS. 24*a* and 24*b*, two C-shaped vertical frame members 66 may be connected to corner block 220 at a right angle to provide an L-junction within framework 52. Further, three or four C-shaped vertical frame members 66 may be connected to corner block 230 to provide a T-junctions or an X-junctions within framework 52, respectively, as desired. When not in use, attachment tubes 228 are disposed in the above-described retracted position. Thus, in the second embodiment, because only C-shaped vertical frame members 66 are used to form L-, T-, and X-type junctions within framework 52, the use of specialized L-, T-, and X-junction vertical frame members is not required to form L-, T-, and X-type junctions within framework 52, thus reducing the number of types of vertical frame members required.

Referring to FIG. 25, swivel bracket 242 is provided to secure the upper ends of adjacent C-shaped vertical frame members when same are connected to corner block 230 in an L-, T-, or X-junction in the second embodiment. Swivel bracket 242 includes a pair of L-shaped metal plates pivotally secured to one another as shown in FIG. 25. In the orientation shown in FIG. 25, swivel bracket 242 has an X-shape with four exposed blades 244 which are received within channels 78 of the upper sub-frame members 74 of four C-shaped vertical frame members 66 to secure same together in an X-junction. Swivel bracket 242 may be rotated along arrow 246 in FIG. 25 to overlap two blades 244 such that swivel bracket 242 has a T-shape for receipt within channels 78 of the upper sub-frame members 74 of three adjacent C-shaped vertical frame members 66 to secure same together in a T-junction. Finally, swivel bracket 242 may be rotated along arrow 248 in FIG. 25 to overlap two sets of blades 244 such that swivel bracket 242 has a L-shape for receipt within channels 78 of the upper sub-frame members 74 of two adjacent C-shaped frame members 66 to secure same together in an L-junction.

Figure 17:
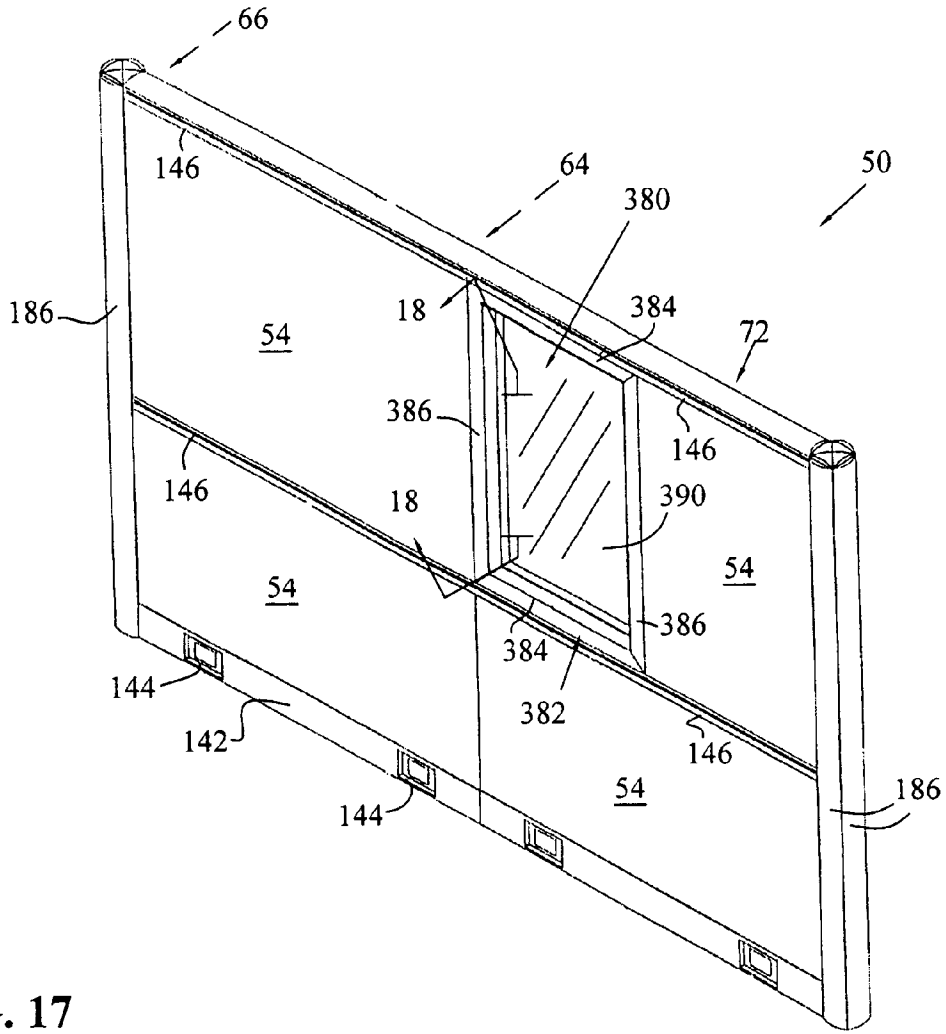
FIG. 17 is a portion of a partition system including a window tile mounted within the partition system framework.
Figure 18:
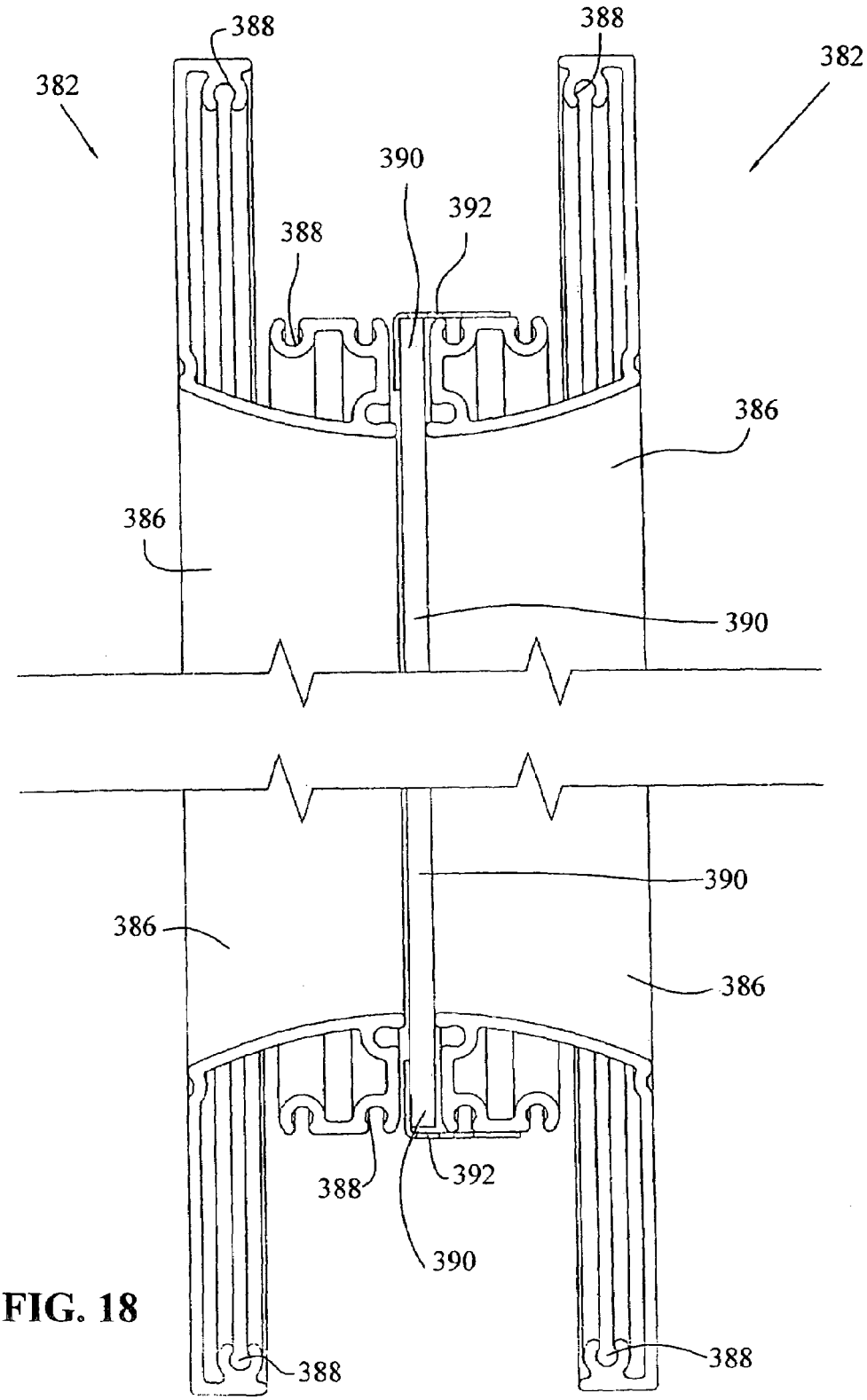
FIG. 18 is a sectional view taken along line 18—18 of FIG. 17.

Referring to FIGS. 17 and 18, window tile 380 is shown mounted to framework 52 of an exemplary partition system 50. Window tile 380 includes a pair of opposing window frame units 382, each defined by horizontal and vertical frame members 384, 386, respectively. Window frame units 382 are attached to framework 52 in the same manner as described above with respect to tiles 54, wherein the edges of horizontal frame members 384 thereof are captured by track members 146. Each frame member 384, 386 includes embossments 388 for receipt of fasteners (not shown) for attaching frame members 384, 386 together to define rectangular window frame units 382. A glass or other transparent or translucent pane 390 is attached to one of the opposing frame units 382 by brackets 392, and is captured between opposing frame units 382 and located centrally within framework 52 when the opposing frame units 382 are attached to framework 52. Alternatively, a sheet of fabric mesh or other material may be attached to one of frame members 384, 386 by brackets 392, by adhesive, or by a spline (not shown) secured to one of members 384, 386 in a suitable manner. Such fabric mesh or other material may provide a semi-opaque transition through framework 52, which provides visual privacy yet allows for air and sound passage between the opposite sides of partition system 50.

In FIGS. 26–45*d*, a variety of functional tiles are shown which, in addition to decorative tiles 54, may be mounted to framework 52 of partition system 50 to provide functional features thereto. Generally, each of the functional tiles described below includes an upper edge and a lower edge similar to decorative tiles 54, enabling the functional tiles to be attached to framework 52 of partition system 50 in the same manner as that described above with respect to decorative tiles 54. Thus, the attachment of each functional tile below to framework 52 will not be further described.

Figure 26:
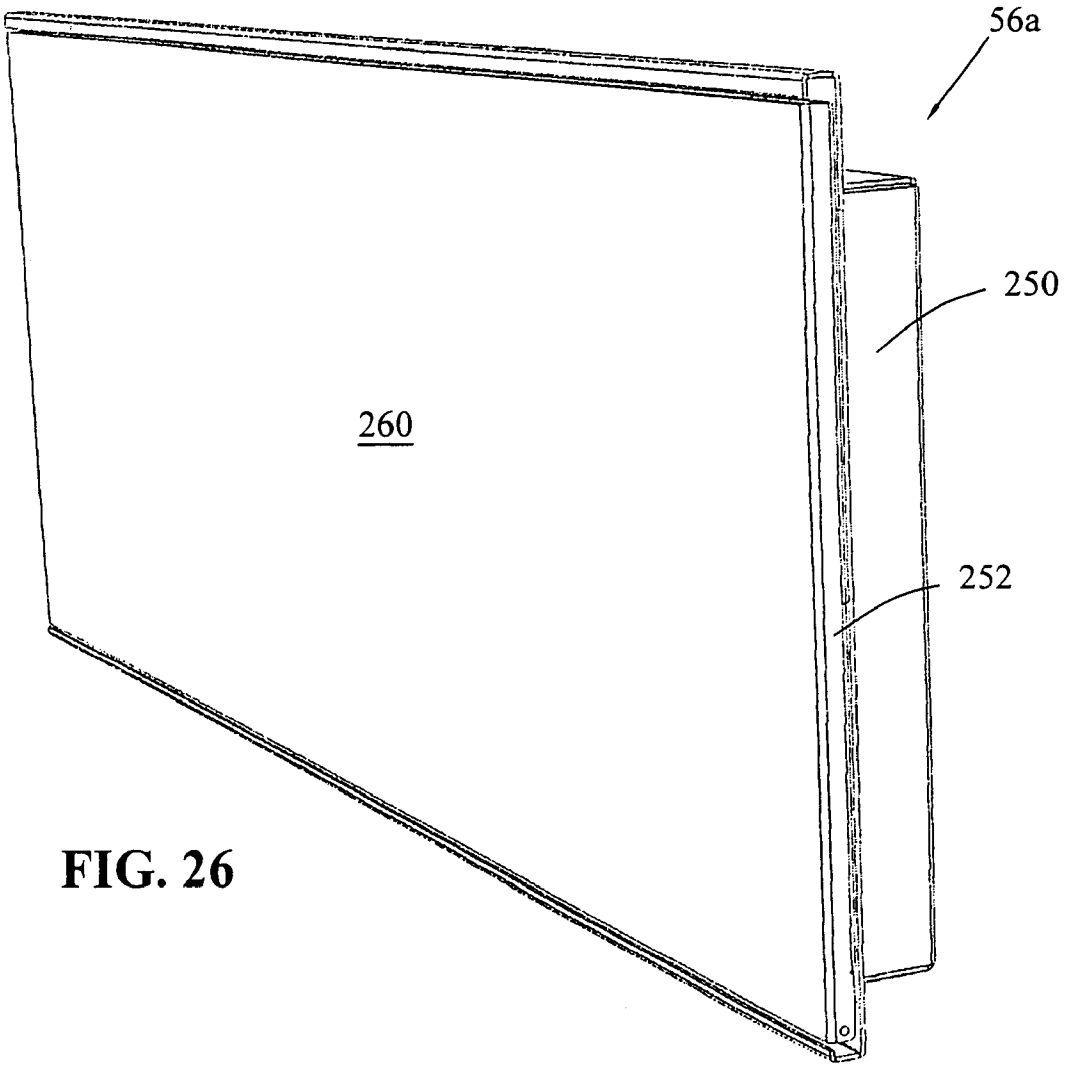
FIG. 26 is a perspective view of a first retractable work surface tile, showing the work surface frame thereof in a retracted or storage position.
Figure 27:
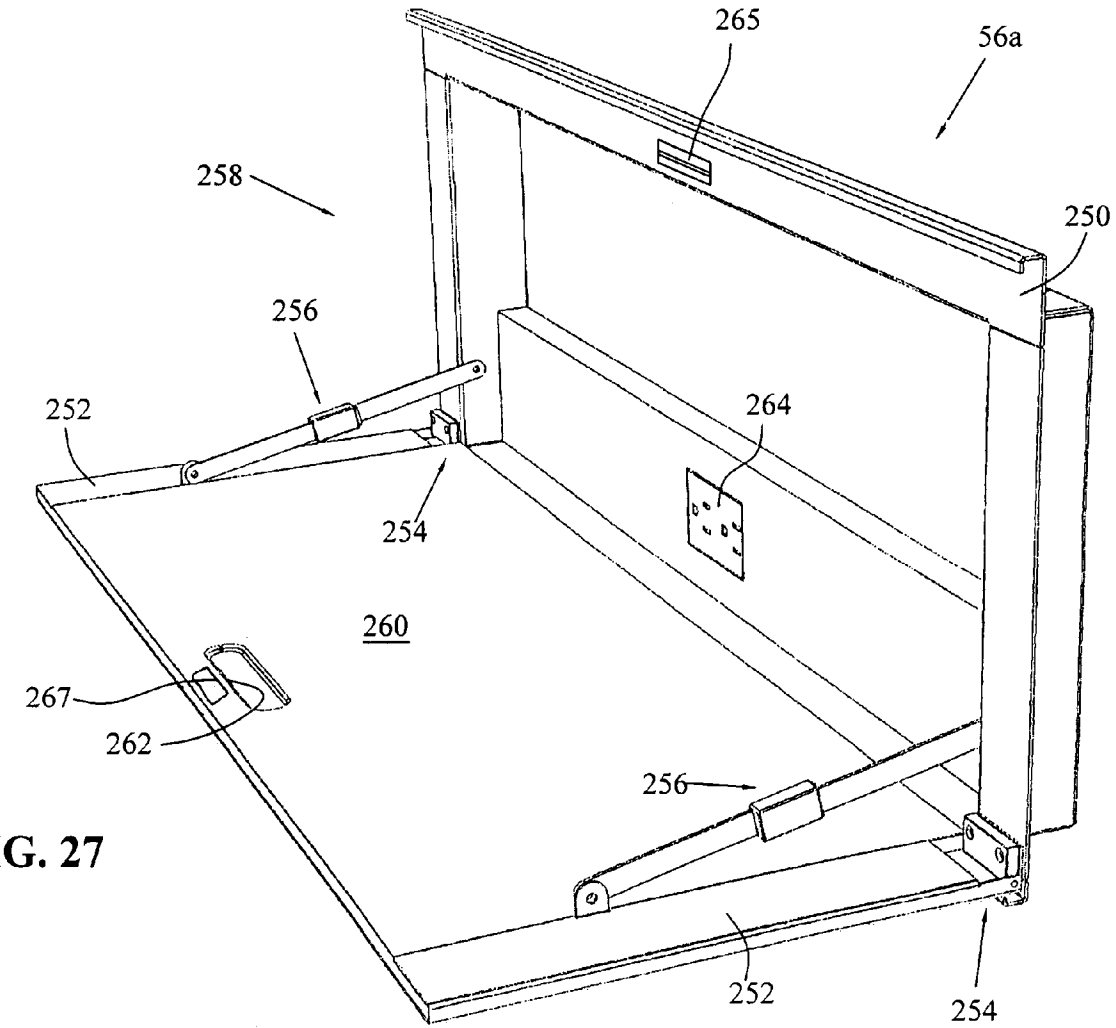
FIG. 27 is a perspective view of the retractable work surface tile of FIG. 26, showing the work surface frame in an extended or use position.
Figure 28:
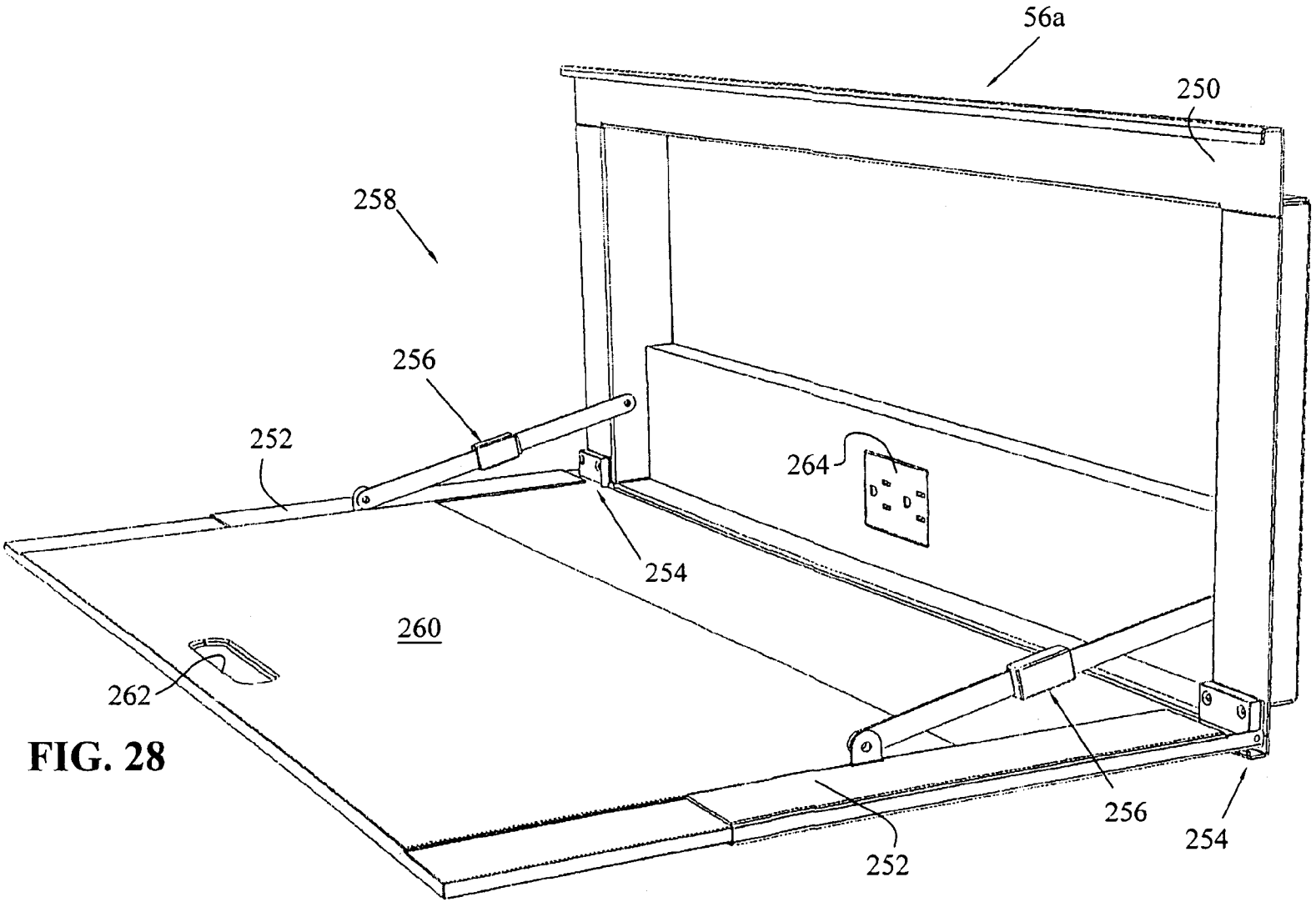
FIG. 28 is a perspective view of the retractable work surface tile of FIG. 27, further showing the work surface slidably extended from the work surface frame.

Referring to FIGS. 26–28, retractable workspace tile 56*a* is shown, which includes tile body 250 having upper and lower edges, and work surface frame 252 pivotally connected by pivot hinge 254 at a lower end thereof to tile body 250. Work surface frame 252 is also connected to tile body 250 by a pair of retracting-type hinges 256 such that work surface frame 252 may be move between a retracted or storage position, shown in FIG. 26, and an extended or use position, shown in FIGS. 27 and 28. In the extended or use position shown in FIGS. 27 and 28, work surface frames are supported by retracting-type hinges 256 to define workspace area 258. Referring to FIGS. 27 and 28, work surface 260 includes handle recess 262 which may be grasped by a user to pull work surface 260 outwardly of work surface frame 252 to an extended position shown in FIG. 28. As shown in FIG. 27, any of the retractable workspace tiles 56 described herein may include magnet 265 on tile body 250 (or to work surface 260) aligned to engage magnetically attractive material 267 on work surface 260 (or on tile body 250) to hold work surface 260 against tile body 250 when work surface frame is disposed in the retracted, non-use position. Additionally, tile body 250 of retractable work surface tile 56*a* may include a power/data module 264 mounted therein, including electrical outlet 269 and data port 271 for providing electrical and/or data services to workspace area 258.

Figure 29:
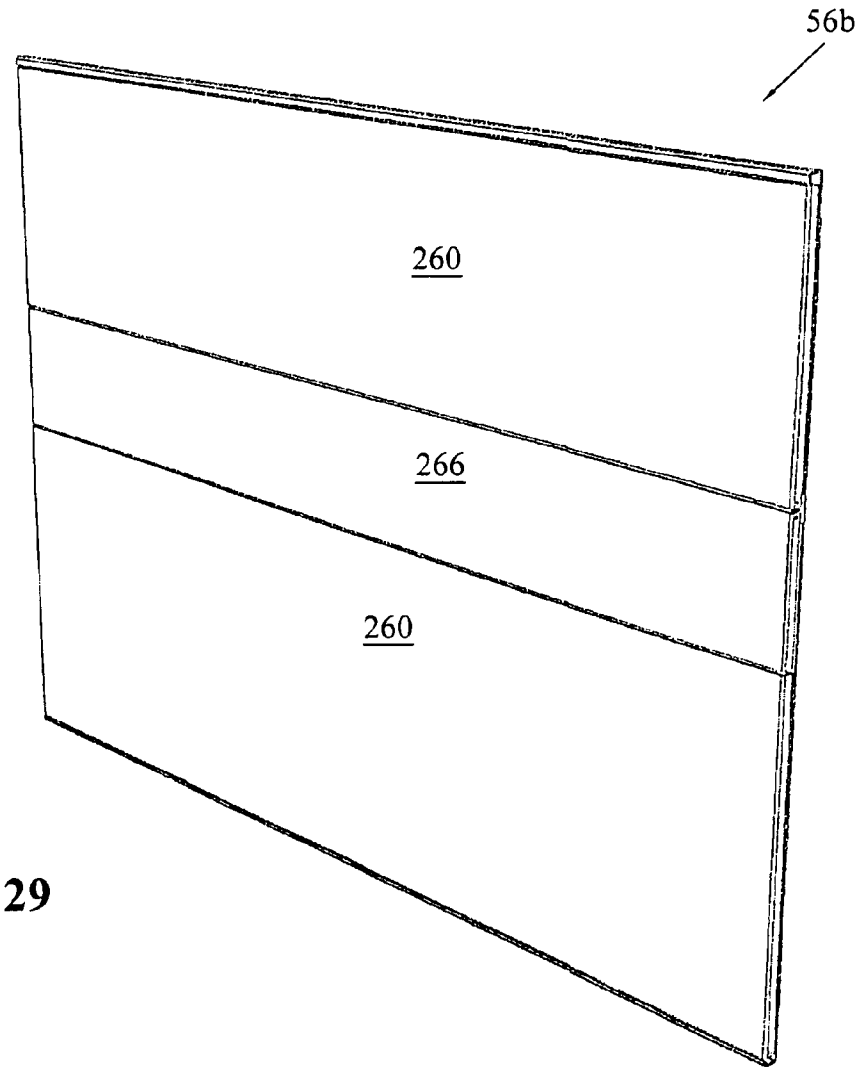
FIG. 29 is a perspective view of a second retractable work surface tile, showing the upper and lower work surface frames thereof in a retracted or storage position.
Figure 30:
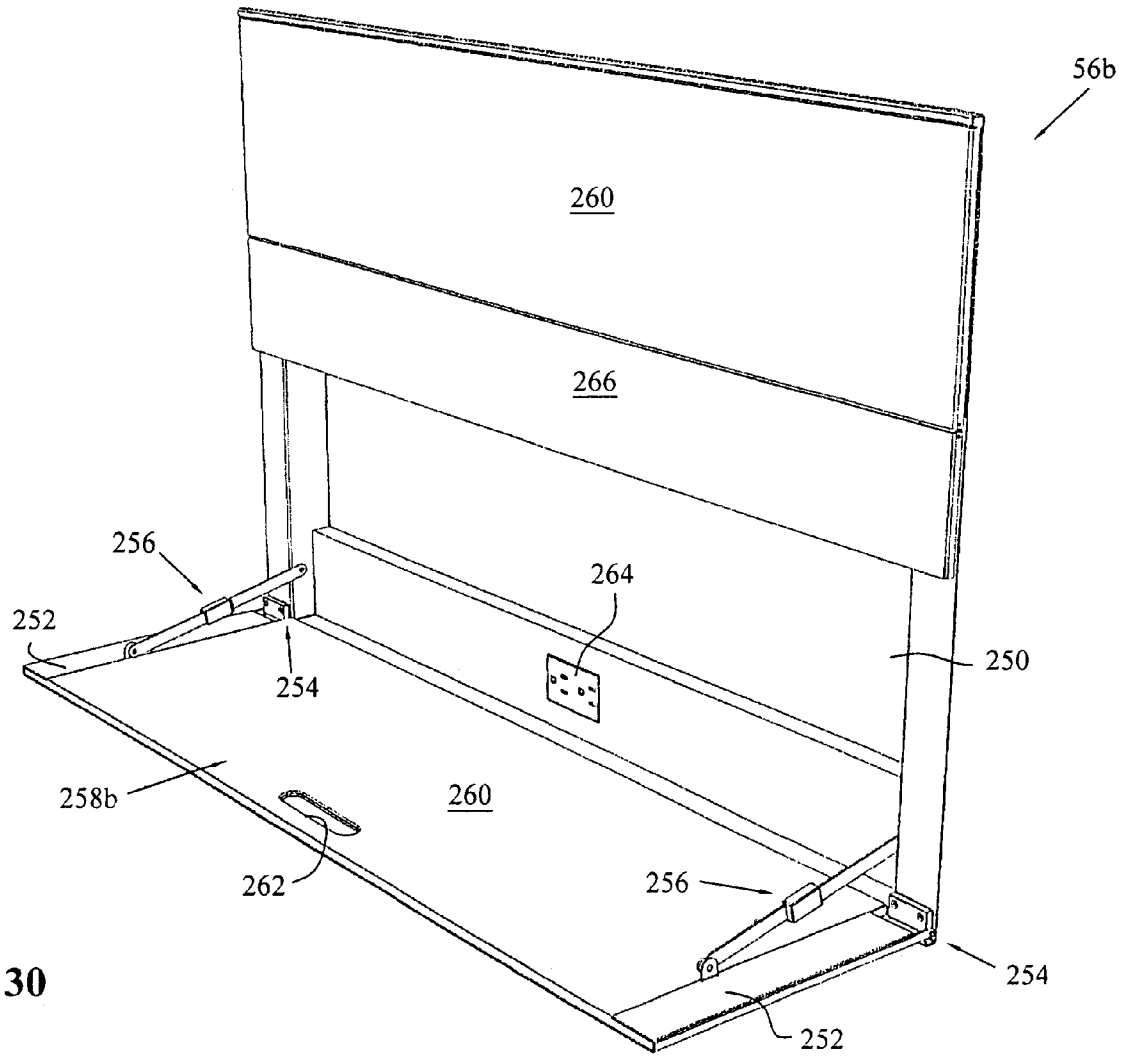
FIG. 30 is a perspective view of the retractable work surface tile of FIG. 29, showing the lower work surface frame thereof in an extended or use position.
Figure 31:
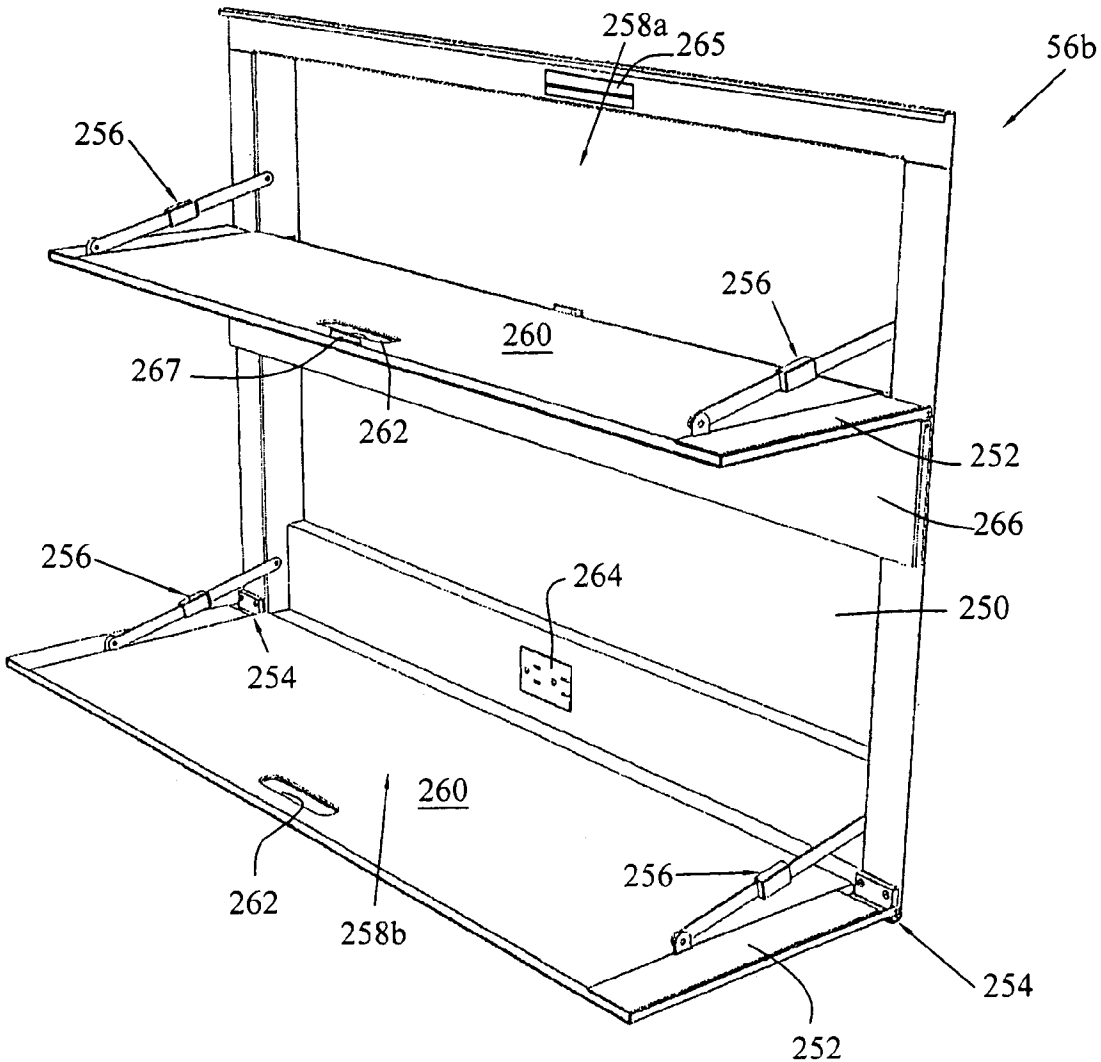
FIG. 31 is a perspective view of a the retractable work surface tile of FIG. 29, showing both the upper and lower work surface frames thereof in an extended or use position.
Figure 32:
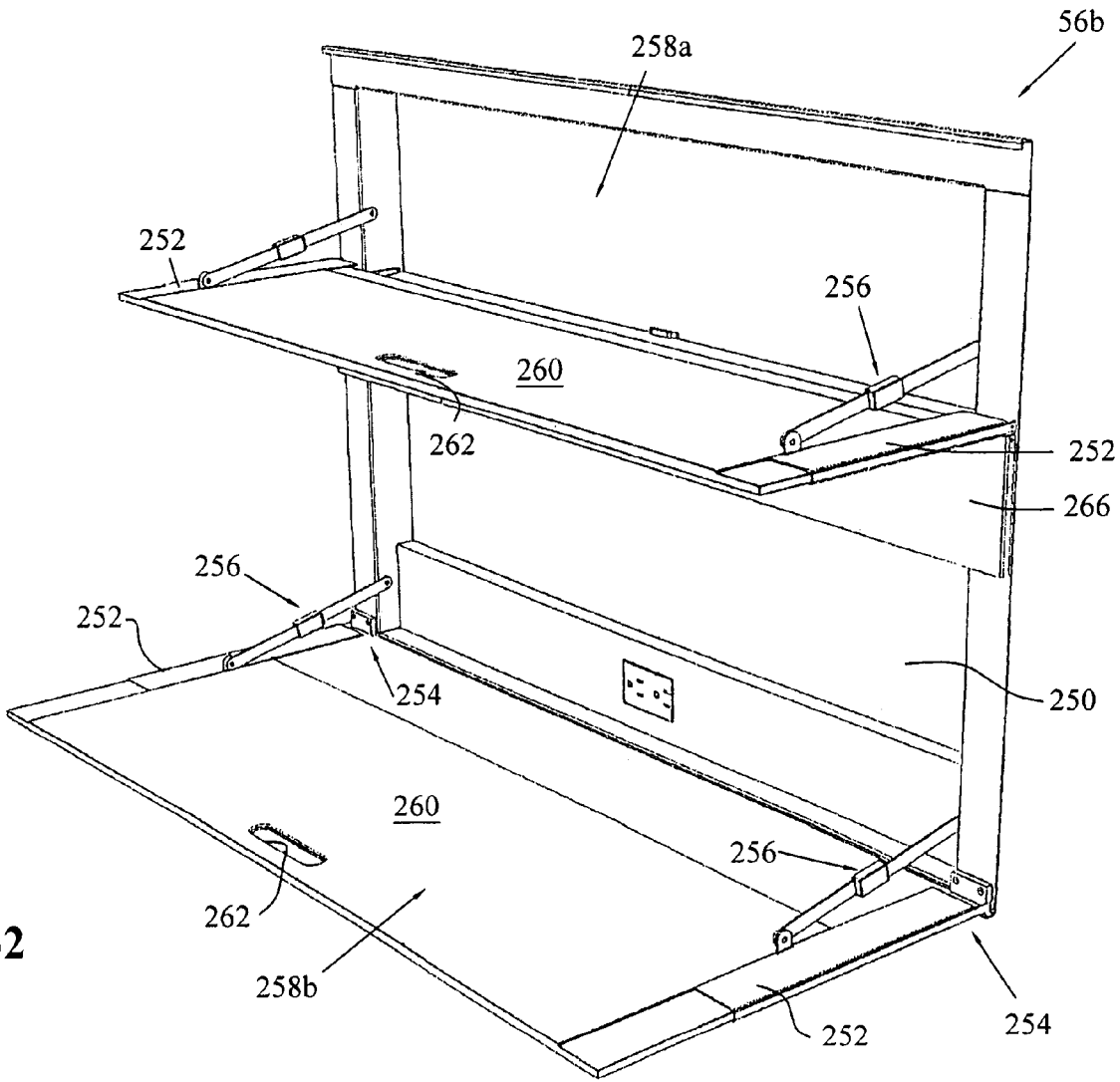
FIG. 32 is a perspective view of the retractable work surface tile of FIG. 29, showing both the upper and lower work surface frames in extended or use positions, and further showing the lower work surface slidably extended from the lower work surface frame.
Figure 33:
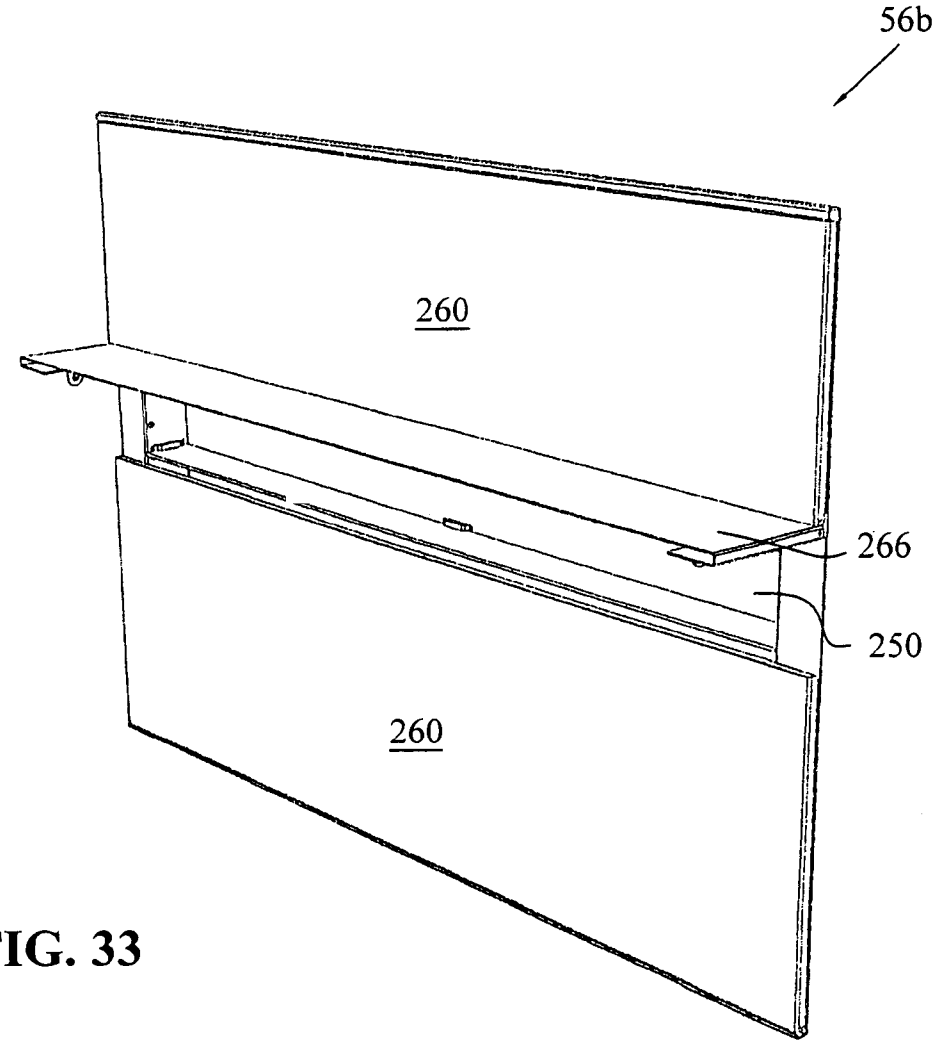
FIG. 33 is a perspective view of the retractable work surface tile of FIG. 29, showing the center panel thereof pivoted to an open position.

Referring to FIGS. 29–33, a second retractable workspace tile 56*b* is shown, which is similar to retractable workspace tile 56*a*, and includes upper and lower retractable workspace frames 252*a*, 252*b* moveable between retracted or storage positions, shown in FIGS. 29, 30, and 33, and extended or use positions, shown in FIGS. 30–32 to define upper and lower workspaces areas 258*a*, 258*b*, respectively. Outlet modules 264 may be provided within tile body 250 of retractable workspace tile 56*b* to provide electrical and/or data services to each workspace area 258*a*, 258*b*. Additionally, retractable work space tile 56*b* includes center tile 266 which is normally disposed in a lowered position as shown in FIGS. 29–32, but which also may be pivoted to a raised position, shown in FIG. 33, to provide access to a lighting fixture, for example, which may be disposed behind center tile 266 to provide lighting to upper or lower workspace areas 258*a*, 258*b*.

Figure 34:
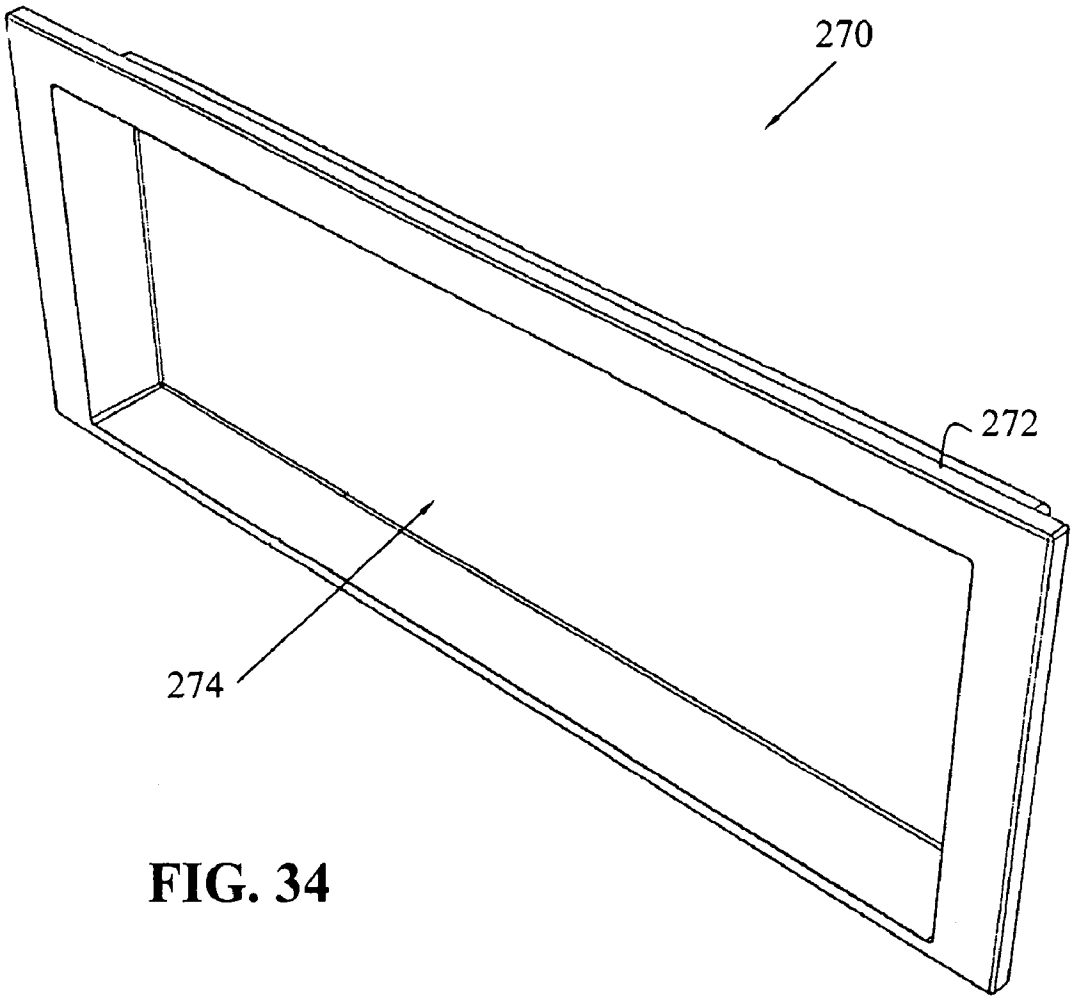
FIG. 34 is a perspective view of a storage tile.

Referring to FIG. 34, storage tile 270 is shown, which includes upper and lower edges and tile body portion 272 defining cavity 274 therein. When storage tile 270 is mounted to framework 52 of partition system 50, cavity 274 of storage tile 270 is disposed within the interior space of framework 52. Thus, in many of the applications described further below, storage tile 270 advantageously facilitates the use of the interior space within framework 52 for storage.

Figure 35:
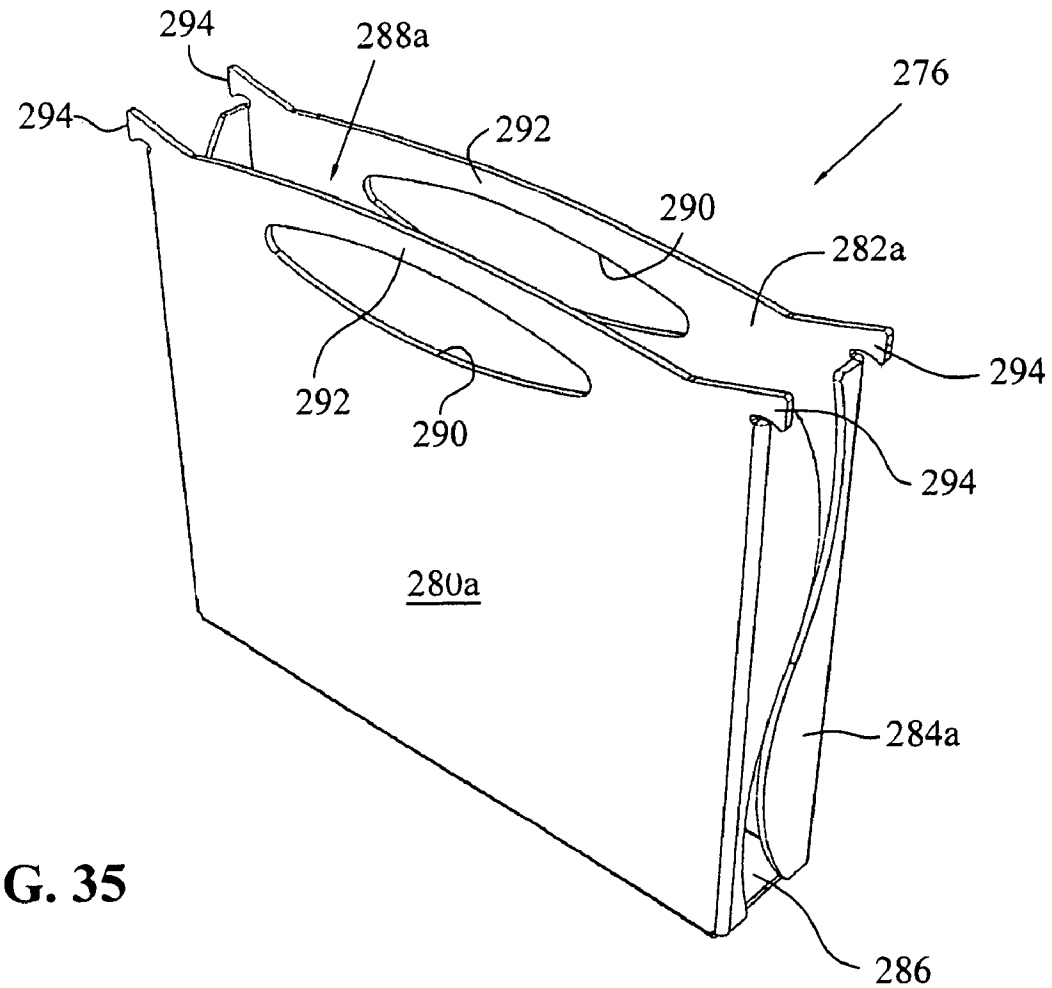
FIG. 35 is a perspective view of a horizontal file pocket.
Figure 36:
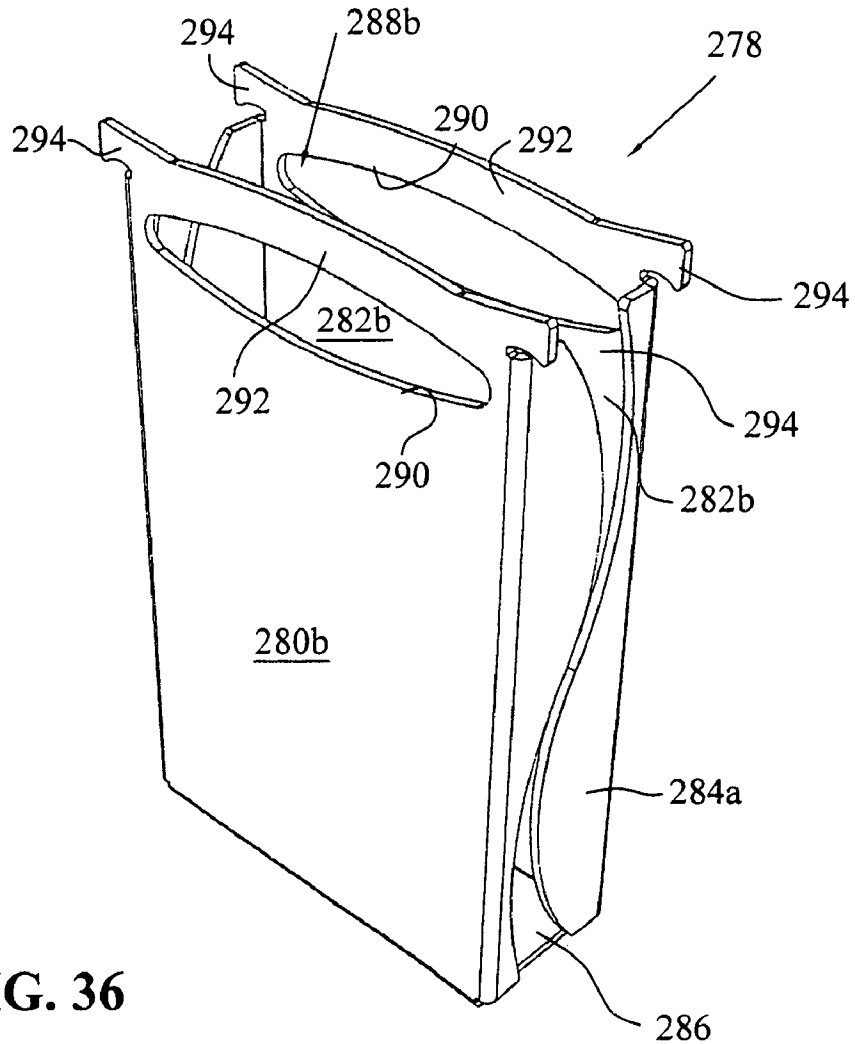
FIG. 36, is a perspective view of a vertical file pocket.

Referring to FIGS. 35 and 36, portable storage components, namely horizontal file pocket 276 and vertical file pocket 278 according to a first embodiment, are shown, which each body portions defined by front wall 280*a*, 280*b* rear wall 282*a*, 282*b*, side walls 284*a*, 284*b*, and bottom walls 286 defining storage spaces 288*a*, 288*b*, respectively. Storage spaces 288*a*, 288*b* may be used to hold papers or office supplies, for example. Front and rear walls 280*a*, 280*b* include apertures 290 therein defining handles 292, and also include hooks 294 at the opposite upper ends thereof.

Figure 37:
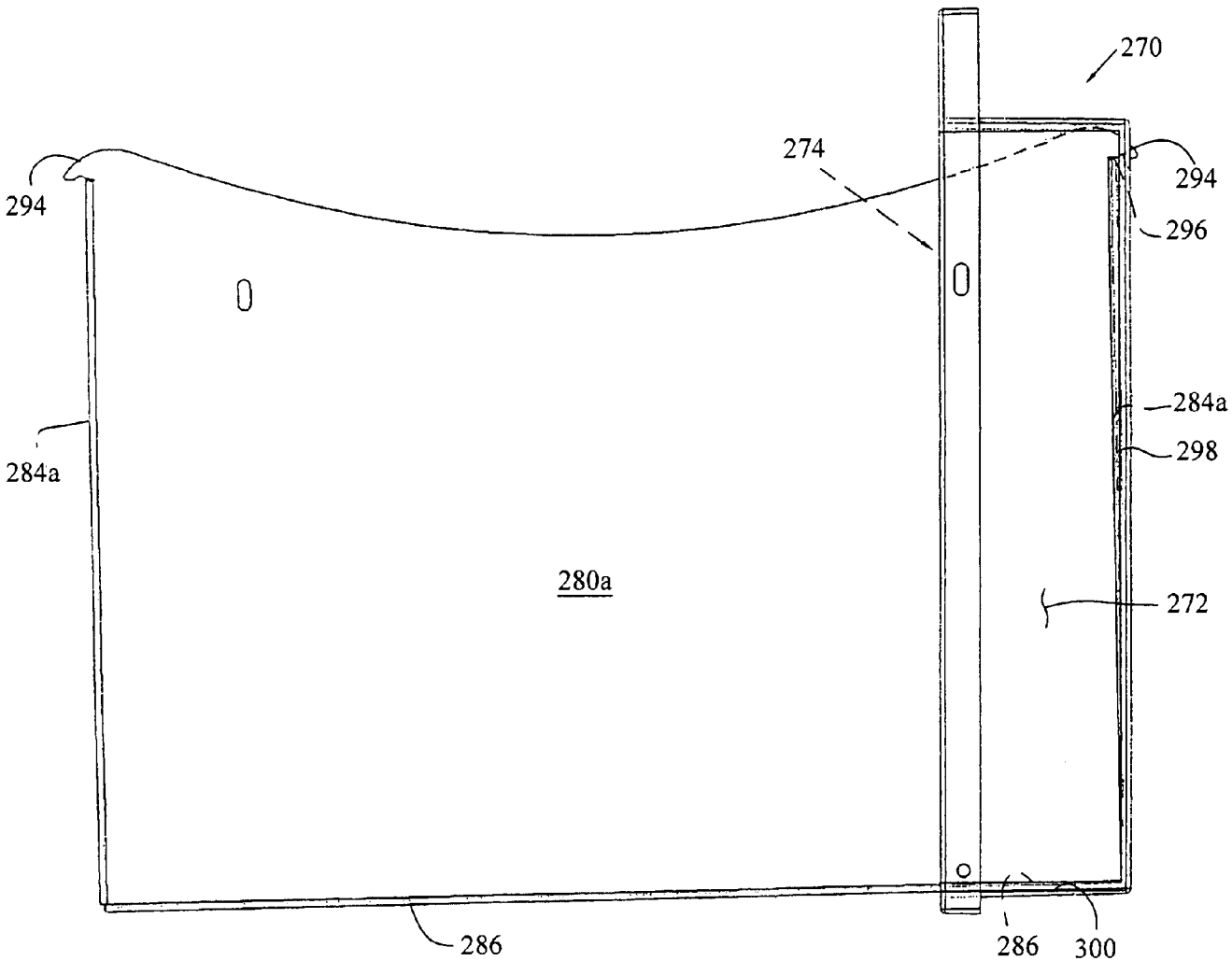
FIG. 37 is an end view of the storage tile of FIG. 34, showing a horizontal file pocket mounted therein.
Figure 38:
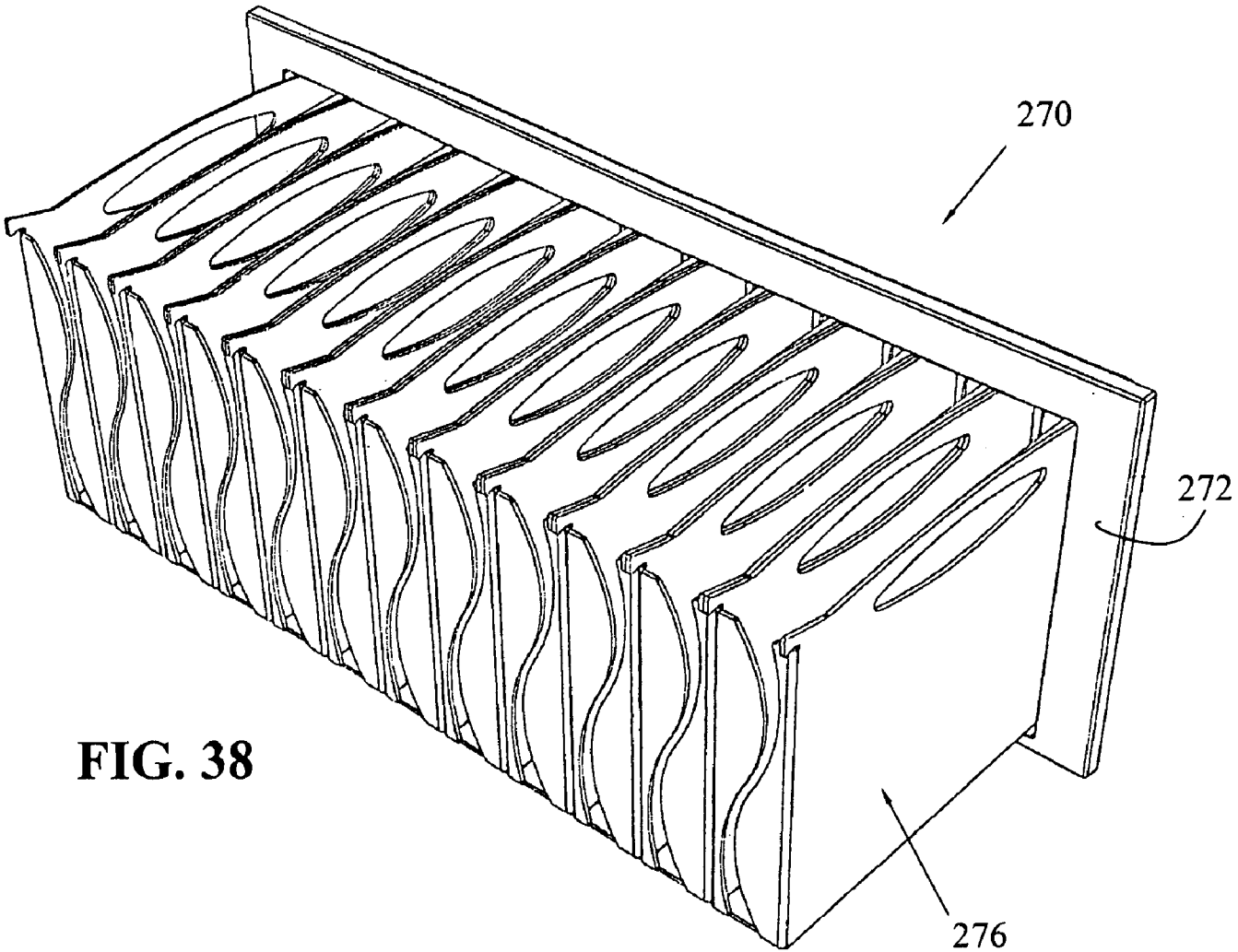
FIG. 38 is a perspective view of the storage tile of FIG. 34, showing a plurality of horizontal file pockets mounted therein.
Figure 39:
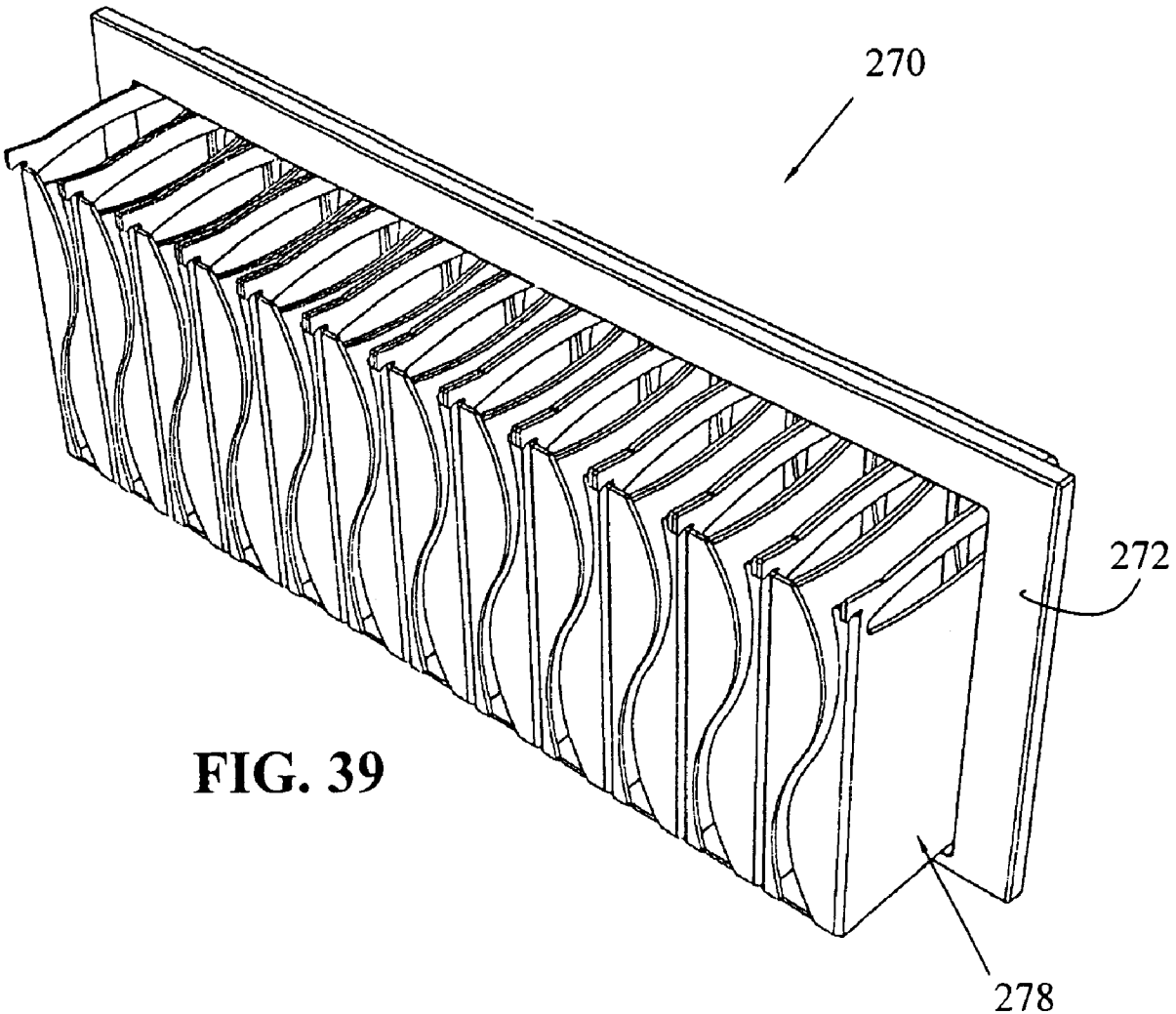
FIG. 39 is a perspective view of the storage tile of FIG. 34, showing a plurality of vertical file pockets mounted therein.

As shown in FIG. 37, horizontal and vertical file pockets 276 and 278 may be mounted within storage tile 270 by engaging hooks 294 thereof within apertures 296 in rear wall 298 of tile body portion 272 of storage tile 270, wherein bottom walls 286 of horizontal and vertical file pockets 276 and 278 rest against bottom wall 300 of tile body portion 272 of storage tile 270. In FIG. 38, a horizontal series of horizontal file pockets 276 are shown mounted within storage tile 270, and in FIG. 39, a horizontal series of vertical file pockets 278 are shown mounted within storage tile 270.

Figure 43A:
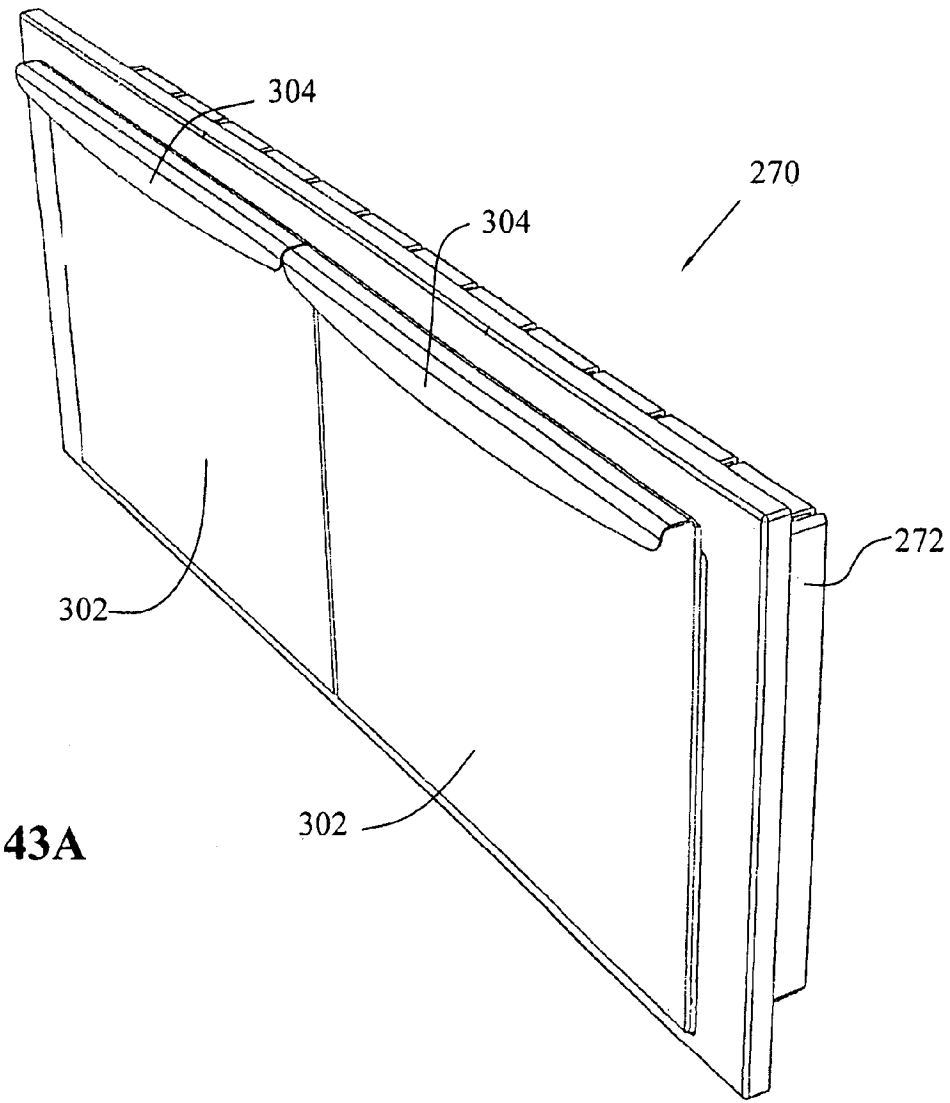
FIG. 43*a* is a perspective view of a storage tile, showing a pair of retractable storage bins pivotally mounted therein.
Figure 43B:
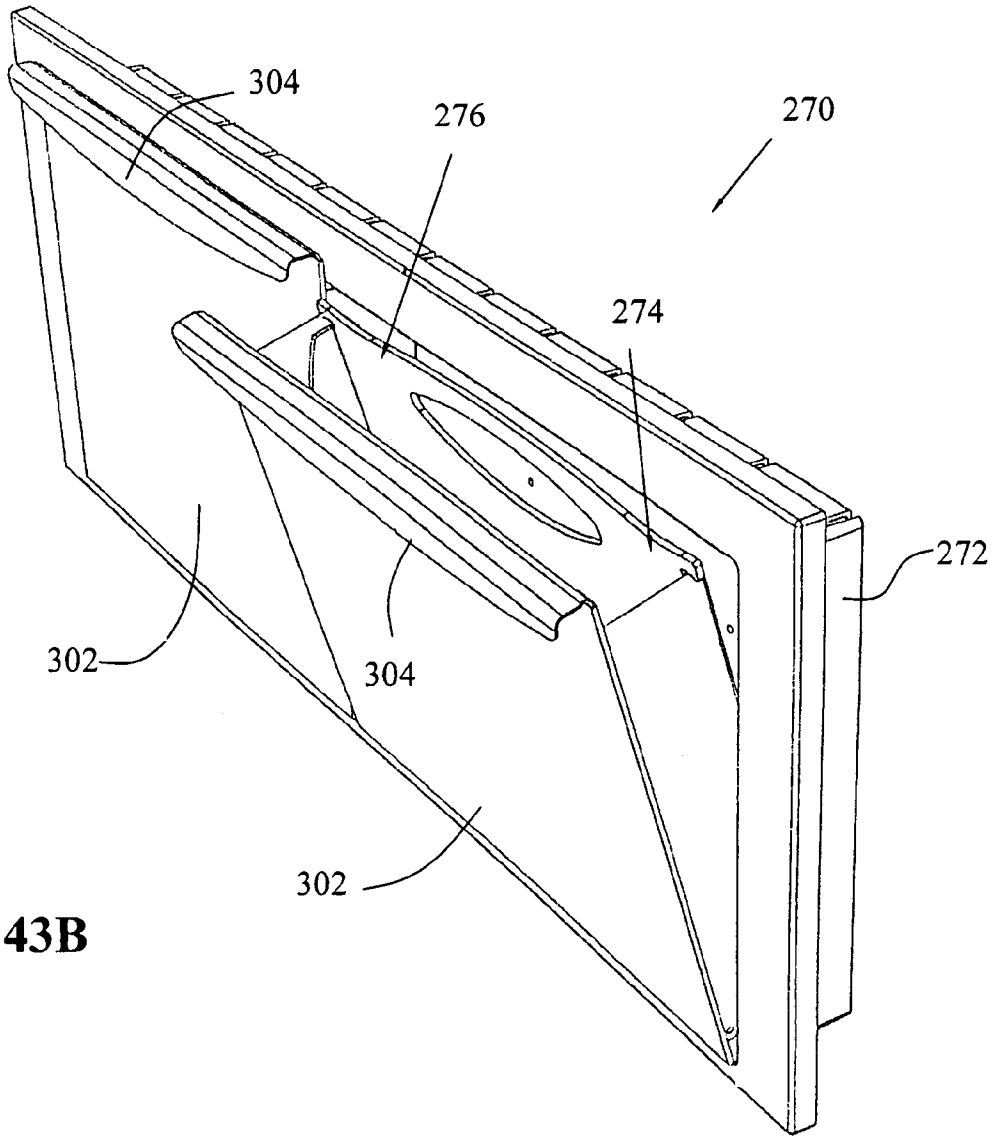
FIG. 43*b* is a perspective view of the storage tile and storage bins of FIG. 43*a*, showing one of the storage bins in an open position, and a file pocket received within the storage bin.

In FIGS. 43*a* and 43*b*, storage tile 270 includes a pair of retractable storage bins 302. Referring to FIG. 43*b*, retractable storage bins 302 are pivotally mounted within storage tile 270 such that same may be selectively moved between a retracted storage position in which storage bins 302 are disposed substantially within cavity 274 of tile body 272, and an extended access position in which at least the upper portions of storage bins 302 are pivoted outwardly of cavity 274 of tile body 272 to expose same for access. Retractable storage bins 302 may be sized to hold horizontal and/or vertical pockets 276 and 278 therein, as shown in FIG. 43*b*. As shown in FIGS. 43*a* and 43*b*, storage bins 302 additionally include handles 304 attached to the upper edges thereof, which may be grasped by a user to move same between the retracted storage position and the extended access position. Retractable storage bins 302 may accommodate papers or other office supplies.

Figure 43C:
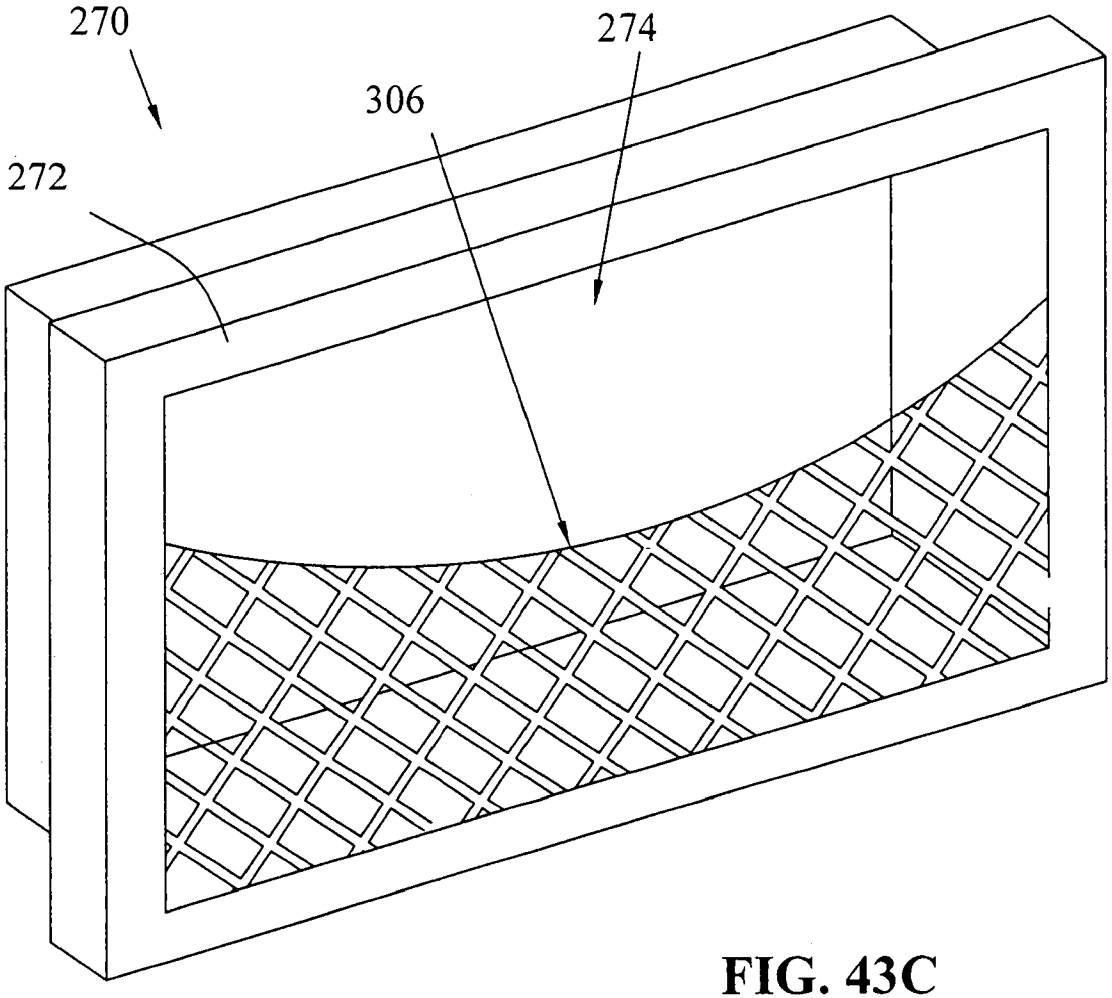
FIG. 43*c* is a perspective view of a storage tile having a net enclosure.

In FIG. 43*c*, storage tile 270 may include net enclosure 306 attached to tile body portion 272, which extends across the front face of cavity 274 in tile body portion 272 to define a storage area therein. Net enclosure 306 is useful for storing odd-shaped or bulky items within storage tile 270, and may be made of a stretchable material to allow net enclosure 306 to stretch as needed to contain such items.

Figure 43D:
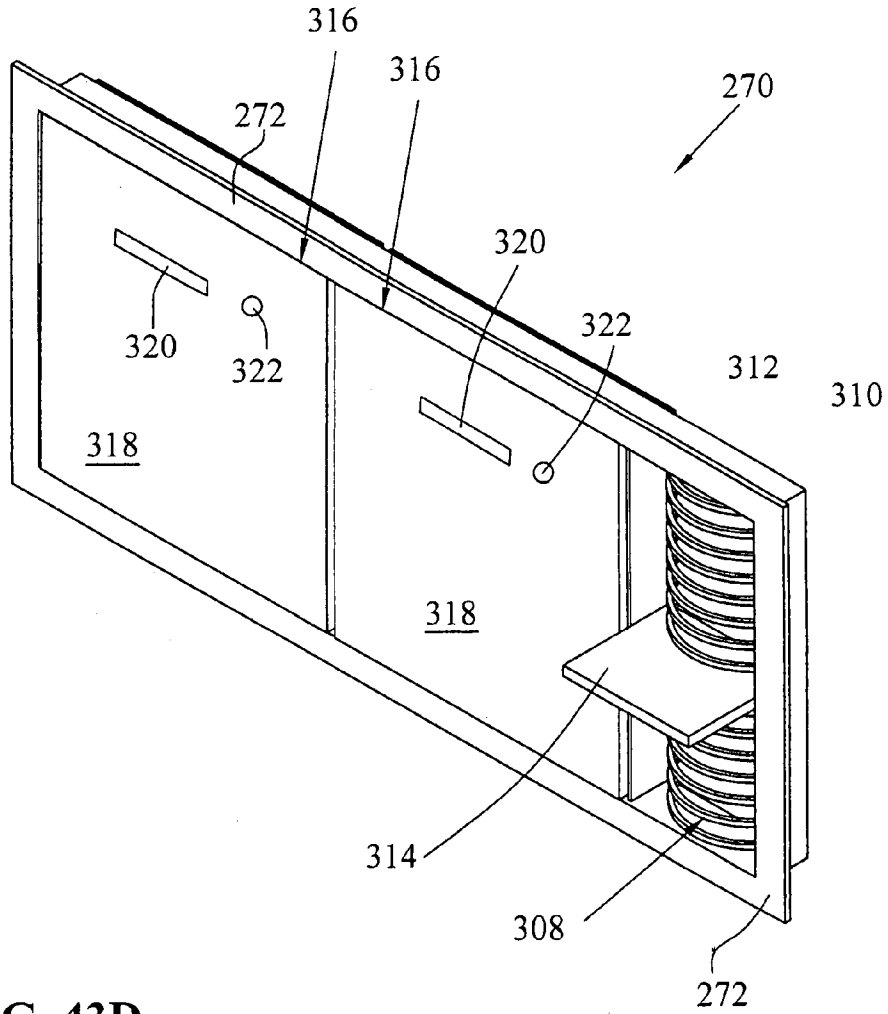
FIG. 43*d* is a perspective view of a storage tile, including a compact disk holder and a pair of paper files.
Figure 43E:
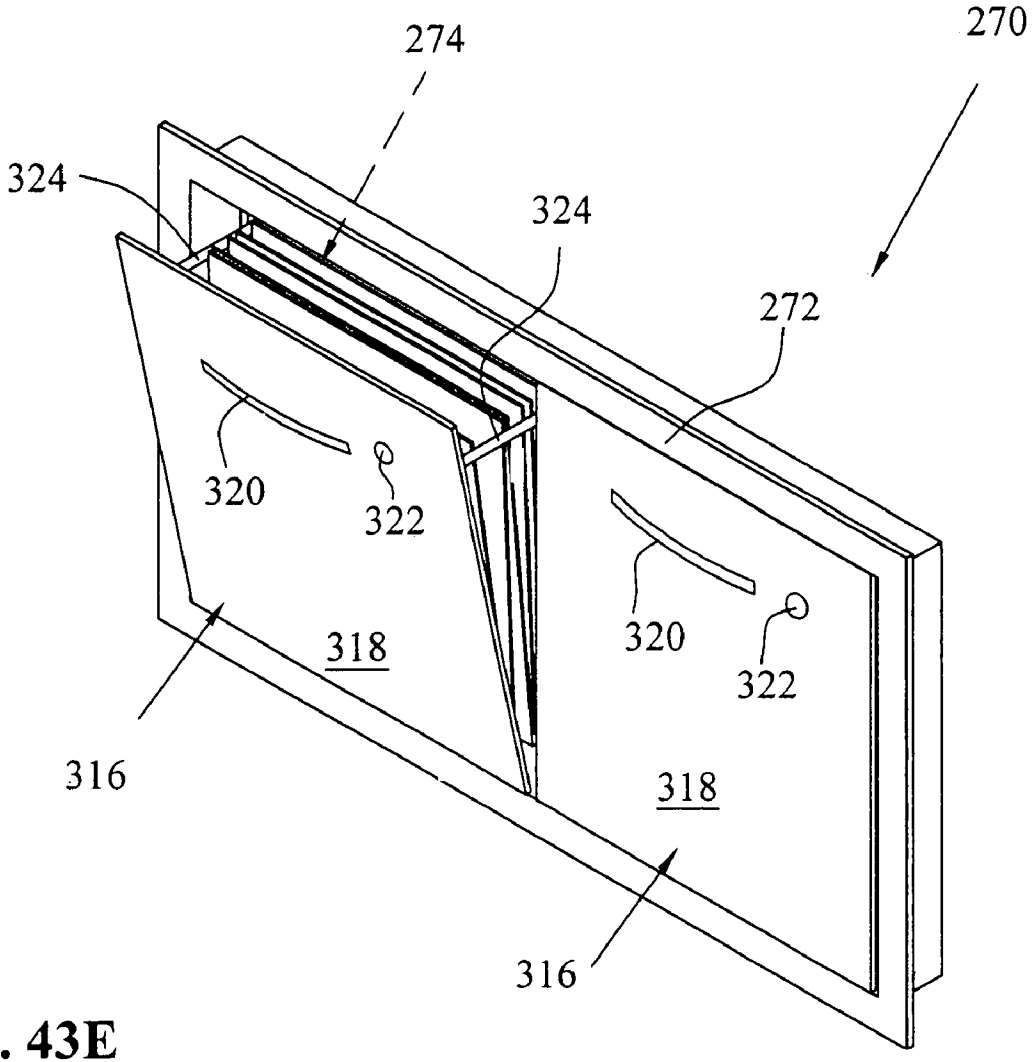
FIG. 43*e* is a perspective view of a storage tile including a pair of paper files, one of the paper files shown in an open position.

Referring to FIG. 43*d*, storage tile 270 may additionally include compact disk (CD) holder 308, which includes an arch-shaped body 310 having a series of arch-shaped slots 312 therein which are dimensioned to receive compact disks 314 in a horizontal orientation for storage, as shown in FIG. 43*d*. Additionally, as shown in FIGS. 43*d* and 43*e*, storage tile 270 may include retractable paper files 316 pivotally mounted to tile body portion 272 at the lower edges thereof, which generally include front plate 318 having handle 320 mounted thereto and optionally, a key-actuated lock 322. Front plate 318 may be attached to rails 324, shown in FIG. 43*e*, to enable hanging-type file folders to be hung therefrom for storage within cavity 274 of tile body portion 272.

Figure 40:
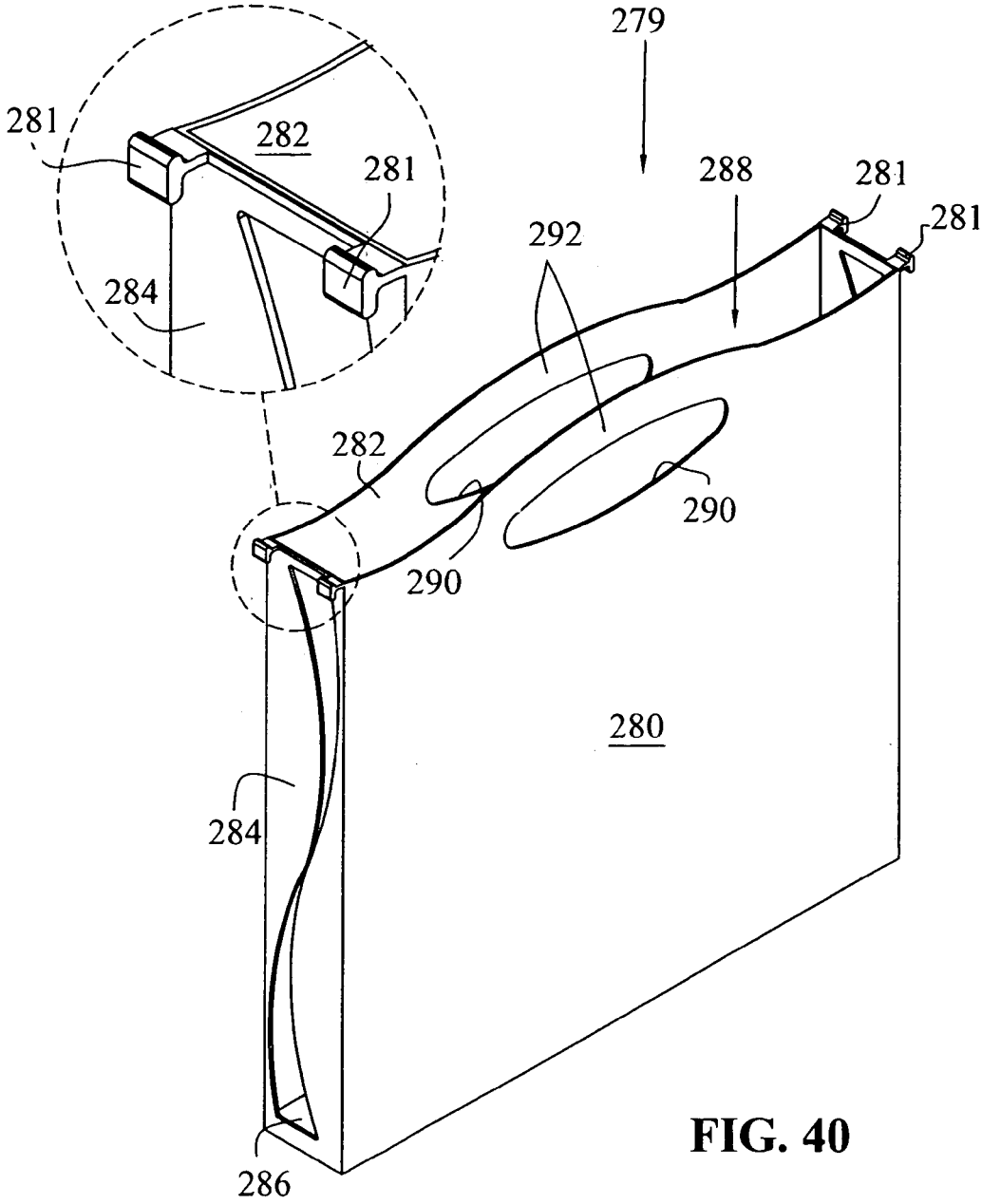
FIG. 40 is a perspective view of an alternative file pocket.

Referring to FIG. 40, another portable storage component, namely file pocket 279 according to a second embodiment, is shown. Many features of file pocket 279 which are identical to those of file pockets 276, 278 are denoted with identical reference numerals. File pocket 279 includes modified hooks 281, which are adapted to engage within track members 146, as shown in FIG. 42.

Figure 42:
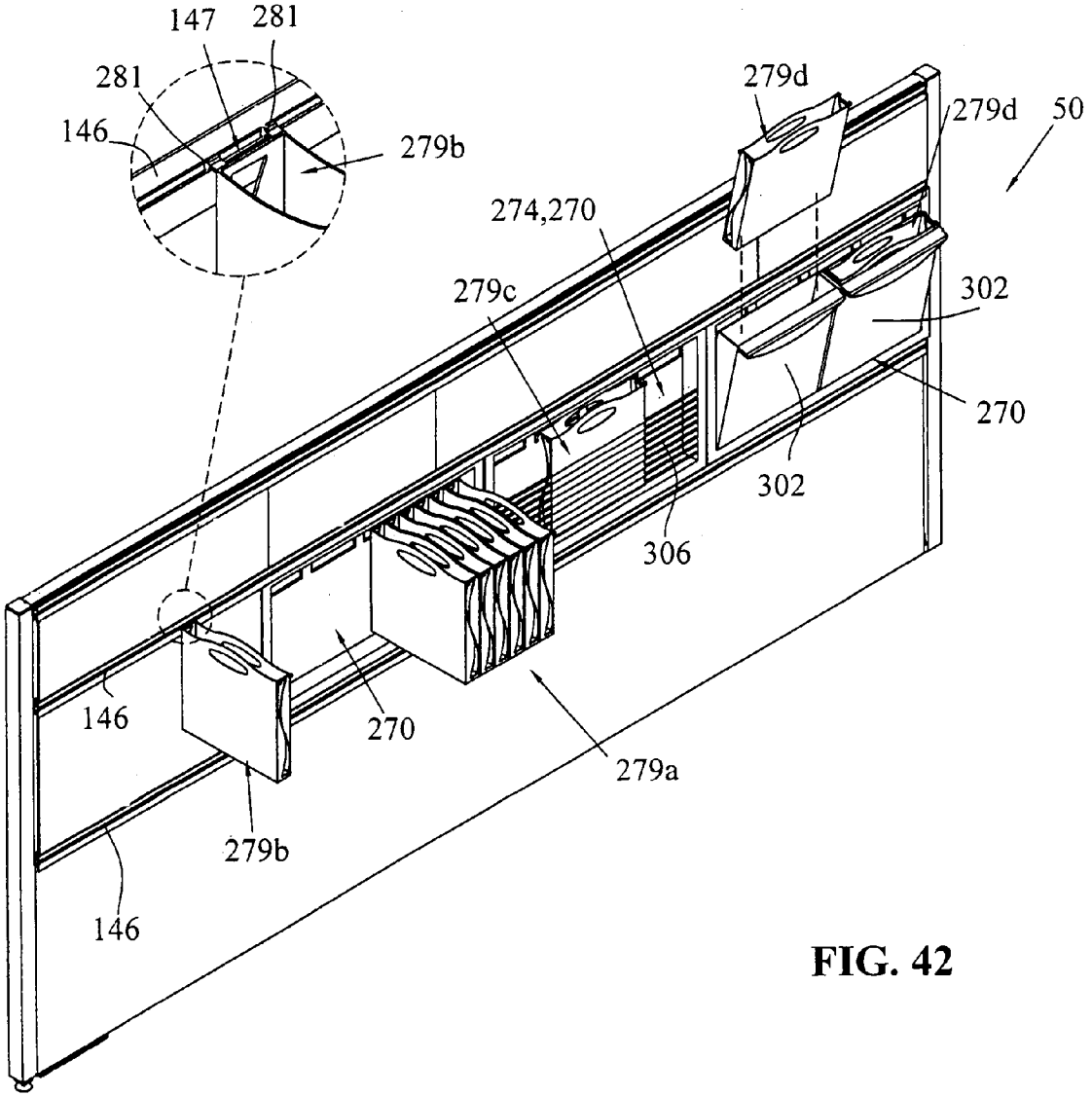
FIG. 42 is a perspective view of a portion of a partition system, illustrating various modes of attachment of file pockets thereto.

As shown in FIG. 42, file pockets 279 may be attached to partition system 50 in a variety of different locations. For example, a number of first horizontal file pockets 279*a* are shown mounted within storage tile 270, as described above with respect to FIG. 37. A second horizontal file pocket 279*b* is shown with hooks 281 thereof engaged within channel 147 of track member 146. Thus, in this manner, file pockets 279 may be attached to track members 146 anywhere within partition system 50. A third horizontal file pocket 279*c* is shown mounted within cavity 274 of storage tile 270, and is retained therein by net enclosure 306. A fourth horizontal file pocket 279*d* is held within retractable storage bin 302 of another storage tile 270, in the manner shown in FIG. 43*b* above.

Figure 41:
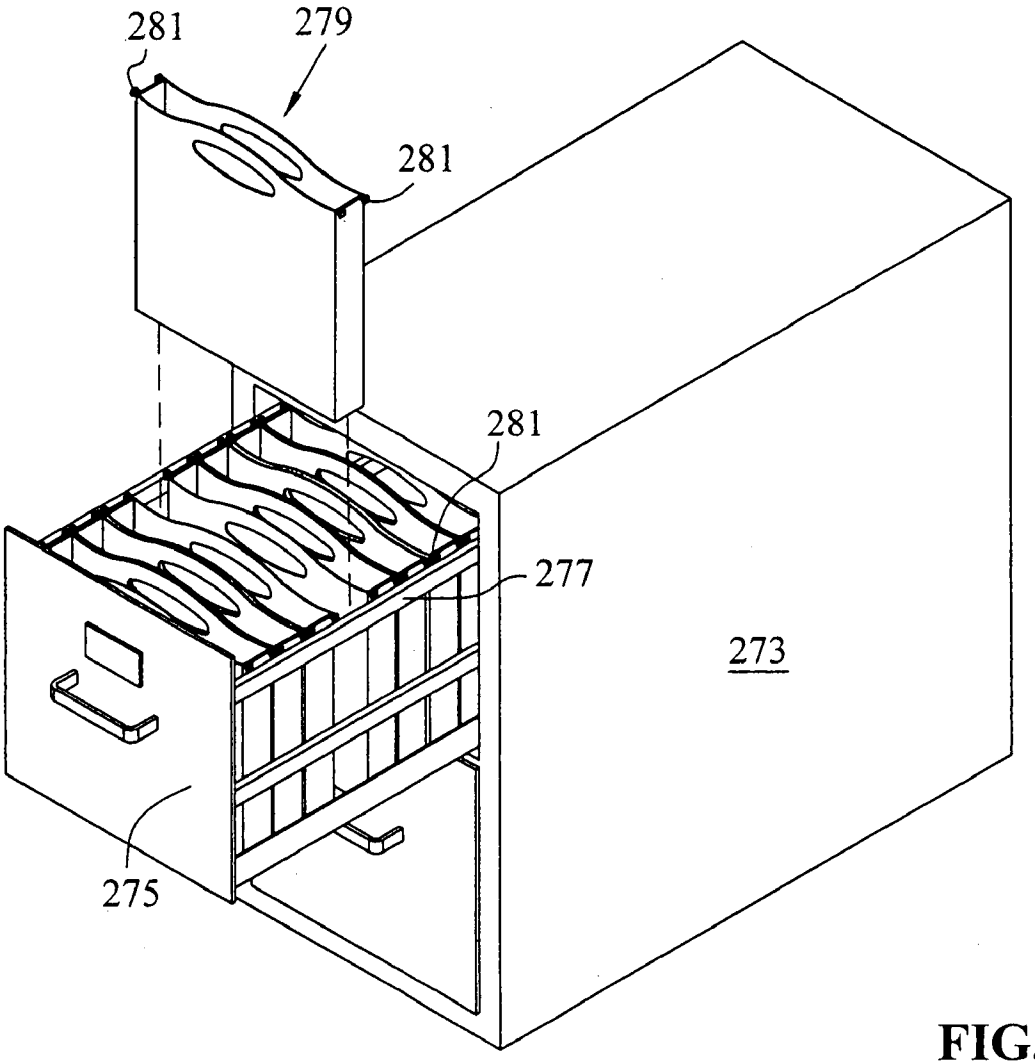
FIG. 41 is a perspective view of a file cabinet, showing insertion of the file pocket of FIG. 40 thereinto.

Referring to FIG. 41, it may be seen that file pockets 279 are sized for receipt within a standard sized drawer 275 of a file cabinet 273, with hooks 281 of file pocket 279 engaging rails 277 within drawer 275 to hang file pocket 276 within drawer 275. Typically, in a standard sized filing cabinet, the width between rails 277 is nominally about 310 millimeters; however, the foregoing width may vary from about 305 millimeters to about 315 millimeters, for example. Therefore, file pockets 279 may advantageously be used for storage within drawers 275 of file cabinet 273, may be attached or mounted to partition system 50 in any of the ways described above and shown in FIG. 42, or further, may be selectively moved between storage in drawers 275 of file cabinet 273 and attachment to partition system 50 as desired.

Figure 44:
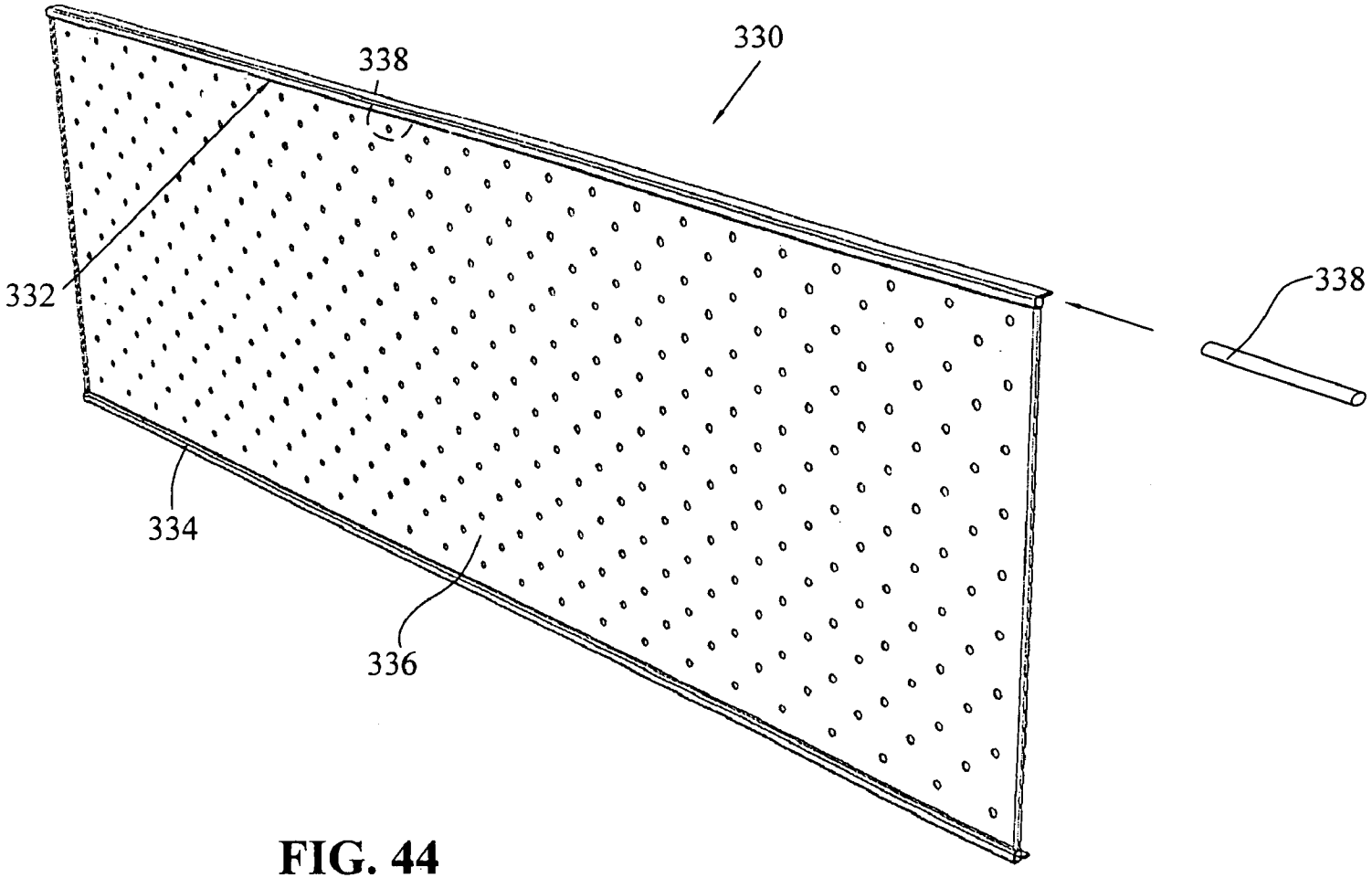
FIG. 44 is a perspective view of a media tile.

In FIG. 44, media tile 330 is shown, which includes upper and lower edges 332, 334 and central plate 336. Upper edge 332 of media tile 330 includes a resilient beading 338 therein, such that papers, pictures, or other flat materials may be inserted upwardly between beading 338 and central plate 336 to capture same therebetween for attachment to media tile 330 for display. Additionally, central plate 336 may be made of a suitable metal, such that magnets (not shown) may be used to attach paper, pictures, or other such materials to central plate 336.

Figure 45A:
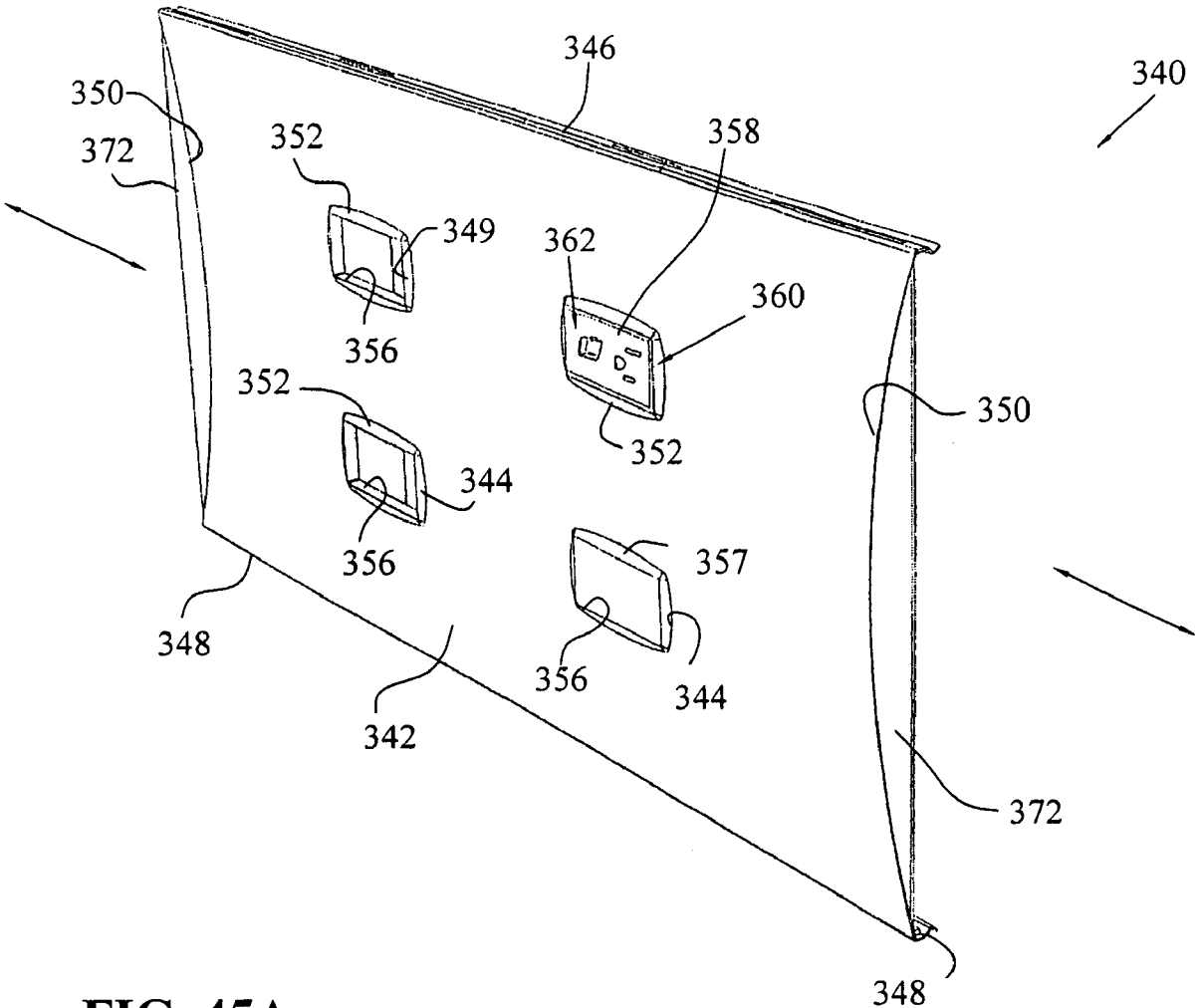
FIG. 45*a* is a front perspective view of an electrical tile.
Figure 45B:
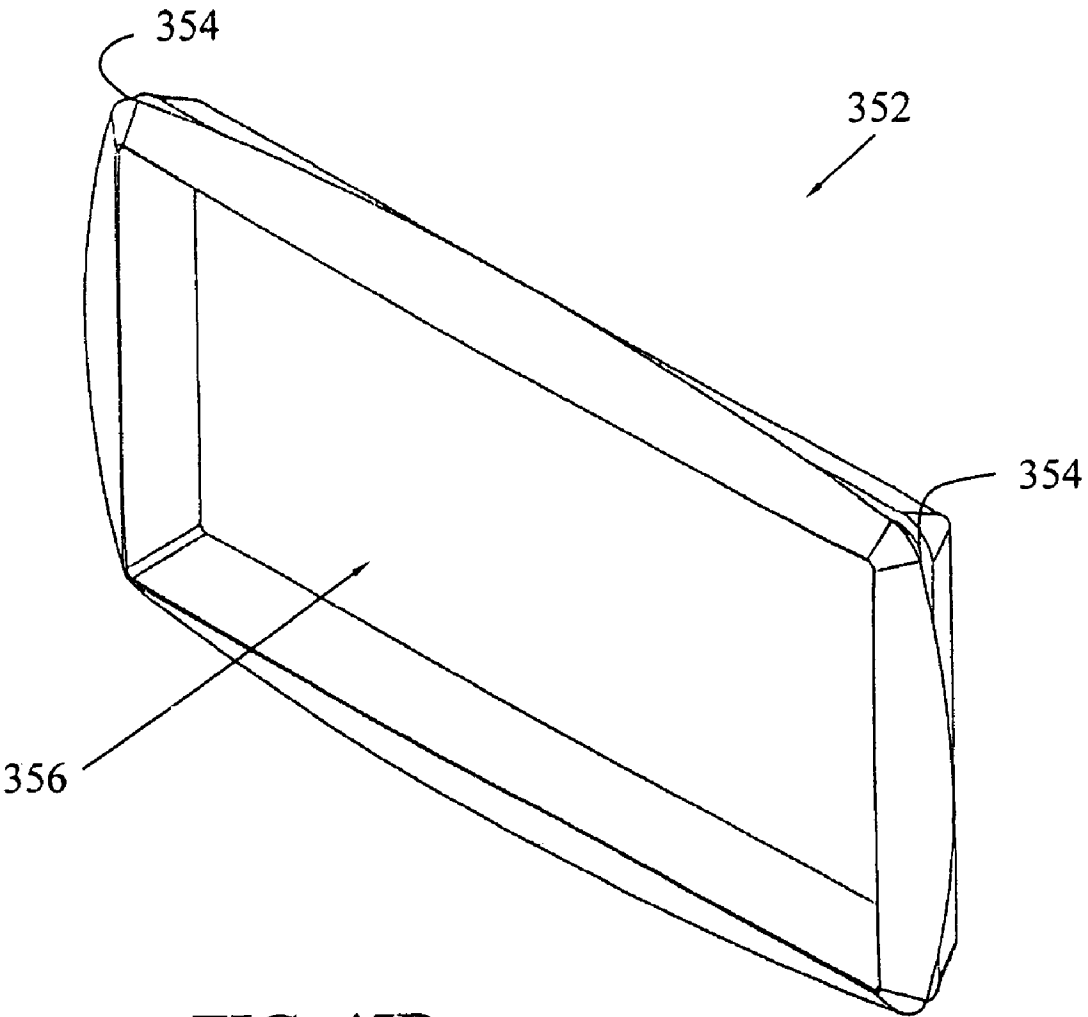
FIG. 45*b* is a perspective view of an outlet module trim element.

Referring to FIGS. 45*a*–45*d*, electrical tile 340 is shown, which may be used to provide electrical and/or data services to any selected vertical location within framework 52 of partition system 50. Electrical tile 340 generally includes front face 342 having one or more outlet module apertures 344 therein, as well as upper edge 346 and lower edge 348, and inwardly-curved side edges 350. Outlet module apertures 344 receive trim elements 352 therein, which are shown in FIG. 45*b*, and which may be made of a resilient material to enable same to be press-fitted within outlet module apertures 344, such that the rim of front face 342 of electrical tile 340 around outlet module apertures 344 is captured within groove 354 of trim elements 352. Trim elements 352 define central openings 356 therein for receipt of outlet modules 358 which, as shown in FIG. 46, may include electrical receptacles 360 and/or data ports 362.

Figure 45C:
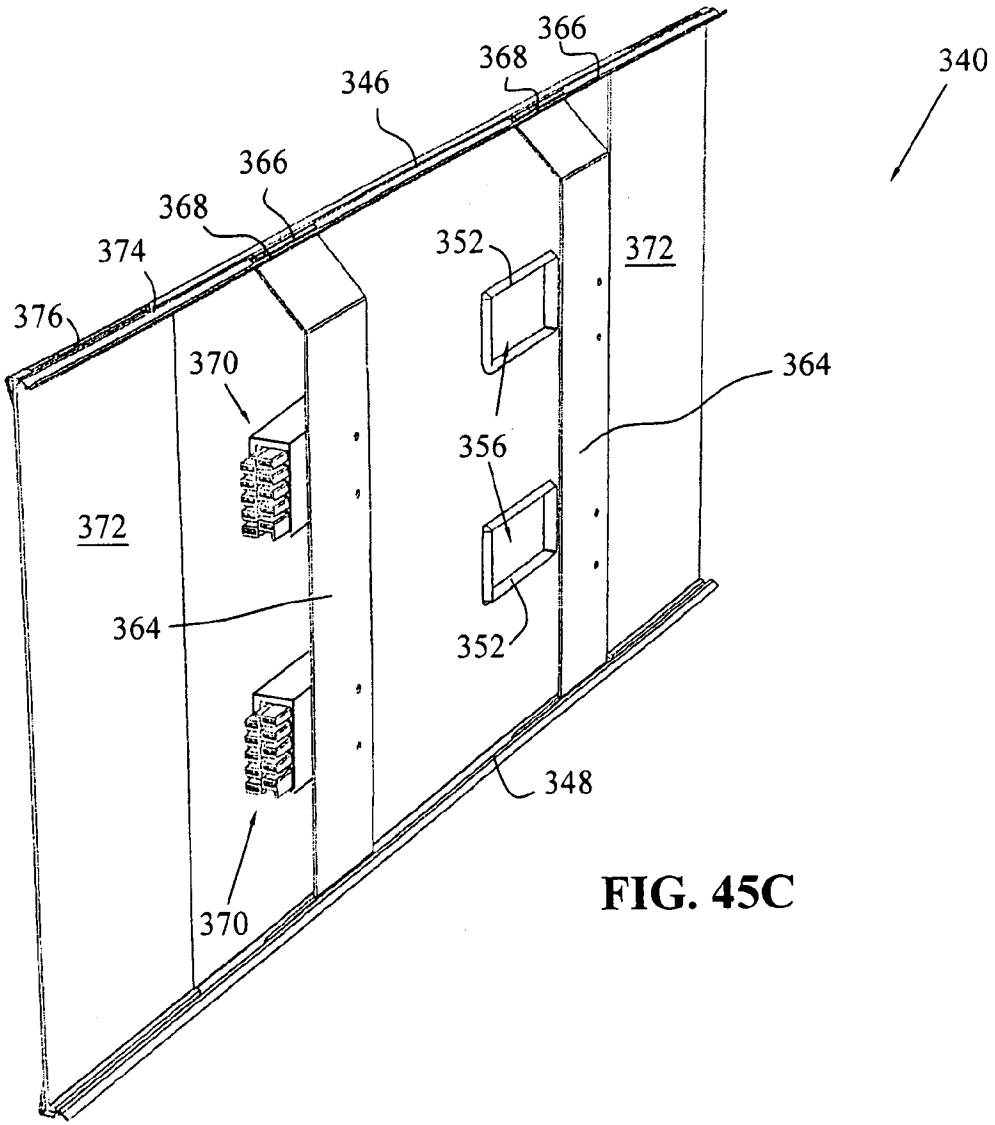
FIG. 45*c* is a rear perspective view of the electrical tile of FIG. 46.
Figure 45D:
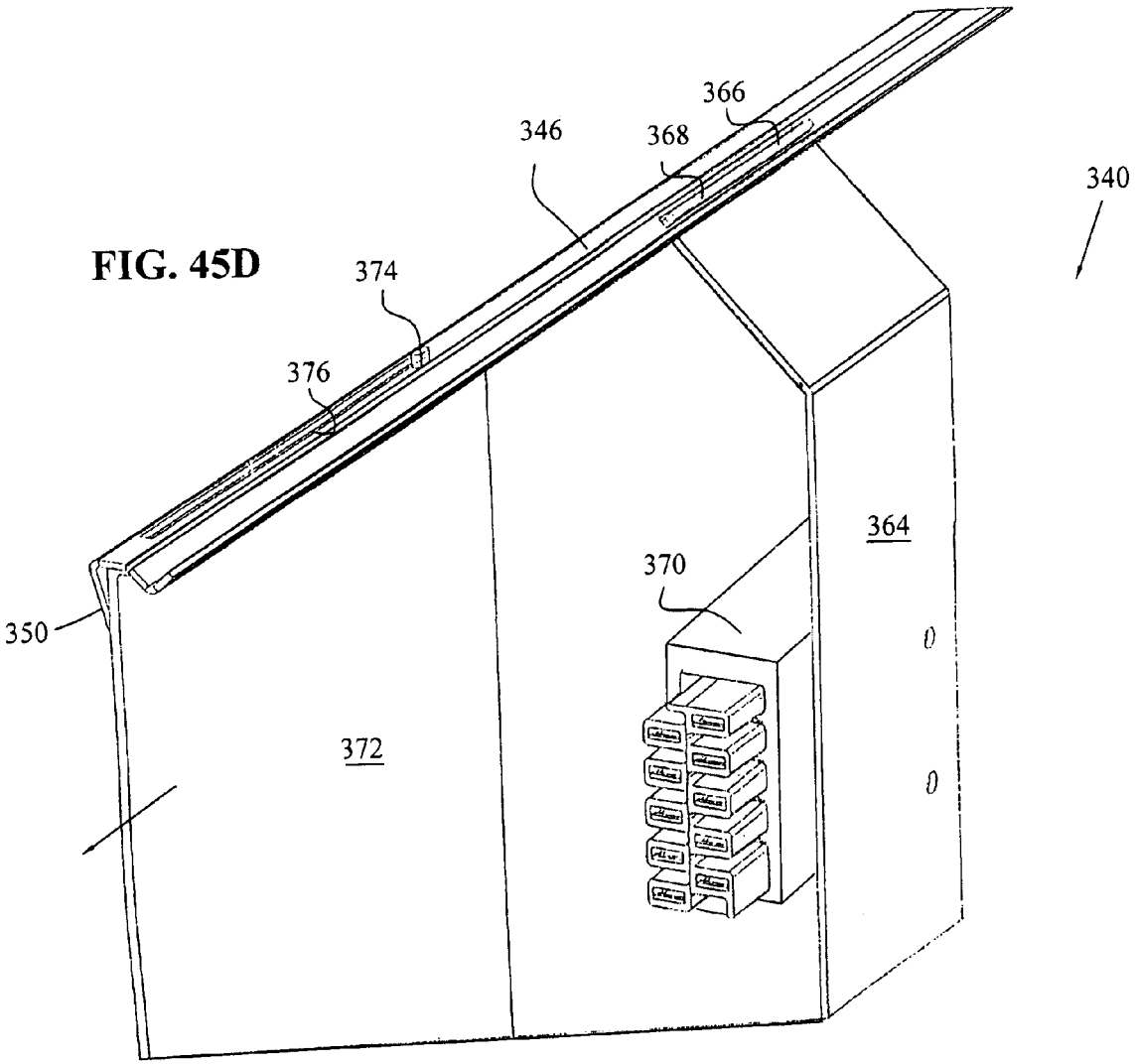
FIG. 45*d* is a rear perspective view of a portion of FIG. 48.

Referring to FIGS. 45*c* and 45*d*, outlet module brackets 364 include tongues 366 at the opposite ends thereof which are received within slots 368 in upper and lower edges 346, 348 of electrical tile 340, respectively, to attach electrical outlet brackets 364 thereto. Outlet modules 358 are in turn connected to outlet module brackets 364 by suitable fasteners, for example, and outlet modules 358 extend through central openings 356 in trim elements 352, and jumper connection ports 370 thereof are exposed behind electrical tile 340 for connection to jumpers (not shown) which are used to connect outlet modules 358 to suitable components of the electrical and/or data system within framework 52, such as harness assemblies 122 (FIG. 12).

Additionally, referring to FIGS. 45*a*, 45*c* and 45*d*, side panels 372 are captured between upper and lower edges 346, 348 of electrical tile 340, and may be slidably extended outwardly of electrical tile 340 to increase the effective width of electrical tile 340 as needed when electrical tile 340 is mounted to framework 52 of partition system 50. Side panels 372 include lugs 374, shown in FIG. 45*d*, which are received within slots 376 in upper and lower edges 346, 348 of electrical tile 340 to limit the travel of side panels 372 between the extreme retracted and extended positions of side panels 372.

Figure 46A:
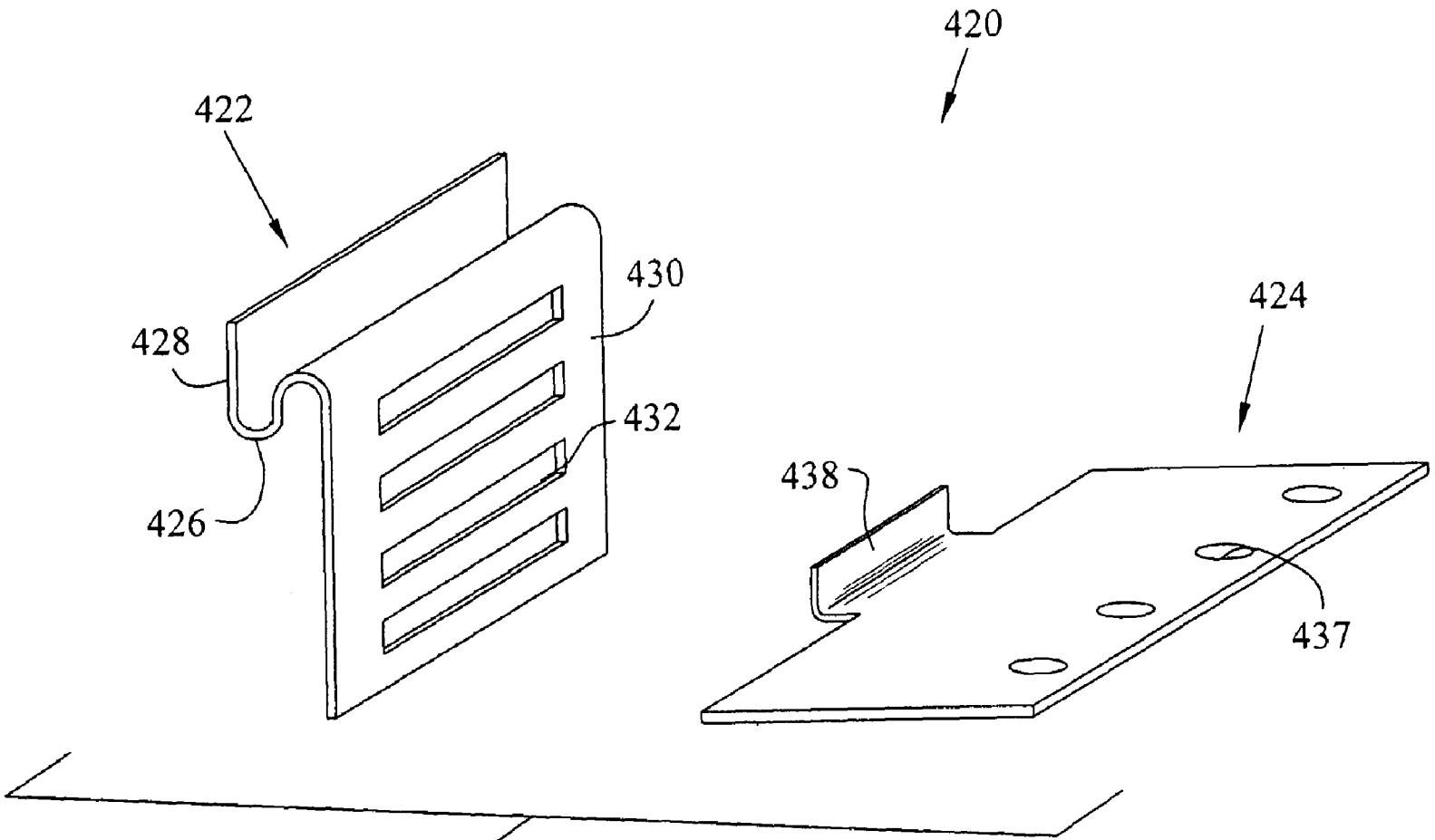
FIG. 46*a* is perspective view of a two-piece work surface support bracket, including a vertical member and a horizontal member.
Figure 46B:
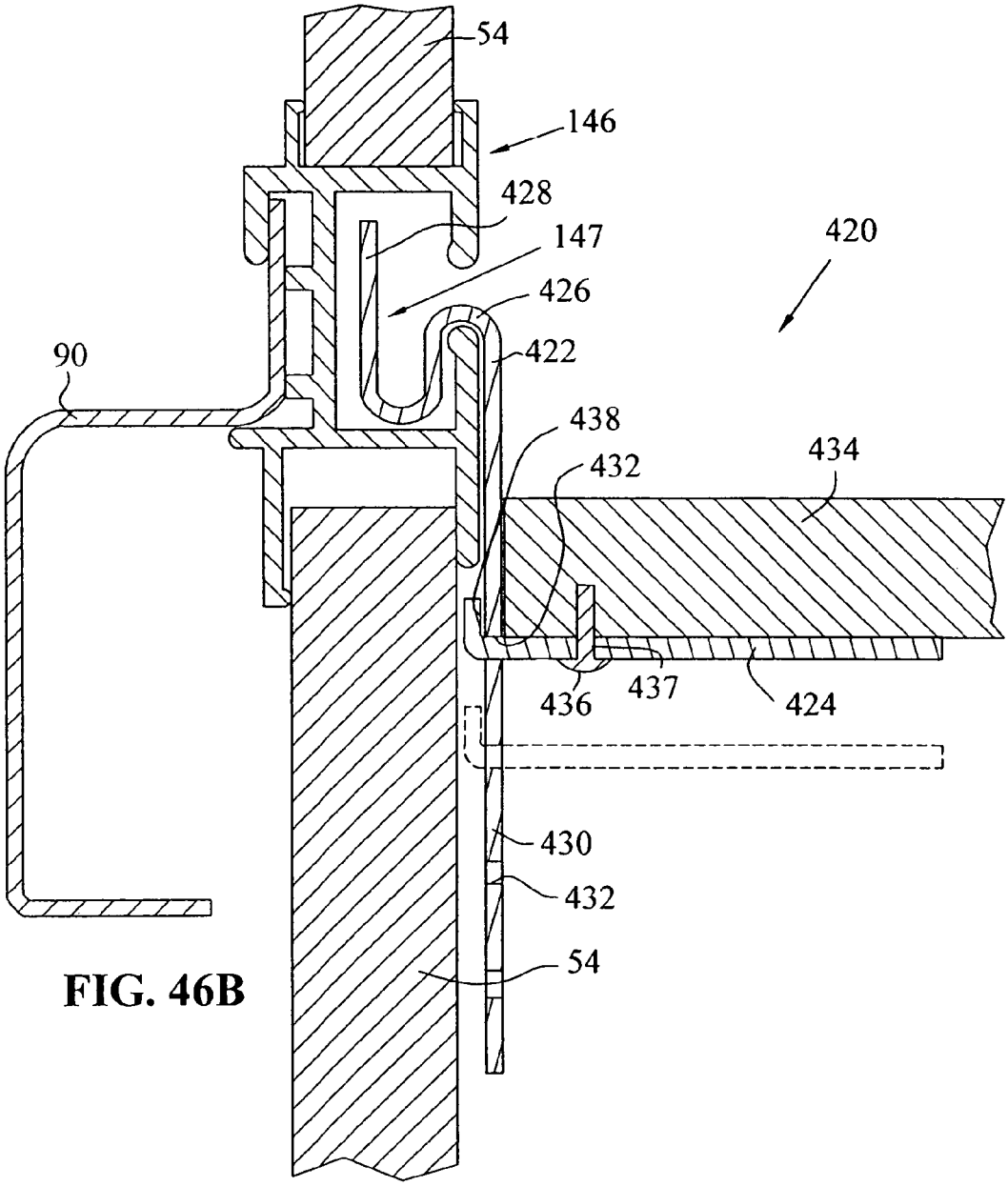
FIG. 46*b* is a sectional view through a portion of the partition system, showing the work surface support bracket of FIG. 46*a* mounted within a track member of the partition system to adjustably support a work surface.

Referring to FIGS. 46*a* and 46*b*, an adjustable work surface bracket 420 is shown, including vertical member 422 and horizontal member 424. Vertical member 422 includes mounting structure for receipt within channel 147 of a track member 146 of partition system 50, including hanger portion 426 which hangs over lower front wall 158 of track member 146, and disengagement portion 428 which projects vertically within channel 147 of track member 146 to prevent disengagement of vertical member 422 from channel 147 of track member 146. Vertical member 422 additionally includes plate portion 430 having a plurality of vertically spaced slots 432. Horizontal member 424 is attached to the underside of a work surface 434 by suitable fasteners, such as screws 436 inserted through holes 437 in horizontal member 424. Horizontal member 424 also includes a vertical tab 438 which may be received within any of the several slots 432 of vertical member 422. In this manner, by varying the connection between tab 438 of horizontal member 424 and any one of slots 432 of vertical member 422, work surface 434 may be adjustably mounted to any track member 146 of partition system 50.

Figure 47A:
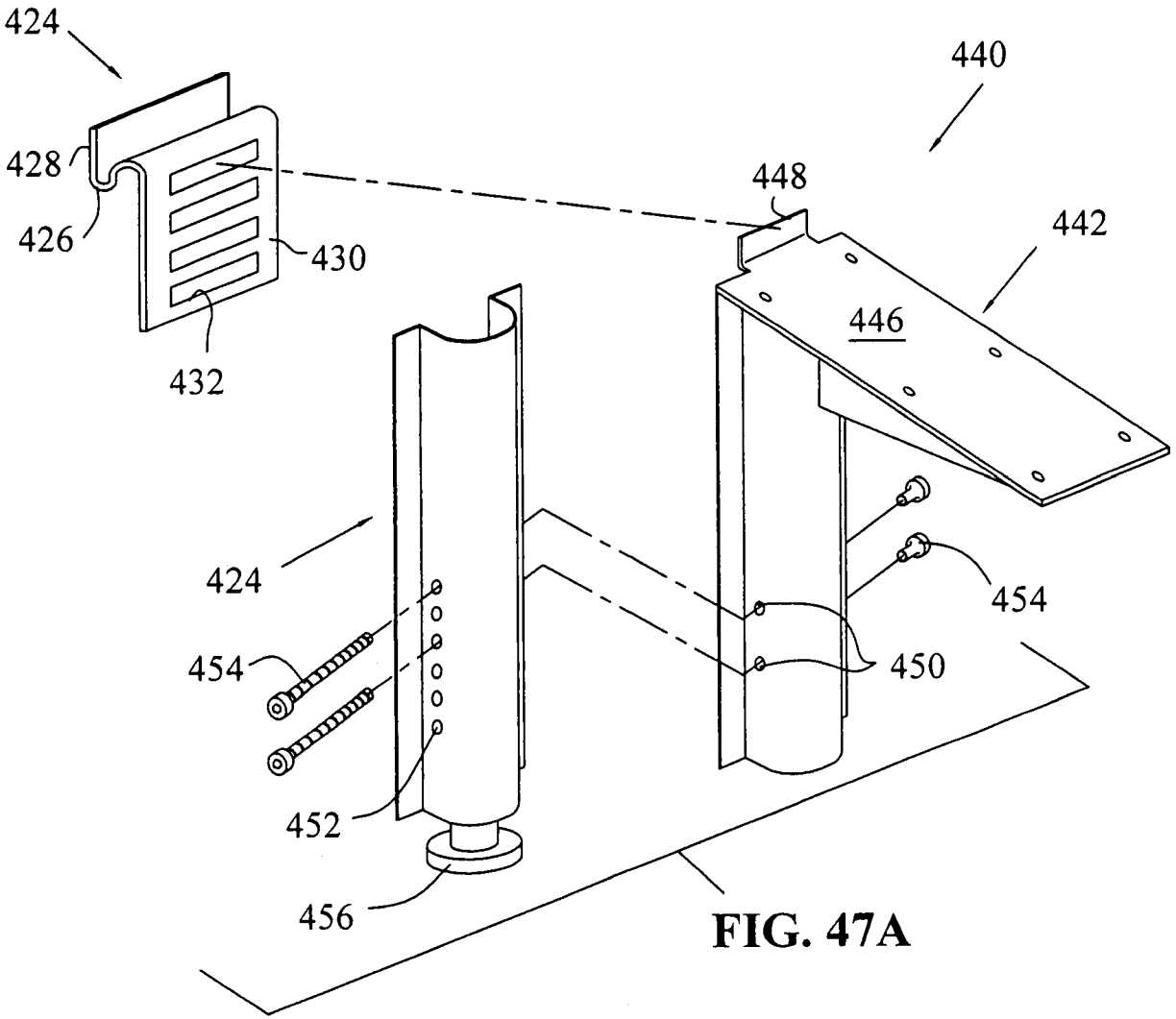
FIG. 47*a* is a perspective view of a work surface support post, including a cantilever portion and a support portion.
Figure 47B:
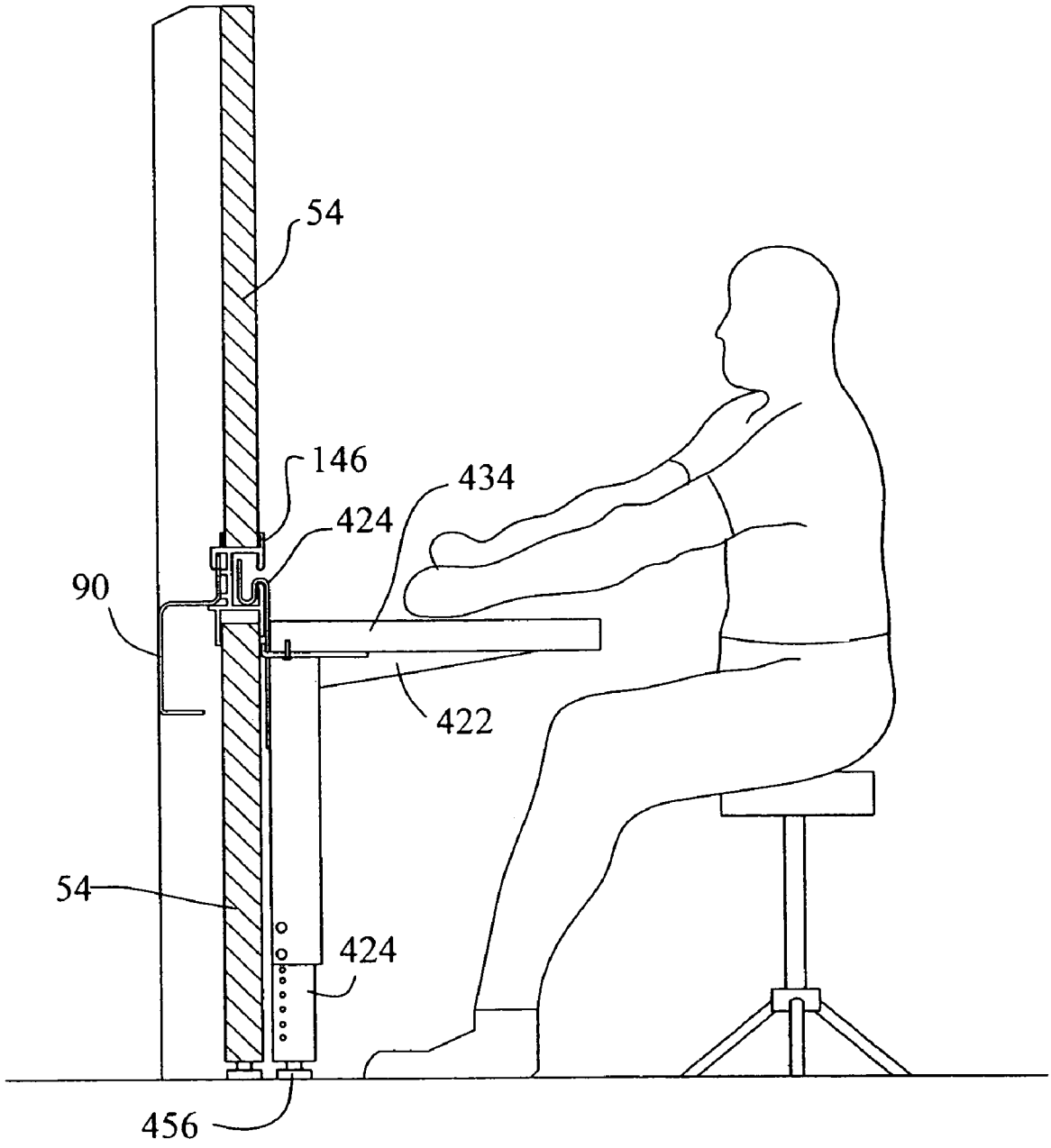
FIG. 47*b* is a sectional view through a portion of the partition system, showing the work surface support post of FIG. 47*a* mounted within a track member of the partition system to adjustably support a work surface.

Referring to FIGS. 47*a* and 47*b*, work surface support post 440 includes cantilever portion 442 and support portion 444. Cantilever portion 442 includes planer surface 446 to which work surface 434 may be attached with fasteners 436, such as screws, and also includes vertical tab 448 for connection with any one of slots 432 of vertical member 424 of bracket 420. Thus, vertical member 422 is used in common with work surface bracket 420 and support post 440. Cantilever portion 442 includes a plurality of vertically spaced holes 450 therein. Support portion 444 nests within cantilever portion 442, and also includes a plurality of vertically spaced holes 452 which may be selectively aligned with holes 450 of cantilever portion 442. Suitable fasteners 454 are used to attach cantilever portion 442 to support portion 444 in a vertically adjustable manner using the foregoing holes 450 and 452. Support portion 444 includes an adjustable glide 456 which engages a floor surface. Referring to FIG. 47*b*, it may be seen that when work surface 434 is mounted to a track member 146 of partition system 50 in the manner described above, support post 440 supports at least a portion of the load of work surface 434. Also, as shown in FIG. 47*b*, the relatively thin profiles of cantilever portion 442 and support portion 444 provide knee space beneath work surface 434 for a user seated at work surface 434.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A workspace partition system, comprising:

a framework including at least two adjacent frame elements, each said frame element comprising:

a vertical upright having upper and lower ends; and at least one sub-frame member secured to at least one of said upper end and said lower end of each of said vertical uprights and extending horizontally therefrom;

at least one horizontal spanner adjustably connected at opposite ends thereof to adjacent sub-frame members of said adjacent frame elements, each of said sub-frame members and said spanners including a plurality of discrete, horizontally-aligned, pre-formed openings therein;

a plurality of fasteners extending through selected pairs of said openings to adjustably connect said sub-frame members and said spanners, whereby the distance between said vertical uprights of said adjacent frame elements may be varied;

at least two vertically spaced track members attached to said frame elements, said track members extending horizontally along said framework, each track member including tile-retaining structure, at least one of said track members including a channel which opens outwardly of said framework; and at least one tile retained between a pair of said vertically spaced track members by said tile-retaining structures thereof, said channel not covered by said at least one tile.

2. The partition system of claim 1, wherein said at least one tile is selectively locatable at one of a plurality of variable horizontally spaced locations along said track members irrespective of the positioning of said frame elements.

3. The partition system of claim 1, wherein said at least one tile is disposed facewise adjacent said framework.

4. A workspace partition system, comprising:

a framework including at least two adjacent frame elements, each said frame element comprising:

a vertical upright having upper and lower ends; and at least one sub-frame member secured to at least one of said upper end and said lower end of each of said vertical uprights and extending horizontally therefrom;

at least one horizontal spanner adjustably connected at opposite ends thereof to adjacent sub-frame members of said adjacent frame elements, whereby the distance between said vertical uprights of said adjacent frame elements may be varied;

mid-channel members connected to said vertical uprights at one of a plurality of locations on said vertical uprights which are disposed intermediate said sub-frame members of said vertical uprights;

at least two vertically spaced track members attached to said frame elements, said track members extending horizontally alone said framework, each track member including tile-retaining structure, at least one of said track members including a channel which opens outwardly of said framework; and at least one tile retained between a pair of said vertically spaced track members by said tile-retaining structures thereof, said channel not covered by said at least one tile.

5. A partition system, comprising:

a framework including a plurality of vertical frame elements, said vertical frame elements connected by a plurality of horizontal frame elements;

at least two horizontal track members connected to said framework, said track members vertically spaced from one another and including tile-retaining structure, at least one of said track members extending horizontally beyond the distance between two adjacent vertical frame elements, and at least one of said track members including a channel which opens outwardly of said framework; and at least one tile slidably retained between said track members and disposed facewise adjacent said framework, said tile not covering said channel and being selectively locatable horizontally along said track members irrespective of the positioning of said frame elements.

6. A partition system, comprising:

a framework including a plurality of vertical frame elements, said vertical frame elements connected by a plurality of horizontal frame elements, said framework defining an interior space bounded by said vertical and horizontal frame elements;

at least two horizontal track members connected to said framework externally of said interior space, said track members vertically spaced from one another and including tile-retaining structure; and at least one tile slidably retained between said track members and disposed facewise adjacent said framework, said tile selectively locatable horizontally alone said track members irrespective of the positioning of said frame elements, wherein each said track member further includes a channel which opens outwardly of said framework, said channel not covered by said at least one tile.

7. A partition system, comprising:

a framework, including:

at least three frame elements disposed in a row, each frame element including a vertical upright to which is secured at least one sub-frame member which extends horizontally therefrom; and horizontal spanners connecting adjacent sub-frame members of adjacent frame elements to form a pair of adjacent framework sections which share one of said frame elements as a common frame element therebetween, each of said sub-frame members and said spanners including a plurality of discrete, horizontally-aligned, pre-formed openings therein;

a plurality of fasteners extending through selected pairs of said openings to adjustably connect said sub-frame members and said spanners, said framework sections defining an interior space bounded by said vertical uprights, sub-frame members, and spanners; and at least two track members connected to said framework externally of said interior space and extending horizontally therealong, said track members spaced vertically from one another and including tile-retaining structure, at least one of said track members including a channel which opens outwardly of said framework; and at least one tile retained between said track members externally of said interior space, said tile covering at least a portion of each of said framework sections and not covering said channel.

8. The partition system of claim 7, wherein said at least one tile spans both of said framework sections.

9. The partition system of claim 7, wherein said at least one tile is disposed facewise adjacent said framework, said tile selectively locatable at any one of a plurality of horizontally spaced locations along said track members irrespective of the positioning of said frame elements.

10. The partition system of claim 7, wherein said spanners are adjustable relative to said sub-frame members such that the width between adjacent vertical uprights of each of said framework sections may be selectively varied.

11. A workspace partition system, comprising:

a framework including at least two adjacent frame elements, each said frame element comprising:

a vertical upright having upper and lower ends;

at least one bracket attached to at least one of said upper and lower ends of each of said vertical uprights;

sub-frame members secured to respective ones of said brackets and extending horizontally therefrom; and at least one horizontal spanner adjustably connected at opposite ends thereof to adjacent sub-frame members of said adjacent frame elements, whereby the distance between said vertical uprights of said adjacent frame elements may be varied;

at least two vertically spaced track members attached to said frame elements, said track members extending horizontally along said framework, each track member including tile-retaining structure, and at least one of said track members including a channel which opens outwardly of said framework; and at least one tile retained between a pair of said vertically spaced track members by said tile-retaining structures thereof, said tile not covering said channel.

12. The partition system of claim 11, wherein said at least one tile is selectively locatable at one of a plurality of variable horizontally spaced locations along said track members irrespective of the positioning of said frame elements.

13. The partition system of claim 11, wherein said at least one tile is disposed facewise adjacent said framework.

14. A partition system, comprising:

a framework including a plurality of vertical frame elements, said vertical frame elements connected by a plurality of horizontal frame elements, said framework defining a pair of substantially vertical side faces;

at least two horizontal track members connected to at least one of said side faces of said framework, said track members vertically spaced from one another and including tile-retaining structure; and at least one tile having upper and lower edges thereof slidably retained between said track members and disposed facewise adjacent said framework, said tile selectively locatable horizontally along said track members irrespective of the positioning of said frame elements, wherein each said track member further includes a channel which opens outwardly of said framework, said channel not covered by said at least one tile.

15. A partition system, comprising:

a framework including a plurality of vertical frame elements, said vertical frame elements connected by a plurality of horizontal frame elements;

at least two horizontal track members each mounted exteriorly on said framework, said track members vertically spaced from one another and including vertically-oriented channels facing one another; and at least one tile having upper and lower edges thereof retained within said channels between said track members and disposed facewise adjacent said framework, said tile selectively locatable horizontally along said track members irrespective of the positioning of said frame elements, wherein each said track member further includes a channel which opens outwardly of said framework, said channel not covered by said at least one tile.

* * * * *

UNITED STATES PATENT AND TRADEMARK OFFICE

CERTIFICATE OF CORRECTION

PATENT NO. : 7,150,127 B2
APPLICATION NO. : 10/453187
DATED : December 19, 2006
INVENTOR(S) : Robert A. Underwood et al.

It is certified that error appears in the above-identified patent and that said Letters Patent is hereby corrected as shown below:

Claim 4, Column 27, Line 5, delete “alone” and insert --along--

Claim 6, Column 27, Line 43, delete “alone” and insert --along--

Signed and Sealed this

Thirteenth Day of March, 2007

JON W. DUDAS
*Director of the United States Patent and Trademark Office*